US009815061B2

(12) United States Patent
Delattre et al.

(10) Patent No.: US 9,815,061 B2
(45) Date of Patent: Nov. 14, 2017

(54) TECHNIQUES AND DROPLET ACTUATOR DESIGNS FOR REDUCING BUBBLE FORMATION

(71) Applicant: ADVANCED LIQUID LOGIC, INC., San Diego, CA (US)

(72) Inventors: Cyril Delattre, Izeaux (FR); Arnaud Rival, St Martin d'Hères (FR); Vijay Srinivasan, Cary, NC (US)

(73) Assignees: Advanced Liquid Logic, Inc., San Diego, CA (US); Illumina France SARL, Paris (FR)

( * ) Notice: Subject to any disclaimer, the term of this patent is extended or adjusted under 35 U.S.C. 154(b) by 250 days.

(21) Appl. No.: 14/549,113

(22) Filed: Nov. 20, 2014

(65) Prior Publication Data

US 2015/0075986 A1 Mar. 19, 2015

Related U.S. Application Data

(63) Continuation of application No. PCT/US2013/048319, filed on Jun. 27, 2013.
(Continued)

(51) Int. Cl.
*B01L 3/00* (2006.01)

(52) U.S. Cl.
CPC ..... *B01L 3/502784* (2013.01); *B01L 3/5029* (2013.01); *B01L 3/50273* (2013.01);
(Continued)

(58) Field of Classification Search
CPC ..... B01L 3/0268; B01L 3/502715; B01L 3/5029; B01L 3/50273; B01L 3/502784; B01L 3/502723
See application file for complete search history.

(56) References Cited

U.S. PATENT DOCUMENTS 4,127,460 A 11/1978 Gaske et al.
4,244,693 A 1/1981 Guon
(Continued)

FOREIGN PATENT DOCUMENTS

JP 2006078225 A 3/2006
JP 2006317364 A 11/2006
(Continued)

OTHER PUBLICATIONS

International Search Report and Written Opinion dated Oct. 8, 2013 for corresponding PCT International Application No. PCT/US2013/048319.

(Continued)

*Primary Examiner* — J. Christopher Ball
(74) *Attorney, Agent, or Firm* — Illumina, Inc.

(57) ABSTRACT

During droplet operations in a droplet actuator, bubbles often form in the filler fluid in the droplet operations gap and interrupt droplet operations. The present invention provides methods and systems for performing droplet operations on a droplet in a droplet actuator comprising maintaining substantially consistent contact between the droplet and an electrical ground while conducting multiple droplet operations on the droplet in the droplet operations gap and/or reducing the accumulation of electrical charges in the droplet operations gap during multiple droplet operations. The methods and systems reduce or eliminate bubble formation in the filler fluid of the droplet operations gap, thereby permitting completion of multiple droplet operations without interruption by bubble formation in the filler fluid in the droplet operations gap.

36 Claims, 24 Drawing Sheets

Related U.S. Application Data

(60) Provisional application No. 61/678,263, filed on Aug. 1, 2012, provisional application No. 61/666,417, filed on Jun. 29, 2012, provisional application No. 61/664,980, filed on Jun. 27, 2012.

(52) U.S. Cl.
CPC ... *B01L 3/502715* (2013.01); *B01L 3/502723* (2013.01); *B01L 3/52* (2013.01); *B01L 2200/06* (2013.01); *B01L 2200/0605* (2013.01); *B01L 2300/0645* (2013.01); *B01L 2300/088* (2013.01); *B01L 2300/089* (2013.01); *B01L 2300/0816* (2013.01); *B01L 2300/1827* (2013.01); *B01L 2400/0406* (2013.01); *B01L 2400/0409* (2013.01); *B01L 2400/0415* (2013.01); *B01L 2400/0427* (2013.01); *B01L 2400/0442* (2013.01)

(56) References Cited

U.S. PATENT DOCUMENTS 4,636,785 A 1/1987 Le Pesant
5,038,852 A 8/1991 Johnson et al.
5,176,203 A 1/1993 Larzul
5,181,016 A 1/1993 Lee
5,225,332 A 7/1993 Weaver et al.
5,266,498 A 11/1993 Tarcha et al.
5,455,008 A 10/1995 Earley et al.
5,472,881 A 12/1995 Beebe et al.
5,486,337 A 1/1996 Ohkawa et al.
5,498,392 A 3/1996 Wilding et al.
5,720,923 A 2/1998 Haff et al.
5,779,977 A 7/1998 Haff et al.
5,817,526 A 10/1998 Kinoshita et al.
5,827,480 A 10/1998 Haff et al.
5,945,281 A 8/1999 Prabhu et al.
5,998,224 A 12/1999 Rohr et al.
6,013,531 A 1/2000 Wang et al.
6,033,880 A 3/2000 Haff et al.
6,063,339 A 5/2000 Tisone et al.
6,130,098 A 10/2000 Handique et al.
6,152,181 A 11/2000 Wapner et al.
6,180,372 B1 1/2001 Franzen
6,294,063 B1 9/2001 Becker et al.
6,319,668 B1 11/2001 Nova et al.
6,453,928 B1 9/2002 Kaplan et al.
6,461,570 B2 10/2002 Ishihara et al.
6,548,311 B1 4/2003 Knoll
6,565,727 B1 5/2003 Shenderov
6,632,655 B1 10/2003 Mehta et al.
6,673,533 B1 1/2004 Wohlstadter et al.
6,734,436 B2 5/2004 Faris et al.
6,773,566 B2 8/2004 Shenderov
6,790,011 B1 9/2004 Le Pesant et al.
6,841,128 B2 1/2005 Kambara et al.
6,846,638 B2 1/2005 Shipwash
6,911,132 B2 6/2005 Pamula et al.
6,924,792 B1 8/2005 Jessop
6,955,881 B2 10/2005 Tanaami
6,977,033 B2 12/2005 Becker et al.
6,989,234 B2 1/2006 Kolar et al.
6,995,024 B2 2/2006 Smith et al.
7,052,244 B2 5/2006 Fouillet et al.
7,163,612 B2 1/2007 Sterling
7,189,359 B2 3/2007 Yuan
7,211,223 B2 5/2007 Fouillet et al.
7,211,442 B2 5/2007 Gilbert et
7,255,780 B2 8/2007 Shenderov
7,267,752 B2 9/2007 King et al.
7,328,979 B2 2/2008 Decre et al.
7,329,545 B2 2/2008 Pamula et al.
7,438,860 B2 10/2008 Takagi et al.
7,439,014 B2 10/2008 Pamula et al.
7,458,661 B2 12/2008 Kim et al.
7,495,031 B2 2/2009 Sakuma et al.
7,531,072 B2 5/2009 Roux et al.
7,547,380 B2 6/2009 Velev
7,556,776 B2 7/2009 Fraden et al.
7,569,129 B2 8/2009 Pamula et al.
7,579,172 B2 8/2009 Cho et al.
7,641,779 B2 1/2010 Becker et al.
7,727,466 B2 6/2010 Meathrel et al.
7,727,723 B2 6/2010 Pollack et al.
7,759,132 B2 7/2010 Pollack et al.
7,763,471 B2 7/2010 Pamula et al.
7,767,147 B2 8/2010 Adachi et al.
7,767,435 B2 8/2010 Chiu et al.
7,815,871 B2 10/2010 Pamula et al.
7,816,121 B2 10/2010 Pollack et al.
7,822,510 B2 10/2010 Paik et al.
7,851,184 B2 12/2010 Pollack et al.
7,875,160 B2 1/2011 Jary
7,901,947 B2 3/2011 Pollack et al.
7,919,330 B2 4/2011 De Guzman et al.
7,922,886 B2 4/2011 Fouillet et al.
7,939,021 B2 5/2011 Smith et al.
7,943,030 B2 5/2011 Shenderov
7,989,056 B2 8/2011 Plissonnier et al.
7,998,436 B2 8/2011 Pollack
8,007,739 B2 8/2011 Pollack et al.
8,041,463 B2 10/2011 Pollack et al.
8,048,628 B2 11/2011 Pollack et al.
8,075,754 B2 12/2011 Sauter-Starace et al.
8,088,578 B2 1/2012 Hua et al.
8,093,062 B2 1/2012 Winger et al.
8,093,064 B2 1/2012 Shah et al.
8,137,917 B2 3/2012 Pollack et al.
8,147,668 B2 4/2012 Pollack et al.
8,179,216 B2 5/2012 Knospe
8,202,686 B2 6/2012 Pamula et al.
8,208,146 B2 6/2012 Srinivasan et al.
8,221,605 B2 7/2012 Pollack et al.
8,236,156 B2 8/2012 Sarrut et al.
8,268,246 B2 9/2012 Srinivasan et al.
8,287,711 B2 10/2012 Pollack et al.
8,292,798 B2 10/2012 Califorrniaa
8,304,253 B2 11/2012 Yi et al.
8,313,698 B2 11/2012 Pollack et al.
8,317,990 B2 11/2012 Pamula et al.
8,337,778 B2 12/2012 Stone et al.
8,342,207 B2 1/2013 Raccurt et al.
8,349,276 B2 1/2013 Pamula et al.
8,364,315 B2 1/2013 Sturmer et al.
8,388,909 B2 3/2013 Pollack et al.
8,389,297 B2 3/2013 Pamula et al.
8,394,249 B2 3/2013 Pollack et al.
8,394,641 B2 3/2013 Winger
8,426,213 B2 4/2013 Eckhardt et al.
8,440,392 B2 5/2013 Pamula et al.
8,444,836 B2 5/2013 Fouillet et al.
2002/0001544 A1 1/2002 Hess et al.
2002/0005354 A1 1/2002 Spence et al.
2002/0036139 A1 3/2002 Becker et al.
2002/0043463 A1 4/2002 Shenderov
2002/0058332 A1 5/2002 Quake et al.
2002/0143437 A1 10/2002 Handique et al.
2003/0007898 A1 1/2003 Bohm et al.
2003/0049177 A1 3/2003 Smith et al.
2003/0164295 A1 9/2003 Sterling
2003/0183525 A1 10/2003 Elrod et al.
2003/0205632 A1 11/2003 Kim et al.
2004/0031688 A1 2/2004 Shenderov
2004/0055871 A1 3/2004 Walton et al.
2004/0055891 A1 3/2004 Pamula et al.
2004/0058450 A1 3/2004 Pamula et al.
2004/0086870 A1 5/2004 Tyvoll et al.
2004/0101445 A1 5/2004 Shvets et al.
2004/0180346 A1 9/2004 Anderson et al.
2004/0209376 A1 10/2004 Natan et al.
2004/0231987 A1 11/2004 Sterling et al.
2005/0189049 A1 9/2005 Ohno et al.
2005/0227349 A1 10/2005 Kim et al.

(56) References Cited

U.S. PATENT DOCUMENTS

2005/0282224 A1 12/2005 Fouillet et al.
2006/0021875 A1 2/2006 Griffith et al.
2006/0039823 A1 2/2006 Yamakawa et al.
2006/0040375 A1 2/2006 Arney et al.
2006/0054503 A1 3/2006 Pamula et al.
2006/0102477 A1 5/2006 Vann et al.
2006/0164490 A1 7/2006 Kim et al.
2006/0194331 A1 8/2006 Pamula et al.
2006/0210443 A1 9/2006 Stearns et al.
2006/0231398 A1 10/2006 Sarrut et al.
2007/0023292 A1 2/2007 Kim et al.
2007/0037294 A1 2/2007 Pamula et al.
2007/0045117 A1 3/2007 Pamula et al.
2007/0064990 A1 3/2007 Roth
2007/0075922 A1 4/2007 Jessop
2007/0086927 A1 4/2007 Natarajan et al.
2007/0179641 A1 8/2007 Lucas et al.
2007/0202538 A1 8/2007 Glezer et al.
2007/0207513 A1 9/2007 Sorensen et al.
2007/0217956 A1 9/2007 Pamula et al.
2007/0241068 A1 10/2007 Pamula et al.
2007/0242105 A1 10/2007 Srinivasan et al.
2007/0242111 A1 10/2007 Pamula et al.
2007/0243634 A1 10/2007 Pamula et al.
2007/0267294 A1 11/2007 Shenderov
2007/0275415 A1 11/2007 Srinivasan et al.
2008/0003142 A1 1/2008 Link et al.
2008/0003588 A1 1/2008 Hasson et al.
2008/0006535 A1 1/2008 Paik et al.
2008/0023330 A1 1/2008 Viovy
2008/0038810 A1 2/2008 Pollack et al.
2008/0044893 A1 2/2008 Pollack et al.
2008/0044914 A1 2/2008 Pamula et al.
2008/0050834 A1 2/2008 Pamula et al.
2008/0053205 A1 3/2008 Pollack et al.
2008/0105549 A1 5/2008 Pamela et al.
2008/0113081 A1 5/2008 Hossainy et al.
2008/0124252 A1 5/2008 Marchand et al.
2008/0142376 A1 6/2008 Fouillet et al.
2008/0151240 A1 6/2008 Roth
2008/0166793 A1 7/2008 Beer et al.
2008/0210558 A1 9/2008 Sauter-Starace et al.
2008/0247920 A1 10/2008 Pollack et al.
2008/0264797 A1 10/2008 Pamula et al.
2008/0274513 A1 11/2008 Shenderov et al.
2008/0281471 A1 11/2008 Smith et al.
2008/0283414 A1 11/2008 Monroe et al.
2008/0302431 A1 12/2008 Marchand et al.
2008/0305481 A1 12/2008 Whitman et al.
2009/0014394 A1 1/2009 Yi et al.
2009/0042319 A1 2/2009 De Guzman et al.
2009/0053726 A1 2/2009 Owen et al.
2009/0127123 A1 5/2009 Raccurt et al.
2009/0134027 A1 5/2009 Jary
2009/0142564 A1 6/2009 Plissonnier et al.
2009/0155902 A1 6/2009 Pollack et al.
2009/0192044 A1 7/2009 Fouillet
2009/0260988 A1 10/2009 Pamula et al.
2009/0263834 A1 10/2009 Sista et al.
2009/0280251 A1 11/2009 De Guzman et al.
2009/0280475 A1 11/2009 Pollack et al.
2009/0280476 A1 11/2009 Srinivasan et al.
2009/0283407 A1 11/2009 Shah et al.
2009/0288710 A1 11/2009 Viovy et al.
2009/0291433 A1 11/2009 Pollack et al.
2009/0304944 A1 12/2009 Sudarsan et al.
2009/0311713 A1 12/2009 Pollack et al.
2009/0321262 A1 12/2009 Adachi et al.
2010/0025242 A1 2/2010 Pamula et al.
2010/0025250 A1 2/2010 Pamula et al.
2010/0028920 A1 2/2010 Eckhardt
2010/0032293 A1 2/2010 Pollack et al.
2010/0041086 A1 2/2010 Pamula et al.
2010/0048410 A1 2/2010 Shenderov et al.
2010/0062508 A1 3/2010 Pamula et al.
2010/0068764 A1 3/2010 Sista et al.
2010/0087012 A1 4/2010 Shenderov et al.
2010/0096266 A1 4/2010 Kim et al.
2010/0116640 A1 5/2010 Pamula et al.
2010/0118307 A1 5/2010 Srinivasan et al.
2010/0120130 A1 5/2010 Srinivasan
2010/0126860 A1 5/2010 Srinivasan et al.
2010/0130369 A1 5/2010 Shenderov et al.
2010/0140093 A1 6/2010 Pamula et al.
2010/0143963 A1 6/2010 Pollack et al.
2010/0151439 A1 6/2010 Pamula et al.
2010/0190263 A1 7/2010 Srinivasan et al.
2010/0194408 A1 8/2010 Sturmer et al.
2010/0221713 A1 9/2010 Pollack et al.
2010/0236927 A1 9/2010 Pope et al.
2010/0236928 A1 9/2010 Srinivasan et al.
2010/0236929 A1 9/2010 Pollack et al.
2010/0258441 A1 10/2010 Sista et al.
2010/0270156 A1 10/2010 Srinivasan et al.
2010/0279374 A1 11/2010 Sista et al.
2010/0282608 A1 11/2010 Srinivasan et al.
2010/0282609 A1 11/2010 Pollack et al.
2010/0291578 A1 11/2010 Pollack
2010/0307917 A1 12/2010 Srinivasan
2010/0320088 A1 12/2010 Fouillet et al.
2010/0323405 A1 12/2010 Pollack et al.
2011/0076692 A1 3/2011 Sista et al.
2011/0086377 A1 4/2011 Thwar et al.
2011/0091989 A1 4/2011 Sista et al.
2011/0097763 A1 4/2011 Pollack et al.
2011/0100823 A1 5/2011 Pollack et al.
2011/0104725 A1 5/2011 Pamula et al.
2011/0104747 A1 5/2011 Pollack et al.
2011/0104816 A1 5/2011 Pollack et al.
2011/0114490 A1 5/2011 Pamula et al.
2011/0118132 A1 5/2011 Winger et al.
2011/0147215 A1 6/2011 Fuchs et al.
2011/0180571 A1 7/2011 Srinivasan et al.
2011/0186433 A1 8/2011 Pollack et al.
2011/0203930 A1 8/2011 Pamula et al.
2011/0209998 A1 9/2011 Shenderov
2011/0213499 A1 9/2011 Sturmer et al.
2011/0303542 A1 12/2011 Srinivasan et al.
2011/0311980 A1 12/2011 Pollack et al.
2012/0018306 A1 1/2012 Srinivasan et al.
2012/0044299 A1 2/2012 Winger
2012/0132528 A1 5/2012 Shenderov et al.
2012/0136147 A1 5/2012 Winger
2012/0165238 A1 6/2012 Pamula et al.
2013/0017544 A1 1/2013 Eckhardt et al.
2013/0018611 A1 1/2013 Sturmer
2013/0059366 A1 3/2013 Pollack et al.
2013/0217113 A1 8/2013 Srinivasan et al.
2013/0217583 A1 8/2013 Link et al.
2013/0280131 A1 10/2013 Handique et al.

FOREIGN PATENT DOCUMENTS

JP 2006329899 A 12/2006
JP 2006329904 A 12/2006
JP 2008096590 A 4/2008
WO 0069565 A1 11/2000
WO 0073655 A1 12/2000
WO 2003045556 6/2003
WO 2004011938 A2 2/2004
WO 2004029585 A1 4/2004
WO 2004030820 4/2004
WO 2004073863 A2 9/2004
WO 2005047696 A1 5/2005
WO 2005069015 A1 7/2005
WO 2006003292 A1 1/2006
WO 2006013303 A1 2/2006
WO 2006070162 A1 7/2006
WO 2006081558 8/2006
WO 2006085905 A1 8/2006
WO 2006124458 A2 11/2006
WO 2006127451 A2 11/2006
WO 2006129486 A1 12/2006
WO 2006132211 A1 12/2006

(56) References Cited

FOREIGN PATENT DOCUMENTS

| | | | |
|---|---|---|---|
| WO | 2006134307 | A1 | 12/2006 |
| WO | 2006138543 | | 12/2006 |
| WO | 2007003720 | A1 | 1/2007 |
| WO | 2007012638 | A1 | 2/2007 |
| WO | 2007033990 | A1 | 3/2007 |
| WO | 2007048111 | | 4/2007 |
| WO | 2007120240 | A2 | 10/2007 |
| WO | 2007120241 | A2 | 10/2007 |
| WO | 2007123908 | A2 | 11/2007 |
| WO | 2008051310 | A2 | 5/2008 |
| WO | 2008055256 | A3 | 5/2008 |
| WO | 2008068229 | A1 | 6/2008 |
| WO | 2008091848 | A2 | 7/2008 |
| WO | 2008098236 | A2 | 8/2008 |
| WO | 2008101194 | A2 | 8/2008 |
| WO | 2008106678 | A1 | 9/2008 |
| WO | 2008109664 | A1 | 9/2008 |
| WO | 2008112856 | A1 | 9/2008 |
| WO | 2008116209 | A1 | 9/2008 |
| WO | 2008116221 | A1 | 9/2008 |
| WO | 2008118831 | A2 | 10/2008 |
| WO | 2008124846 | A2 | 10/2008 |
| WO | 2008131420 | A2 | 10/2008 |
| WO | 2008134153 | A1 | 11/2008 |
| WO | 2009002920 | A1 | 12/2008 |
| WO | 2009003184 | A1 | 12/2008 |
| WO | 2009011952 | A1 | 1/2009 |
| WO | 2009021173 | A1 | 2/2009 |
| WO | 2009021233 | A2 | 2/2009 |
| WO | 2009026339 | A2 | 2/2009 |
| WO | 2009029561 | A2 | 3/2009 |
| WO | 2009032863 | A2 | 3/2009 |
| WO | 2009052095 | A1 | 4/2009 |
| WO | 2009052123 | A2 | 4/2009 |
| WO | 2009052321 | A2 | 4/2009 |
| WO | 2009052345 | A1 | 4/2009 |
| WO | 2009052348 | A2 | 4/2009 |
| WO | 2009076414 | | 6/2009 |
| WO | 2009086403 | A2 | 7/2009 |
| WO | 2009111769 | A2 | 9/2009 |
| WO | 2009135205 | A2 | 11/2009 |
| WO | 2009137415 | A2 | 11/2009 |
| WO | 2009140373 | A2 | 11/2009 |
| WO | 2009140671 | A2 | 11/2009 |
| WO | 2010004014 | A1 | 1/2010 |
| WO | 2010006166 | A2 | 1/2010 |
| WO | 2010009463 | A2 | 1/2010 |
| WO | 2010019782 | A2 | 2/2010 |
| WO | 2010027894 | A2 | 3/2010 |
| WO | 2010042637 | A2 | 4/2010 |
| WO | 2010077859 | A3 | 7/2010 |
| WO | 2011002957 | A2 | 1/2011 |
| WO | 2011020011 | A2 | 2/2011 |
| WO | 2011057197 | A2 | 5/2011 |
| WO | 2011084703 | A2 | 7/2011 |
| WO | 2011126892 | A2 | 10/2011 |
| WO | 2012009320 | A2 | 1/2012 |
| WO | 2012012090 | A2 | 1/2012 |
| WO | 2012037308 | A2 | 3/2012 |
| WO | 2012068055 | A3 | 5/2012 |
| WO | 2013009927 | A3 | 1/2013 |

OTHER PUBLICATIONS

Binks, "Wetting: theory and experiment", Current Opinion in Colloids and Interface Science, vol. 6, No. 1, 17-21, 2001.

Chamberlain, et al., "Deletion screening of Duchenne musular dystrophy locus via multiplex DNA amplification", Nuc. Acid. Res. 16, pp. 11141-11156, 1988.

Cho, et al., "Concentration and binary separation of micro particles for droplet-based digital microfluidics", Lab Chip, vol. 7, 490-498, 2007.

Coltro et al., "Toner and paper-based fabrication techniques for microfluidic applications", Electrophoresis, vol. 31, 2487-2498, Jul. 2010.

Dorfman, et al., "Contamination-Free Continuouse Flow Microfluidic Polymerase Chain Reaction for Quantitative and Clinical Applications", Analytical Chemistry 77, 3700-3704, 2005.

Fowler, "Labon-on-a-Chip Technology May Present New ESD Challenges", Electrostatic Discharge (ESD) Journal. Retrieved on Apr. 18, 2008 from:http://www.esdjournal.com/articles/labchip/Lab.htm., Mar. 2002.

Gijs, Mam, "Magnetic bead handling on-chip:new opportunities for analytical applications", Microfluidics and Nanofluidics, vol. 1, 22-40, Oct. 2, 2004.

Huang, et al., "MEMS-based sample preparation for molecular diagnostics", Analytical and Bioanalytical Chemistry, vol. 372, 49-65, 2002.

Jones, et al., "Dielectrophoretic liquid actuation and nanodroplet formation", J. Appl. Phys., vol. 89, No. 2, 1441-1448, Jan. 2001.

Kim, et al., "Electrowetting on paper for electronic paper display", ACS Applied Materials & Interfaces, vol. 2, 3318-3323, Nov. 2010.

Margulies, et al., "Genome sequencing in microfabricated high-density picolitre reactors", Nature, vol. 437, 376-380 and Supplemental Materials, 2005.

Pamula et al., "Digital Microfluidics for Lab-on-a-Chip Applications", "Emerging CAD Challenges for Biochip Design" Workshop, Conference on Design, Automation, and Test in Europe (DATE), Munich, Germany, Advance Programme, pp. 85-87, 2006.

Park, et al., "Single-sided continuous optoelectrowetting (SCOEW) droplet manipulation with light patterns", Lab on a chip, vol. 10, 1655-1661, Jul. 2010.

Pinho, et al., "Haemopoietic progenitors in the adult mouse omentum: permanent production of B lymphocytes and monocytes", Cell Tissue Res., vol. 319, No. 1, 91-102, Jan. 2005.

Poliski, Making materials fit the future: accommodating relentless technological requirements means researchers must recreate and reconfigure materials, frequently challenging established laws of physics, while keeping an eye on Moore's Law, R&D Magazine Conference, Dec. 2001.

Raj, et al., Composite Dielectrics and Surfactants for Low Voltage Electrowetting Devices, University/Government/Industry Micro/Nano Symposium, vol. 17, 187-190, Jul. 13-16, 2008.

Russom, et al., "Pyrosequencing in a Microfluidic Flow-Through Device", Anal. Chem. vol. 77, 7505-7511, 2005.

Schwartz, et al., "Dielectrophoretic approaches to sample preparation and analysis", The University of Texas, Dissertation, Dec. 2001.

Shah, et al., "EWOD-driven droplet microfluidic device integrated with optoelectronic tweezers as an automated platform for cellular isolation and analysis", Lab on a Chip, vol. 9, 1732-1739, Jun. 2009.

Tsuchiya, et al., "On-chip polymerase chain reaction microdevice employing a magnetic droplet-manipulation system", Sensors and Actuators B, vol. 130, 583-588, Oct. 18, 2007.

Welch, et al., "Picoliter DNA sequencing chemistry on an electrowetting-based digital microfluidic platform", Biotechnology Journal, vol. 6, 165-176, Feb. 2011.

Wheeler, et al., "Electrowetting-Based Microfluidics for Analysis of Peptides and Proteins by Matrix-Assisted Laser Desportion/Ionization Mass Spectrometry", Anal. Chem. 76, 4833-4838, 2004.

Yi et al., "Microfluidics technology for manipulation and analysis of biological cells", Analytica Chimica Acta, vol. 560, 1-23, 2006.

Bali et al., "Comparison of methods for the analysis of lysosomal enzyme activities in quality control dried blood spot specimens", 2013 International Conference on Inborn Errors of Metabolism (IEM): India. New Delhi, India. Poster presentation, abstract published in conference proceedings, Apr. 4-7, 2013.

Bali et al., "Comparison of Methods for the Analysis of Lysosomal Enzyme Activities in Quality Control Dried Blood Spot Specimens", LSD World Meeting, Orlando, FL, poster presented, Feb. 12-15, 2013.

Bali et al., "Digital microfluidics: a single multiplex platform for rapid newborn screening", 2013 International Conference on Inborn Errors of Metabolism (IEM): India, New Delhi, India, oral presentation,poster presentation, abstract published in conf. proceedings, Apr. 4-7, 2013.

(56) References Cited

OTHER PUBLICATIONS

Benton et al., "Library Preparation Method 1 DNA Library Construction for Illumine SBS Sequencing Platforms using NEBNext® Library Preparation Reagents", Application Note, NuGEN, 2011.
Boles et al., "Droplet-Based Pyrosequencing Using Digital Microfluidics", Analytical Chemistry, vol. 83, Sep. 2011, 8439-47.
Bottausci et al., "Fully Integrated EWOD Based Bio-Analysis Device", Labautomation 2011, Palm Springs Convention Center, Palm Springs, CA, USA; Abstract in Proceedings on line, poster distributed, Jan. 29-Feb. 2, 2011.
Burde et al., "Digital Microfluidic Rapid HIV Point-of-Care Diagnostic Device for Resource Limited Settings", Workshop on TB and HIV Diagnostics, Silver Spring, MD. (Poster, copies distributed to attendees.) http://www.blsmeetings.net/TB-HIV-Dx-Wkshop/index.cfm, Jun. 28, 2011.
Burton et al., "Diagnosis of Fabry and Gaucher diseases from the Pilot Screening of Newborns for Lysosomal Storage Disorders in Illinois", APHL Newborn Screening and Genetic Testing Symposium, San Diego, 2011.
Chakrabarty, "Automated Design of Microfluidics-Based Biochips: connecting Biochemistry of Electronics CAD", IEEE International Conference on Computer Design, San Jose, CA, Oct. 1-4, 2006, 93-100.
Chakrabarty et al., "Design Automation Challenges for Microfluidics-Based Biochips", DTIP of MEMS & MOEMS, Montreux, Switzerland, Jun. 1-3, 2005.
Chakrabarty et al., "Design Automation for Microfluidics-Based Biochips", ACM Journal on Engineering Technologies in Computing Systems , 1(3), Oct. 2005, 186-223.
Chakrabarty, "Design, Testing, and Applications of Digital Microfluidics-Based Biochips", Proceedings of the 18th International Conf. on VLSI held jointly with 4th International Conf. on Embedded Systems Design (VLSID'05), IEEE, Jan. 3-7, 2005.
Chen et al., "Development of Mesoscale Actuator Device with Micro Interlocking Mechanism", J. Intelligent Material Systems and Structures, vol. 9, No. 4, Jun. 1998, pp. 449-457.
Chen et al., "Mesoscale Actuator Device with Micro Interlocking Mechanism", Proc. IEEE Micro Electro Mechanical Systems Workshop, Heidelberg, Germany, Jan. 1998, pp. 384-389.
Chen et al., "Mesoscale Actuator Device: Micro Interlocking Mechanism to Transfer Macro Load", Sensors and Actuators, vol. 73, Issues 1-2, Mar. 1999, pp. 30-36.
Cohen, "Automated Multianalyte Screening Tool for Classification of Forensic Samples", NIJ conference 2012, http://www.nij.gov/nij/events/nij_conference/2012/nij-2012-program-book.pdf, 2012.
Cohen, "Low Cost Sample-to-Sequence Device for Human & Pathogen ID", Integrating Sample Prep, Baltimore, MD, Oct. 18, 2012.
Cohen, "Digital Microfluidic Sample Prep & Bioanalytical Systems", BioDot Workshop: From R&D to Quantitative IVDs, Irvine, CA, Apr. 24, 2012.
Cotten et al., "Digital Microfluidics: a novel platform for multiplexed detection of lysosomal storage diseases", Abstract # 3747.9. Pediatric Academic Society Conference, 2008.
Delapierre et al., "SmartDrop: An Integrated System from Sample Collection to Result using real-time PCR," 4th National Bio-Threat Conference, Dec. 7-9, 2010, New Orleans, LA, USA; Abstract in Proceedings, Poster presented at conference.
Delattre, Movie in news on TF1 (at 12'37" Cyril Delattre) http://videos.tf1.fr/jt-we/zoom-sur-grenoble-html, 2009, (English translation of audio).
Delattre, Movie in talk show "C Dans l'air" (at 24" Cyril Delattre), http://www.france5.fr/c-dans-l-air/sante/bientot-vous-ne-serez-plus-malade-31721, 2009, (English translation of audio).
Delattre, Movie on Web TV—Cite des sciences (at 3'26" Cyril Delattre), http://www.universcience.tv/video-laboratoire-de-poche-793.html, 2009, (English translation of audio).
Delattre et al., "Macro to microfluidics system for biological environmental monitoring", Biosensors and Bioelectronics, vol. 36, Issue 1, 2012, Available online, Apr. 27, 2012, 230-235.
Delattre et al., "SmartDrop: an integrated system from sample preparation to analysis using real-time PCR", 10th International Symposium on Protection against Chemical and Biological Warfare Agents; Stockholm, Sweden; poster, Jun. 10, 2010.
Delattre et al., "SmartDrop: An integrated system from sample preparation to analysis using real-time PCR", 10th International Symposium on Protection against Chemical and Biological Warfare Agents; Stockholm, Sweden; Abstract,paper,, Jun. 8-11, 2010.
Delattre et al., "Towards an industrial fabrication process for electrowetting chip using standard MEMS Technology", μTAS2008, San Diego; poster presented, Oct. 15, 2008.
Delattre et al., "Towards an industrial fabrication process for electrowetting chip using standard MEMS Technology", μTAS2008, San Diego; Abstract in proceedings, Oct. 13-16, 2008, 1696-1698.
Dewey, "Towards a Visual Modeling Approach to Designing Microelectromechanical System Transducers", Journal of Micromechanics and Microengineering, vol. 9, Dec. 1999, 332-340.
Dewey et al., "Visual modeling and design of microelectromechanical system tansducers", Microelectronics Journal, vol. 32, Apr. 2001, 373-381.
Eckhardt et al., "Development and validation of a single-step fluorometric assay for Hunter syndrome", APHL Newborn Screening and Genetic Testing Symposium, San Diego, 2011.
Emani et al., "Novel microfluidic platform for automated lab-on-chip testing of hypercoagulability panel", Blood Coagulation and Fibrinolysis, vol. 23(8), 2012, 760-8.
Emani et al., "Novel Microfluidic Platform for Point of Care Hypercoagulability Panel Testing", Circulation, vol. 122, 2010, A14693.
Fair et al., "A Micro- Watt Metal-Insulator-Solution-Transport (MIST) Device for Scalable Digital Bio-Microfluidic Systems", IEEE IEDM Technical Digest, 2001, 16.4.1-4.
Fair et al., "Advances in droplet-based bio lab-on-a-chip", BioChips 2003, Boston, 2003.
Fair et al., "Bead-Based and Solution-Based Assays Performed on a Digital Microfluidic Platform", Biomedical Engineering Society (BMES) Fall Meeting, Baltimore, MD, Oct. 1, 2005.
Fair, "Biomedical Applications of Electrowetting Systems", 5th International Electrowetting Workshop, Rochester, NY, May 31, 2006.
Fair et al., "Chemical and Biological Applications of Digital-Microfluidic Devices", IEEE Design & Test of Computers, vol. 24(1), Jan.-Feb. 2007, 10-24.
Fair et al., "Chemical and biological pathogen detection in a digital microfluidic platform", DARPA Workshop on Microfluidic Analyzers for DoD and National Security Applications, Keystone, CO, 2006.
Fair, "Digital microfluidics: is a true lab-on-a-chip possible?", Microfluid Nanofluid, vol. 3, Mar. 8, 2007, 245-281.
Fair, "Droplet-based microfluidic Genome sequencing", NHGRI PI's meeting, Boston, 2005.
Fair et al., "Electrowetting-based On-Chip Sample Processing for Integrated Microfluidics", IEEE Inter. Electron Devices Meeting (IEDM), 2003, 32.5.1-32.5.4.
Fair et al., "Integrated chemical/biochemical sample collection, pre-concentration, and analysis on a digital microfluidic lab-on-a-chip platform", Lab-on-a-Chip: Platforms, Devices, and Applications, Conf. 5591, SPIE Optics East, Philadelphia, Oct. 25-28, 2004.
Fair, "Scaling of Digital Microfluidic Devices for Picoliter Applications", The 6th International Electrowetting Meeting, Aug. 20-22, 2008, p. 14.
Fouillet, "Bio-Protocol Integration in Digital Microfluidic Chips", The 6th International Electrowetting Meeting, Aug. 20-22, 2008, p. 15.
Fouillet et al., "Design and Validation of a Complex Generic Fluidic Microprocessor Based on EWOD Droplet for Biological Applications", 9th International Conference on Miniaturized Systems for Chem and Life Sciences, Boston, MA, Oct. 9-13, 2005, 58-60.
Fouillet et al., "Digital microfluidic design and optimization of classic and new fluidic functions for lab on a chip systems", Microfluid Nanofluid, vol. 4, 2008, 159-165.

(56) References Cited

OTHER PUBLICATIONS

Graham et al., "Development of Quality Control Spots for Lysosomal Storage Disorders under cGMP", APHL Newborn Screening and Genetic Testing Symposium, San Diego, 2011.
Graham et al., "Fluorometric reagent kits for screening Lysosomal Storage Disorders: One year stability evaluation and shelf-life recommendations", Extended abstract from the 2013 APHL Newborn Screening and Genetic Testing Symposium and the International Society for Neonatal Screening, Atlanta, GA.
Graham et al., "Fluorometric reagent kits for screening Lysosomal Storage Disorders: One year stability evaluation and shelf-life recommendations", 2013 APHL Newborn Screening and Genetic Testing Symposium and the International Society for Neonatal Screening,Atlanta, GA.Poster presented, abstract published in conference proceedings, May 5-10, 2013.
Hua et al., "Multiplexed real-time polymerase chain reaction on a digital microfluidic platform", Analytical Chemistry, vol. 82, No. 6, Mar. 15, 2010, Published on Web, Feb. 12, 2010, 2310-2316.
Hua et al., "Rapid Detection of Methicillin-Resistant *Staphylococcus Aureus* (MRSA) Using Digital Microfluidics", 12th Intl Conference on Miniaturized Systems for Chemistry and Life Sciences, Proc. μTAS, Oct. 12-16, 2008.
Jary et al., "Development of complete analytical system for Environment and homeland security", 14th International Conference on Biodetection Technologies 2009, Technological Responses to Biological Threats, Baltimore, MD; Abstract in Proceedings, poster distributed at conference, Jun. 25-26, 2009, 663.
Jary et al., "SmartDrop, Microfluidics for Biology", Forum 4i 2009, Grenoble, France; Flyer distributed at booth, May 14, 2009.
Jun et al., "Valveless Pumping using Traversing Vapor Bubbles in Microchannels", J. Applied Physics, vol. 83, No. 11, Jun. 1998, pp. 5658-5664.
Kim et al., "MEMS Devices Based on the Use of Surface Tension", Proc. Int. Semiconductor Device Research Symposium (ISDRS'99), Charlottesville, VA, Dec. 1999, pp. 481-484.
Kim, "Microelectromechanical Systems (MEMS) at the UCLA Micromanufacturing Lab", Dig. Papers, Int. Microprocesses and Nanotechnology Conf. (MNC'98), Kyungju, Korea, Jul. 1998, pp. 54-55.
Kim et al., "Micromachines Driven by Surface Tension", AIAA 99/3800, 30th AIAA Fluid Dynamics Conference, Norfolk, VA, (Invited lecture), Jun. 1999, pp. 1-6.
Kleinert et al., "Digital microfluidic platform for newborn screening using whole blood in hospital settings for hyperbilirubinemia", Extended abstract from the 2013 APHL Newborn Screening and Genetic Testing Symposium and the International Society for Neonatal Screening.
Kleinert et al., "Digital microfluidic platform for newborn screening using whole blood in hospital settings for hyperbilirubinemia", 2013 APHL Newborn Screening and Genetic Testing Symposium and the International Society for Neonatal Screening, Atlanta, GA, Poster presented, abstract published in proceedings, May 5-10, 2013.
Kleinert et al., "Dynamics and Stability of Oil Films During Droplet Transport by Electrowetting", 86th ACS Colloid & Surface Science Symposium, Abstract, Jun. 13, 2012.
Kleinert et al., "Dynamics and Stability of Oil Films During Droplet Transport by Electrowetting", 86th ACS Colloid & Surface Science Symposium, Presentation, Jun. 13, 2012.
Kleinert et al., "Dynamics and stability of oil films during droplet transport by electrowetting", 8th International Meeting on Electrowetting, Athens, Greece, Jun. 21-23, 2012.
Kleinert et al., "Electric Field Assisted Convective Assembly of Colloidal Crystal Coatings", Symposium MM: Evaporative Self Assembly of Polymers, Nanoparticles, and DNA, 2010 MRS Spring Meeting, San Francisco, CA., Apr. 6-8, 2010.
Kleinert et al., "Electric Field-Assisted Convective Assembly of Large-Domain Colloidal Crystals", The 82nd Colloid & Surface Science Symposium, ACS Division of Colloid & Surface Science, North Carolina State University, Raleigh, NC. www.colloids2008.org., Jun. 15-18, 2008.
Kleinert, "Electric-Field-Assisted Convective Assembly of Colloidal Crystal Coatings", Langmuir, vol. 26(12), May 13, 2010, 10380-10385.
Kleinert et al., "Evaluation of a Digital Microfluidic Platform for Point of Care Newborn Screening of Hyperbilirubinemia, Congenital Hypothyroidism and G6PD Deficiency in Emerging Programs", Pediatric Academic Societies Annual Meeting, Washington, D.C, Abstract, http://www.abstracts2view.com/pas/., May 4-7, 2013.
Kleinert et al., "Evaluation of a Digital Microfluidic Platform for Point of Care Newborn Screening of Hyperbilirubinemia, Congenital Hypothyroidism and G6PD Deficiency in Emerging Programs", Pediatric Academic Societies Annual Meeting,Washington, D.C., Poster, May 4-7, 2013.
Kleinert, "Liquid Transport and Colloidal Self Assembly in Thin Wetting Films Driven by Electric Fields", PhD Dissertation, North Carolina State University, 2013.
Lee et al., "Microactuation by Continuous Electrowetting Phenomenon and Silicon Deep Rie Process", Proc. MEMS (DSC—vol. 66) ASME Int. Mechanical Engineering Congress and Exposition, Anaheim, CA, Nov. 1998, 475-480.
Lee et al., "Liquid Micromotor Driven by Continuous Electrowetting", Proc. IEEE Micro Electro Mechanical Systems Workshop, Heidelberg, Germany, Jan. 1998, pp. 538-543.
Lee et al., "Theory and Modeling of Continuous Electrowetting Microactuation", Proc. Mems (MEMS—vol. 1), ASME Int. Mechanical Engineering Congress and Exposition, Nashville, TN, Nov. 1999, pp. 397-403.
Malk et al., "EWOD in coplanar electrode configurations", Proceedings of ASME 2010 3rd Joint US-European Fluids Engineering Summer Meeting and 8th International Conference on Nanochannels, Microchannels, and Minichannels, http://asmedl.org/getabs/servlet/GetabsServlet?prog=normal &id=ASMECP0020100545010002390000, Aug. 1-5, 2010.
Marchand et al., "Organic Synthesis in Soft Wall-Free Microreactors: Real-Time Monitoring of Fluorogenic Reactions", Analytical Chemistry, vol. 80, Jul. 2, 2008, 6051-6055.
Millington et al., "Applications of tandem mass spectrometry and microfluidics in newborn screening", Southeastern Regional Meeting of the American Chemical Society, Raleigh, North Carolina, 2012.
Millington et al., "Digital microfluidics: a future technology in the newborn screening laboratory", Seminars in Perinatology, vol. 34, Apr. 2010, 163-169.
Millington et al., "Digital Microfluidics: a novel platform for multiplexed detection of LSDs with potential for newborn screening", Association of Public Health Laboratories Annual Conference, San Antonio, TX, Nov. 4, 2008.
Millington et al., "Digital Microfluidics: A Novel Platform for Multiplexing Assays Used in Newborn Screening", Proceedings of the7th International and Latin American Congress. Oral Presentations. Rev Invest Clin; vol. 61 (Supt. 1), 2009, 21-33.
Mugele et al., "Electrowetting: from basics to applications", Institution of Physics Publishing, Journal of Physics: Condensed Matter, 2005, R705-R774.
Nuffer et al., "Sample-to-Sequence Analyzer for Human ID Applications", 23rd International Symposium for Human Identification, Nashville, TN. http://www.promega.com/~/media/files/resources/conference%20proceedings/ishi%2023/poster%20abstracts/32 %20poster.pdf?la=en, Oct. 16-17, 2012.
Paik et al., "A digital-microfluidic approach to chip cooling", IEEE Design & Test of Computers, vol. 25, Jul. 2008, 372-381.
Paik et al., "Adaptive Cooling of Integrated Circuits Using Digital Microfluidics", IEEE Transactions on VLSI, vol. 16, No. 4, 2008, 432-443.
Paik et al., "Adaptive Cooling of Integrated Circuits Using Digital Microfluidics", accepted for publication in IEEE Transactions on VLSI Systems, 2007, and Artech House, Norwood, MA, 2007.
Paik, "Adaptive Hot-Spot Cooling of Integrated Circuits Using Digital Microfluidics", Dissertation, Dept. of Electrical and Computer Engineering, Duke University, Apr. 25, 2006, 1-188.

(56) References Cited

OTHER PUBLICATIONS

Paik et al., "Adaptive hot-spot cooling of integrated circuits using digital microfluidics", Proceedings ASME International Mechanical Engineering Congress and Exposition, Orlando, Florida, USA. IMECE2005-81081, Nov. 5-11, 2005, 1-6.
Paik et al., "Coplanar Digital Microfluidics Using Standard Printed Circuit Board Processes", 9th International Conference on Miniaturized Systems for Chemistry and Life Sciences (MicroTAS), Boston, MA; Poster, 2005.
Paik et al., "Coplanar Digital Microfluidics Using Standard Printed Circuit Board Processes", 9th Int'l Conf. on Miniaturized Systems for Chemistry and Life Sciences, Boston, MA, Oct. 9-13, 2005, 566-68.
Paik et al., "Droplet-Based Hot Spot Cooling Using Topless Digital Microfluidics on a Printed Circuit Board", Int'l Workshops on Thermal Investigations of ICs and Systems (THERMINIC), 2005, 278-83.
Paik et al., "Electrowetting-based droplet mixers for microfluidic systems", Lab on a Chip (LOC), vol. 3. (more mixing videos available, along with the article, at LOC's website), 2003, 28-33.
Paik et al., "Programmable Flow-Through Real Time PCR Using Digital Microfluidics", 11th International Conference on Miniaturized Systems for Chemistry and Life Sciences, Paris, France, Oct. 7-11, 2007, 1559-1561.
Paik et al., "Programmable flow-through real-time PCR using digital microfluidics", Proc. Micro Total Analysis Systems (μTAS), Handout, 2007.
Paik et al., "Programmable flow-through real-time PCR using digital microfluidics", Proc. Micro Total Analysis Systems (μTAS), Poster, 2007.
Paik et al., "Rapid Droplet Mixers for Digital Microfluidic Systems", Masters Thesis, Duke Graduate School., 2002, 1-82.
Paik et al., "Rapid droplet mixers for digital microfluidic systems", Lab on a Chip, vol. 3. (More mixing videos available, along with the article, at LOC's website.), 2003, 253-259.
Paik et al., "Thermal effects on Droplet Transport in Digital Microfluids with Application to Chip Cooling Processing for Integrated Microfluidics", International Conference on Thermal, Mechanics, and Thermomechanical Phenomena in Electronic Systems (ITherm), 2004, 649-654.
Pamula, "A digital microfluidic platform for multiplexed explosive detection", Chapter 18, Electronics Noses and Sensors for the Detection of Explosives, Eds., J.W. Gardner and J. Yinon, Kluwer Academic Publishers, 2004.
Pamula et al., "A droplet-based lab-on-a-chip for colorimetric detection of nitroaromatic explosives", Proceedings of Micro Electro Mechanical Systems, 2005, 722-725.
Pamula et al., "Cooling of integrated circuits using droplet-based microfluidics", Proc. ACM Great Lakes Symposium on VLSI, Apr. 2003, 84-87.
Pamula, "Digital microfluidic lab-on-a-chip for multiplexing tests in newborn screening", Newborn Screening Summit: Envisioning a Future for Newborn Screening, Bethesda, MD, Dec. 7, 2009.
Pamula et al., "Digital microfluidic lab-on-a-chip for protein crystallization", 5th Protein Structure Initiative "Bottlenecks" Workshop, NIH, Bethesda, MD, Apr. 13-14, 2006, I-16.
Pamula et al., "Digital Microfluidic Methods in Diagnosis of Neonatal Biochemical Abnormalities", Developing Safe and Effective Devices and Instruments for Use in the Neonatal Intensive Care for the 21st Century, Pediatric Academic Societies' Annual Meeting, Vancouver, Canada, May 1-4, 2010.
Pamula et al., "Digital Microfluidic Platform for Multiplexing LSD Assays in Newborn Screening", LSD World Meeting, Las Vegas, NV, Feb. 16-18, 2011.
Pamula et al., "Digital Microfluidics Platform for Lab-on-a-chip applications", Duke University Annual Post Doctoral Research Day, 2002.
Pamula et al., "Microfluidic electrowetting-based droplet mixing", IEEE, 2002, 8-10.
Pamula et al., "Rapid LSD assays on a multiplex digital microfluidic platform for newborn screening", Lysosomal Disease Network World Symposium 2012, San Diego, CA, Feb. 8-19, 2012, 39.
Pamula, "Sample Preparation and Processing using Magnetic Beads on a Digital Microfluidic Platform", CHI's Genomic Sample Prep, San Francisco, CA, Jun. 9-10, 2009.
Pamula, "Sample-to-sequence-molecular diagnostics on a digital microfluidic lab on a chip", Pre-conference workshops, 4th International Conference on Birth Defects and Disabilities in the Developing World, New Dehli, India, Oct. 4, 2009.
Panchapakesan, "Droplet Feedback Mechanisms on a Digital Microfluidic Platform and Development of Hyperbilirubinemia Panel", PhD Dissertation, University at Buffalo, State University of New York, Jan. 9, 2013.
Pollack et al., "Applications of Electrowetting-Based Digital Microfluidics in Clinical Diagnostics", Expert Rev. Mol. Diagn., vol. 11(4), 2011, 393-407.
Pollack et al., "Continuous sequencing-by-synthesis-based on a digital microfluidic platform", National Human Genome Research Institute, Advanced Dna Sequencing Technology Development Meeting, Chapel Hill, NC, Mar. 10-11, 2010.
Pollack, et al., "Electrowetting-Based Actuation of Droplets for Integrated Microfluidics", Lab on a Chip (LOC), vol. 2, 2002, 96-101.
Pollack et al., "Electrowetting-based actuation of liquid droplets for microfluidic applications", Appl. Phys. Letters, vol. 77, No. 11, Sep. 11, 2000, 1725-1726.
Pollack, "Electrowetting-based Microactuation of Droplets for Digital Microfluidics", PhD Thesis, Department of Electrical and Computer Engineering, Duke University, 2001.
Pollack et al., "Electrowetting-Based Microfluidics for High-Throughput Screening", smallTalk 2001 Conference Program Abstract, San Diego, Aug. 27-31, 2001, 149.
Pollack et al., "Investigation of electrowetting-based microfluidics for real-time PCR applications", Proc. 7th Int'l Conference on Micro Total Analysis Systems (mTAS), Squaw Valley, CA, Oct. 5-9, 2003, 619-622.
Pollack, "Lab-on-a-chip platform based digital microfluidics", The 6th International Electrowetting Meeting, Aug. 20-22, 2008, 16.
Pollack, "Sample Preparation Using Digital Microfluidics", Sample Prep 2012, Knowledge Press, Inc., May 3-4, 2012.
Punnamaraju, "Voltage and Photo Induced Effects in Droplet-Interface-Bilayer Lipid", PhD Thesis, University of Cincinnati, 2011.
Punnamaraju et al., "Voltage Control of Droplet Interface Bilayer Lipid Membrane Dimensions", Langmuir The ACS Journal of Surfaces and Colloids, vol. 27, Issue 2, 2011, Published on Web, Dec. 10, 2010, 618-626.
Ren et al., "Automated electrowetting-based droplet dispensing with good reproducibility", Proc. Micro Total Analysis Systems (mTAS), 7th Int. Conf.on Miniaturized Chem and Biochem Analysis Systems, Squaw Valley, CA, Oct. 5-9, 2003, 993-996.
Ren et al., "Automated on-chip droplet dispensing with vol. control by electro-wetting actuation and capacitance metering", Sensors and Actuators B: Chemical, vol. 98, Mar. 2004, 319-327.
Ren et al., "Design and testing of an interpolating mixing architecture for electrowetting-based droplet-on-chip chemical dilution", Transducers, 12th International Conference on Solid-State Sensors, Actuators and Microsystems, 2003, 619-622.
Ren et al., "Dynamics of electro-wetting droplet transport", Sensors and Actuators B (Chemical), vol. B87, No. 1, Nov. 15, 2002, 201-206.
Ren et al., "Micro/Nano Liter Droplet Formation and Dispensing by Capacitance Metering and Electrowetting Actuation", IEEE-NANO, 2002, 369-372.
Rival et al., "EWOD Digital Microfluidic Device for Single Cells Sample Preparation and Gene Expression Analysis", Lab Automation 2010, Palm Springs Convention Center, Palm Springs, CA, USA; Abstract in Proceedings, Poster distributed at conference, Jan. 23-27, 2010.
Rival et al., "Expression de genes de quelques cellules sur puce EWOD/Gene expression of few cells on EWOD chip",

(56) References Cited

OTHER PUBLICATIONS iRTSV,http://www-dsv.cea.fr/var/plain/storage/original/media/File/iRTSV/thema_08(2).pdf (english translation), Winter 2009-2010.
Rival et al., "New insight on droplet dynamics under electrowetting actuation and design tools for speeding up product development", 8th Electrowetting Workshop, Athens, Greece. Abstract, 2012.
Rival et al., "New insight on droplet dynamics under electrowetting actuation and design tools for speeding up product development", 8th Electrowetting Workshop, Athens, Greece, Presentation, 2012.
Rival et al., "Towards Single Cells Gene Expression on EWOD Lab on Chip", ESONN 2008, Grenoble, France; Poster presented, Aug. 26, 2008.
Rival et al., "Towards single cells gene expression on EWOD lab on chip", ESONN, Grenoble, France, abstract in proceedings, Aug. 2008.
Rival et al., "Towards single cells gene expression preparation and analysis on ewod lab on chip", Nanobio Europe 2009, Poster distributed at conference, Jun. 16-18, 2009.
Rival et al., "Towards single cells gene expression preparation and analysis on ewod lab on chip", Nanobio Europe 2009, Abstract in proceedings, Jun. 16-18, 2009.
Rival et al., "Towards single cells gene expression preparation and analysis on ewod lab on chip", Lab on Chip Europe 2009 poster distributed at Conference, May 19-20, 2009.
Rival et al., "Towards single cells gene expression preparation and analysis on ewod lab on chip", Lab on Chip Europe 2009, Abstract in proceedings, May 19-20, 2009.
Rouse et al., "Digital microfluidics: a novel platform for multiplexing assays used in newborn screening", Poster 47, 41st AACC's Annual Oak Ridge Conference Abstracts, Clinical Chemistry, vol. 55, 2009, 1891.
Sandahl et al., "Automated Multianalyte Screening for Classification of Forensic Samples", 23rd International Symposium for Human Identification, Nashville, TN. http://www.promega.com/~/media/files/resources/conference%20proceedings/ishi%2023/poster%20abstracts/31%20poster.pdf?la=en, Oct. 16-17, 2012.
Schell et al., "Evaluation of a Digital Microfluidic real-time PCR Platform to detect DNA of Candida albicans", Eur. J. Clin Microbiol Infect Dis, Published on-line DOI 10.1007/s10096-012-15616, Feb. 2012.
Sherman et al., "Flow Control by Using High-Aspect-Ratio, In-Plane Microactuators", Sensors and Actuators, vol. 73, 1999, pp. 169-175.
Sherman et al., "In-Plane Microactuator for Fluid Control Application", Proc. IEEE Micro Electro Mechanical Systems Workshop, Heidelberg, Germany, Jan. 1998, pp. 454-459.
Shi et al., "Evaluation of stability of fluorometric reagent kits for screening of Lysosomal Storage Disorders", APHL Newborn Screening and Genetic Testing Symposium, San Diego, 2011.
Sista et al., "96-Immunoassay Digital Microfluidic Multiwell Plate", Proc. μTAS, Oct. 12-16, 2008.
Sista, "Development of a Digital Microfluidic Lab-on-a-Chip for Automated Immunoassays with Magnetically Responsive Beads", PhD Thesis, Department of Chemical Engineering, Florida State University, 2007.
Sista et al., "Development of a digital microfluidic platform for point of care testing", Lab on a chip, vol. 8, Dec. 2008, First published as an Advance Article on the web, Nov. 5, 2008, 2091-2104.
Sista et al., "Development of digital microfluidic assays for galactosemia and biotinidase deficiency in newborn dried blood spot samples", 2013 APHL Newborn Screening and Genetic Testing Symposium and the International Society for Neonatal Screening, Atlanta, GA. Poster presented, abstract in conference proceedings, May 5-10, 2013.
Sista et al., "Development of digital microfluidic assays for galactosemia and biotinidase deficiency in newborn dried blood spot samples", Extended abstract from the 2013 APHL Newborn Screening and Genetic Testing Symposium and the International Society for Neonatal Screening, Atlanta, GA, Extended abstract to be published summer 2013-13 confirmed.
Sista et al., "Digital Microfluidic Platform for Multiplexing Enzyme Assays: Implications for Lysosomal Storage Disease Screening in Newborns", Clinical Chemistry, vol. 57, Aug. 22, 2011, 1444-51.
Sista et al., "Digital Microfluidic platform for multiplexing LSD assays in newborn screening", APHL Newborn Screening and Genetic Testing Symposium, Orlando, May 3-6, 2010.
Sista et al., "Digital Microfluidic Platform to Consolidate Enzymatic Assays on Dried Blood Spot Samples for Rapid Newborn Screening", 2013 Canadian Newborn and Child Screening Symposium, Ottawa, Canada, Poster, Apr. 11-12, 2013.
Sista et al., "Heterogeneous immunoassays using magnetic beads on a digital microfluidic platform", Lab on a Chip, vol. 8, Dec. 2008, First published as an Advance Article on the web, Oct. 14, 2008, 2188-2196.
Sista et al., "Multiplex digital microfluidic platform for newborn screening of lysosomal storage disorders", 2013 Pediatric Academic Societies Annual Meeting PAS (Pediatric Academic Society), Washington, D.C., poster presented, abstract published online http://www.abstracts2view.com/pas/, May 4-7, 2013.
Sista et al., "Multiplex Digital Microfluidic Platform for Rapid Newborn Screening of Lysosomal Storage Disorders", ACMG Annual Meeting, Charlotte, NC, 2012.
Sista et al., "Multiplex Newborn Screening for Pompe, Fabry, Hunter, Gaucher, and Hurler Diseases Using a Digital Microfluidic Platform", Clinica Chimica Acta, vol. 424. available on line http://dx.doi.org/10.1016/j.cca.2013.05.001, May 7, 2013, 12-18.
Sista et al., "Performance of a digital microfluidic assay for Gaucher and Hurler disorders", APHL Newborn Screening and Genetic Testing Symposium, San Diego, 2011.
Sista et al., "Performance of multiple enzymatic assays on dried blood spot samples for rapid newborn screening using digital microfluidics", 2013 Oak Ridge Conference (AACC), Baltimore, MD, poster presentation, Apr. 18-19, 2013.
Sista et al., "Rapid assays for Gaucher and Hurler diseases in dried blood spots using digital microfluidics", Molecular Genetics and Metabolism. vol. 109. Available online http://dx.doi.org/10.1016/j.ymgme.2013.03.010, 2013, 218-220.
Sista et al., "Rapid, Single-Step Assay for Hunter Syndrome in Dried Blood Spots Using Digital Microfluidics", Clinica Chimica Acta, vol. 412, 2011, 1895-97.
Sista et al., "Spatial multiplexing of immunoassays for small-volume samples", 10th PI Meeting IMAT, Bethesda, 2009.
Srinivasan et al., "3-D imaging of moving droplets for microfluidics using optical coherence tomography", Proc. 7th International Conference on Micro Total Analysis Systems (mTAS), Squaw Valley, CA, Oct. 5-9, 2003, 1303-1306.
Srinivasan et al., "A digital microfluidic biosensor for multianalyte detection", Proc. IEEE 16th Annual Int'l Conf. on Micro Electro Mechanical Systems Conference, 2003, 327-330.
Srinivasan, "A Digital Microfluidic Lab-on-a-Chip for Clinical Diagnostic Applications", Ph.D. thesis, Dept of Electrical and Computer Engineering, Duke University, 2005.
Srinivasan et al., "An integrated digital microfluidic lab-on-a-chip for clinical diagnostics on human physiological fluids", Lab on a Chip, vol. 4, 2004, 310-315.
Srinivasan et al., "Clinical diagnostics on human whole blood, plasma, serum, urine, saliva, sweat and tears on a digital microfluidic platform", Proc. 7th International Conference on Micro Total Analysis Systems (mTAS), Squaw Valley, CA, Oct. 5-9, 2003, 1287-1290.
Srinivasan et al., "Commercializing electrowetting-based digital microfluidics: from the lab to a product", 8th International Meeting on Electrowetting, Athens, Greece, Jun. 21-23, 2012.
Srinivasan et al., "Digital Microfluidic Lab-on-a-Chip for Protein Crystallization", The 82nd ACS Colloid and Surface Science Symposium, 2008.
Srinivasan et al., "Digital Microfluidics: a novel platform for multiplexed detection of lysosomal storage diseases for newborn screening", AACC Oak Ridge Conference Abstracts, Clinical Chemistry, vol. 54, 2008, 1934.

(56) References Cited

OTHER PUBLICATIONS

Srinivasan et al., "Droplet-based microfluidic lab-on-a-chip for glucose detection", Analytica Chimica Acta, vol. 507, No. 1, 2004, 145-150.
Srinivasan et al., "Electrowetting", Chapter 5, Methods in Bioengineering: Biomicrofabrication and Biomicrofluidics, Ed. J.D. Zahn, ISBN: 9781596934009, Artech House Publishers, 2010.
Srinivasan et al., "Feasibility of a point of care newborn screening platform for hyperbilirubinemia", APHL Newborn Screening and Genetic Testing Symposium, San Diego, 2011.
Srinivasan et al., "Low cost digital microfluidic platform for protein crystallization", Enabling Technologies for Structural Biology, NIGMS Workshop, Bethesda, MD., Mar. 4-6, 2009, J-23.
Srinivasan et al., "Protein Stamping for MALDI Mass Spectrometry Using an Electrowetting-based Microfluidic Platform", Lab-on-a-Chip: Platforms, Devices, and Applications, Conf. 5591, SPIE Optics East, Philadelphia, Oct. 25-28, 2004.
Srinivasan et al., "Scalable Macromodels for Microelectromechanical Systems", Technical Proc. 2001 Int. Conf. on Modeling and Simulation of Microsystems, 2001, 72-75.
Su et al., "Yield Enhancement of Digital Microfluidics-Based Biochips Using Space Redundancy and Local Reconfiguration", Proc. Design, Automation and Test in Europe (DATE) Conf., IEEE, 2005, 1196-1201.
Sudarsan et al., "Printed circuit technology for fabrication of plastic based microfluidic devices", Analytical Chemistry vol. 76, No. 11, Jun. 1, 2004, Previously published online, May 2004, 3229-3235.
Thwar et al., "DNA sequencing using digital microfluidics", Poster 42, 41st AACC's Annual Oak Ridge Conference Abstracts, Clinical Chemistry vol. 55, 2009, 1891.
Tolun et al., "A Novel Fluorometric Enzyme Analysis Method for Hunter Syndrome Using Dried Blood Spots", Mol. Genet. Metab., 105, Issue 3, 2012; doi:10.1016/j.ymgme.2011.12.011, Epub, Dec. 21, 2011, 519-521.
Tolun et al., "Dried blood spot based enzyme assays for lysosomal storage disorders", 2011 Tokyo Meeting on Lysosomal Storage Disease Screening, Tokyo, Aug. 5, 2011.
Wang et al., "Comparison of enzyme activities for Pompe, Fabry, and Gaucher diseases on CDC's Quality Control spots between microplate fluorometry, mass spectrometry, and digital microfluidic fluorometry", APHL Newborn Screening and Genetic Testing Symposium, San Diego, 2011.
Wang et al., "Droplet-based micro oscillating-flow PCR chip", J. Micromechanics and Microengineering, vol. 15, 2005, 1369-1377.
Wang et al., "Efficient in-droplet separation of magnetic particles for digital microfluidics", Journal of Micromechanics and Microengineering, vol. 17, 2007, 2148-2156.
Weaver, "Application of Magnetic Microspheres for Pyrosequencing on a Digital Microfluidic Platform", Department of Electrical and Computer Engineering, Duke University, 2005.
Wulff-Burchfield et al., "Microfluidic platform versus conventional real-time polymerase chain reaction for the detection of Mycoplasma pneumoniae in respiratory specimens", Diagnostic Microbiology and Infectious Disease, vol. 67, 2010, 22-29.
Xu et al., "A Cross-Referencing-Based Droplet Manipulation Method for High-Throughput and Pin-Constrained Digital Microfluidic Arrays", Proceedings of conference on Design, Automation and Test in Europe, Apr. 2007.
Xu et al., "Automated Design of Pin-Constrained Digital Microfluidic Biochips Under Droplet-Interference Constraints", ACM Journal on Emerging Technologies is Computing Systems, vol. 3(3), 2007, 14:1-14:23.
Xu et al., "Automated solution preparation on a digital microfluidic lab-on-chip", PSI Bottlenecks Workshop, 2008.
Xu et al., "Automated, Accurate and Inexpensive Solution-Preparation on a Digital Microfluidic Biochip", Proc. IEEE Biomedical Circuits and Systems Conference (BioCAS), 2008, 301-304.
Xu et al., "Defect-Aware Synthesis of Droplet-Based Microfluidic Biochips", IEEE, 20th International Conference on VLSI Design, 2007.
Xu et al., "Defect-Tolerant Design and Optimization of a Digital Microfluidic Biochip for Protein Crystallization", IEEE Transactions on Computer Aided Design, vol. 29, No. 4, 2010, 552-565.
Xu et al., "Design and Optimization of a Digital Microfluidic Biochip for Protein Crystallization", Proc. IEEE/ACM International Conference on Computer-Aided Design (ICCAD), Nov. 2008, 297-301.
Xu et al., "Digital Microfluidic Biochip Design for Protein Crystallization", IEEE-NIH Life Science Systems and Applications Workshop, LISA, Bethesda, MD, Nov 8-9, 2007, 140-143.
Xu et al., "Droplet-Trace-Based Array Partitioning and a Pin Assignment Algorithm for the Automated Design of Digital Microfluidic Biochips", CODES, 2006, 112-117.
Xu et al., "Integrated Droplet Routing in the Synthesis of Microfluidic Biochips", IEEE, 2007, 948-953.
Xu et al., "Parallel Scan-Like Test and Multiple-Defect Diagnosis for Digital Microfluidic Biochips", IEEE Transactions on Biomedical Circuits and Systems, vol. 1(2), Jun. 2007, 148-158.
Xu et al., "Parallel Scan-Like Testing and Fault Diagnosis Techniques for Digital Microfluidic Biochips", Proceedings of the 12th IEEE European Test Symposium (ETS), Freiburg, Germany, May 20-24, 2007, 63-68.
Yang et al., "Manipulation of droplets in microfluidic systems", Trends in Analytical Chemistry, vol. 29, Feb. 2010, 141-157.
Yao et al., "Spot Cooling Using Thermoelectric Microcooler", Proc. 18th Int. Thermoelectric Conf, Baltimore, VA, pp. 256-259, Aug. 1999.
Yi et al., "Channel-to-droplet extractions for on-chip sample preparation", Solid-State Sensor, Actuators and Microsystems Workshop (Hilton Head '06), Hilton Head Island, SC, Jun. 2006, 128-131.
Yi et al., "Characterization of electrowetting actuation on addressable single-side coplanar electrodes", Journal of Micromechanics and Microengineering, vol. 16.,Oct. 2006, 2053-2059.
Yi et al., "EWOD Actuation with Electrode-Free Cover Plate", Digest of Tech. papers, 13th International Conference on Solid-State Sensors, Actuators and Microsystems (Transducers '05), Seoul, Korea, Jun. 5-9, 2005, 89-92.
Yi et al., "Geometric surface modification of nozzles for complete transfer of liquid drops", Solid-State Sensor, Actuator and Microsystems Workshop, Hilton Head Island, South Carolina, Jun. 6-10, 2004, 164-167.
Yi, "Soft Printing of Biological Liquids for Micro-arrays: Concept, Principle, Fabrication, and Demonstration", Ph.D. dissertation, UCLA, 2004.
Yi et al., "Soft Printing of Droplets Digitized by Electrowetting", Transducers 12th Int'l Conf. on Solid State Sensors, Actuators and Microsystems, Boston, Jun. 8-12, 2003, 1804-1807.
Yi et al., "Soft Printing of Droplets Pre-Metered by Electrowetting", Sensors and Actuators A: Physical, vol. 114, Jan. 2004, 347-354.
Zeng et al., "Actuation and Control of Droplets by Using Electrowetting-on-Dielectric", Chin. Phys. Lett., vol. 21(9), 2004, 1851-1854.
Zhao et al., "Droplet Manipulation and Microparticle Sampling on Perforated Microfilter Membranes", J. Micromech. Microeng., vol. 18, 2008, 1-11.
Zhao et al., "In-droplet particle separation by travelling wave dielectrophoresis (twDEP) and EWOD", Solid-State Sensor, Actuators and Microsystems Workshop (Hilton Head '06), Hilton Head Island, SC, Jun. 2006, 181-184.
Zhao et al., "Micro air bubble manipulation by electrowetting on dielectric (EWOD): transporting, splitting, merging and eliminating of bubbles", Lab on a chip, vol. 7, 2007, First published as an Advance Article on the web, Dec. 4, 2006, 273-280.
Zhao et al., "Microparticle Concentration and Separation byTraveling-Wave Dielectrophoresis (twDEP) for Digital Microfluidics", J. Microelectromechanical Systems, vol. 16, No. 6, Dec. 2007, 1472-1481.
Zhao et al., "Optimization Techniques for the Synchronization of Concurrent Fluidic Operations in Pin-Constrained Digital Microfluidic Biochips", IEEE Transactions on Very Large Scale Integration (VLSI) Systems, vol. 20, No. 6, Jun. 2012, 1132-1145.

(56) References Cited

OTHER PUBLICATIONS

Zhao et al., "Synchronization of Concurrently-Implemented Fluidic Operations in Pin-Constrained Digital Microfluidic Biochips", VLSI Design, (Best Paper Award), 2010.
International Preliminary Report on Patentability dated Oct. 4, 2013 from related International Patent Application No. PCT/US2013/048319.

TECHNIQUES AND DROPLET ACTUATOR DESIGNS FOR REDUCING BUBBLE FORMATION

RELATED APPLICATIONS

This application is a continuation of and claims priority to PCT International Patent Application No. PCT/US2013/048319, entitled "Techniques and Droplet Actuator Designs for Reducing Bubble Formation," filed on Jun. 27, 2013, the application of which is related to and claims priority to U.S. Provisional Patent Application No. 61/664,980, filed on Jun. 27, 2012, entitled "Methods of Providing a Reliable Ground Connection to Droplets in a Droplet Actuator and Thereby Reduce or Eliminate Air Bubble Formation"; U.S. Provisional Patent Application No. 61/666,417, filed on Jun. 29, 2012, entitled "Reduction of Bubble Formation in a Droplet Actuator"; and U.S. Provisional Patent Application No. 61/678,263, filed on Aug. 1, 2012 entitled "Techniques and Droplet Actuator Designs for Reducing Bubble Formation"; the entire disclosures of which are specifically incorporated herein by reference.

FIELD OF THE INVENTION

The invention relates to methods and systems for reducing or eliminating bubble formation in droplet actuators, thereby permitting completion of multiple droplet operations without interruption by bubble formation.

BACKGROUND

A droplet actuator typically includes one or more substrates configured to form a surface or gap for conducting droplet operations. The one or more substrates establish a droplet operations surface or gap for conducting droplet operations and may also include electrodes arranged to conduct the droplet operations. The droplet operations substrate or the gap between the substrates may be coated or filled with a filler fluid that is immiscible with the liquid that forms the droplets. Bubble formation in the filler fluid in a droplet actuator can interfere with functionality of the droplet actuator. There is a need for techniques for preventing unwanted bubbles from forming in the filler fluid in a droplet actuator.

BRIEF DESCRIPTION OF THE INVENTION

A method of performing droplet operations on a droplet in a droplet actuator is provided, the method including: (a) providing a droplet actuator including a top substrate and a bottom substrate separated to form a droplet operations gap, where the droplet actuator further includes an arrangement of droplet operations electrodes arranged for conducting droplet operations thereon; (b) filling the droplet operations gap of the droplet actuator with a filler fluid; (c) providing a droplet in the droplet operations gap; (d) conducting multiple droplet operations on the droplet in the droplet operations gap, where the droplet is transported through the filler fluid in the droplet operations gap; and (e) maintaining substantially consistent contact between the droplet and an electrical ground while conducting the multiple droplet operations on the droplet in the droplet operations gap; where the substantially consistent contact between the droplet and the electrical ground permits completion of the multiple droplet operations without interruption by bubble formation in the filler fluid in the droplet operations gap. In certain embodiments, the method further includes heating the droplet in the droplet operations gap, particularly heating the droplet to at least sixty percent of boiling point. In other embodiments, the droplet is heated to a minimum temperature of seventy five degrees Celsius. In other embodiments, the droplet is heated to within twenty degrees Celsius of boiling point. In certain embodiments, conducting the multiple droplet operations without the interruption by the bubble formation in the filler fluid in the droplet operations gap includes conducting at least 10, at least 100, at least 1,000, or at least 100,000 droplet operations. In other embodiments, conducting the multiple droplet operations without the interruption by the bubble formation in the filler fluid in the droplet operations gap includes completing an assay or completing multiple cycles of a polymerase chain reaction. In other embodiments, the droplet includes multiple droplets in the droplet operations gap, and substantially consistent contact is maintained between multiple droplets and the electrical ground while conducting multiple droplet operations on the multiple droplets in the droplet operations gap. In another embodiment, the filler fluid is an electrically conductive filler fluid.

In other embodiments, maintaining substantially consistent contact between the droplet and the electrical ground while conducting the multiple droplet operations on the droplet in the droplet operations gap includes grounding the top substrate of the droplet actuator to the electrical ground and maintaining substantially consistent contact between the droplet and the top substrate. In other embodiments, maintaining substantially consistent contact between the droplet and the electrical ground while conducting the multiple droplet operations on the droplet in the droplet operations gap includes texturing the surface of the top substrate. In other embodiments, maintaining substantially consistent contact between the droplet and the electrical ground while conducting the multiple droplet operations on the droplet in the droplet operations gap includes adjusting a height of the droplet operations gap, particularly reducing the height of the droplet operations gap. In some embodiments, the height of the droplet operations gap may be adjusted with a spring. In certain embodiments, maintaining substantially consistent contact between the droplet and the electrical ground while conducting the multiple droplet operations on the droplet in the droplet operations gap includes moving the electrical ground toward the droplet. In certain embodiments, maintaining substantially consistent contact between the droplet and the electrical ground while conducting the multiple droplet operations on the droplet in the droplet operations gap includes merging the droplet with another droplet.

In certain embodiments, the method of performing droplet operations on a droplet in a droplet actuator further includes: (i) heating the droplet in a zone of the droplet operations gap; and (ii) arranging the electrical ground coplanar to the droplet operations electrodes in the zone to maintain the substantially consistent contact between the droplet and the electrical ground while conducting the multiple droplet operations on the droplet in the droplet operations gap.

In other embodiments, the droplet operations electrodes are arranged on one or both of the bottom and/or top substrates. In other embodiments, maintaining substantially consistent contact between the droplet and the electrical ground while conducting the multiple droplet operations on the droplet in the droplet operations gap includes providing the droplet operations electrodes in various arrangements, including an overlapping arrangement, an interdigitated arrangement, or a triangular arrangement.

In certain embodiments, the method of performing droplet operations on a droplet in a droplet actuator further includes: (i) bounding the droplet operations gap with a sidewall and an opposite sidewall to create a droplet operations channel; (ii) arranging the droplet operations electrodes on the sidewall; (iii) arranging one or more ground electrodes along the opposite sidewall; and (iv) connecting the one or more ground electrodes to the electrical ground; where the substantially consistent contact with the electrical ground while conducting the multiple droplet operations on the droplet in the droplet operations gap is unaffected by gravity. In some embodiments, the sidewall includes a first rail and the opposite sidewall includes a second rail, where the first rail and second rail are elongated three-dimensional (3D) structures that are arranged in parallel with each other. The method may further include offsetting positions of the droplet operations electrodes and the position of the one or more ground electrodes. The method may also include where the one or more ground electrodes are a continuous strip. The method may further include oppositely arranging each droplet operations electrode to each one or more ground electrode.

In other embodiments, the method of performing droplet operations on a droplet in a droplet actuator further includes: (i) bounding the droplet operations gap with a sidewall and an opposite sidewall to create a droplet operations channel; (ii) arranging the droplet operations electrodes on the sidewall; (iii) arranging one or more ground electrodes along the bottom substrate; and (iv) connecting the one or more ground electrodes to the electrical ground; where the substantially consistent contact with the electrical ground while conducting the multiple droplet operations on the droplet in the droplet operations gap is unaffected by gravity. In some embodiments, the sidewall includes a first rail and the opposite sidewall includes a second rail, where the first rail and second rail are elongated three-dimensional (3D) structures that are arranged in parallel with each other.

In certain embodiments, the method of performing droplet operations on a droplet in a droplet actuator further includes: (i) applying a voltage to transport the droplet from an unactivated electrode to an activated electrode; and (ii) reducing electrical charges in the droplet operations gap as the droplet is transported to the activated electrode;

where bubble formation in the filler fluid in the droplet operations gap is reduced or eliminated. In other embodiments, the method further includes heating the droplet in the droplet operations gap. In certain embodiments, the electrical charges may be reduced by adjusting a height of the droplet operations gap, particularly reducing the height of the droplet operations gap, or texturing the surface of the top substrate.

In other embodiments, the method of performing droplet operations on a droplet in a droplet actuator further includes: (i) applying a voltage to transport the droplet from an unactivated electrode to an activated electrode; and (ii) reducing discharge of electrical charges as the droplet is transported to the activated electrode; where bubble formation in the filler fluid in the droplet operations gap is reduced or eliminated. In other embodiments, the method further includes heating the droplet in the droplet operations gap. In certain embodiments, the discharge of electrical charges may be reduced by adjusting a height of the droplet operations gap, particularly reducing the height of the droplet operations gap, or texturing the surface of the top substrate.

In certain embodiments, a method of performing droplet operations on a droplet in a droplet actuator is provided, including: (a) providing a droplet actuator including a top substrate and a bottom substrate separated to form a droplet operations gap, where the droplet actuator further includes an arrangement of droplet operations electrodes arranged for conducting droplet operations thereon; (b) filling the droplet operations gap of the droplet actuator with a filler fluid; (c) providing a droplet in the droplet operations gap; (d) heating the droplet to within twenty degrees Celsius of boiling to produce a heated droplet; (e) conducting multiple droplet operations on the heated droplet in the droplet operations gap, where the heated droplet is transported through the filler fluid in the droplet operations gap; and (f) reducing accumulation of electrical charges in the droplet operations gap as the heated droplet is transported through the filler fluid in the droplet operations gap; where the reduced accumulation of electrical charges in the droplet operations gap permits completion of the multiple droplet operations without interruption by bubble formation in the filler fluid in the droplet operations gap.

Systems for performing droplet operations on a droplet in a droplet actuator are also provided. In some embodiments, the system includes a processor for executing code and a memory in communication with the processor, and code stored in the memory that causes the processor at least to: (a) provide a droplet in the droplet operations gap of a droplet actuator, where the droplet actuator includes a top substrate and a bottom substrate separated to form the droplet operations gap, and where the droplet actuator further includes an arrangement of droplet operations electrodes arranged for conducting droplet operations thereon; (b) fill the droplet operations gap of the droplet actuator with a filler fluid; (c) heat the droplet in a zone of the droplet operations gap to within twenty degrees Celsius of boiling to produce a heated droplet; (d) conduct multiple droplet operations on the heated droplet in the droplet operations gap, where the heated droplet is transported through the filler fluid in the zone of the droplet operations gap; and (e) maintain substantially consistent contact between the heated droplet and an electrical ground while conducting the multiple droplet operations on the heated droplet in the zone of the droplet operations gap; where the substantially consistent contact between the heated droplet and the electrical ground permits completion of the multiple droplet operations without interruption by bubble formation in the filler fluid in the zone of the droplet operations gap. In some embodiments, the code causing the processor to conduct the multiple droplet operations without the interruption by the bubble formation in the filler fluid in the zone of the droplet operations gap includes conducting at least 10, at least 100, at least 1,000, or at least 100,000 droplet operations. In further embodiments, the code further causes the processor to complete an assay or to complete multiple cycles of a polymerase chain reaction without the interruption by the bubble formation in the filler fluid in the zone of the droplet operations gap.

In certain embodiments of the system for performing droplet operations on a droplet in a droplet actuator, the code further causes the processor to ground the top substrate of the droplet actuator to the electrical ground, where maintaining substantially consistent contact between the heated droplet and the electrical ground includes means for maintaining substantially consistent contact between the heated droplet and the top substrate while conducting the multiple droplet operations on the heated droplet in the zone of the droplet operations gap. In some embodiments, maintaining substantially consistent contact between the heated droplet and the electrical ground includes means for adjusting a height of the droplet operations gap, particularly reducing the height of the droplet operations gap. In some embodiments, the means for adjusting the height of the droplet operations gap includes a spring. In other embodiments, maintaining substantially consistent contact between the heated droplet and the electrical ground includes means for texturing the surface of the top substrate of the droplet operations gap. In some embodiments, maintaining substantially consistent contact between the heated droplet and the electrical ground includes means for moving the electrical ground toward the droplet. In other embodiments, maintaining substantially consistent contact between the heated droplet and the electrical ground includes means for arranging the electrical ground coplanar to the droplet operations electrodes in the zone. In certain embodiments, maintaining substantially consistent contact between the heated droplet and the electrical ground includes means for merging the droplet with another droplet.

In other embodiments of the system for performing droplet operations on a droplet in a droplet actuator, the droplet operations electrodes are arranged on one or both of the bottom and/or top substrates. In other embodiments of the system, maintaining substantially consistent contact between the heated droplet and the electrical ground while conducting the multiple droplet operations on the heated droplet in the zone of the droplet operations gap includes providing the droplet operations electrodes in various arrangements, including an overlapping arrangement, an interdigitated arrangement, or a triangular arrangement. In certain embodiments, maintaining substantially consistent contact between the heated droplet and the electrical ground includes means for decreasing a distance between adjacent droplet operations electrodes.

In other embodiments of the system, maintaining substantially consistent contact between the heated droplet and the electrical ground includes means for: (i) bounding the droplet operations gap with a sidewall and an opposite sidewall to create a droplet operations channel; (ii) arranging the droplet operations electrodes on the sidewall; (iii) arranging one or more ground electrodes along the bottom substrate; and (iv) connecting the one or more ground electrodes to the electrical ground; where the substantially consistent contact with the electrical ground while conducting the multiple droplet operations on the droplet in the droplet operations gap is unaffected by gravity. In some embodiments, the sidewall includes a first rail and the opposite sidewall includes a second rail, where the first rail and second rail are elongated three-dimensional (3D) structures that are arranged in parallel with each other. In other embodiments of the system, maintaining substantially consistent contact between the heated droplet and the electrical ground includes means for offsetting positions of the droplet operations electrodes to the positions of the one or more ground electrodes. In other embodiments of the system, maintaining substantially consistent contact between the heated droplet and the electrical ground includes means for arranging the one or more ground electrodes as a continuous strip. In other embodiments of the system, maintaining substantially consistent contact between the heated droplet and the electrical ground includes means for oppositely arranging each droplet operations electrode to each one or more ground electrodes.

In other embodiments of the system, maintaining substantially consistent contact between the heated droplet and the electrical ground includes means for: (i) bounding the droplet operations gap with a sidewall and an opposite sidewall to create a droplet operations channel; (ii) arranging the droplet operations electrodes on the sidewall; (iii) arranging one or more ground electrodes along the bottom substrate; and (iv) connecting the one or more ground electrodes to the electrical ground;

where the substantially consistent contact with the electrical ground while conducting the multiple droplet operations on the droplet in the droplet operations gap is unaffected by gravity. In some embodiments, the sidewall includes a first rail and the opposite sidewall includes a second rail, where the first rail and second rail are elongated three-dimensional (3D) structures that are arranged in parallel with each other.

In another embodiment, a system for performing droplet operations on a droplet in a droplet actuator is provided, including a processor for executing code and a memory in communication with the processor, the system including code stored in the memory that causes the processor at least to: (a) provide a droplet in the droplet operations gap of a droplet actuator, where the droplet actuator includes a top substrate and a bottom substrate separated to form the droplet operations gap, and where the droplet actuator further includes an arrangement of droplet operations electrodes arranged for conducting droplet operations thereon; (b) fill the droplet operations gap of the droplet actuator with a filler fluid; (c) provide a droplet in the droplet operations gap; (d) heat the droplet to within twenty degrees Celsius of boiling to produce a heated droplet; (e) conduct multiple droplet operations on the heated droplet in the droplet operations gap, where the heated droplet is transported through the filler fluid in the droplet operations gap; and (f) reduce accumulation of electrical charges in the droplet operations gap as the heated droplet is transported through the filler fluid in the droplet operations gap; where the reduced accumulation of electrical charges in the droplet operations gap permits completion of the multiple droplet operations without interruption by bubble formation in the filler fluid in the droplet operations gap.

A computer readable medium storing processor executable instructions for performing a method of performing droplet operations on a droplet in a droplet actuator is also provided, the method including: (a) providing a droplet actuator including a top substrate and a bottom substrate separated to form a droplet operations gap, and where the droplet actuator further includes an arrangement of droplet operations electrodes arranged for conducting droplet operations thereon; (b) filling the droplet operations gap of the droplet actuator with a filler fluid; (c) providing a droplet in the droplet operations gap; (d) conducting multiple droplet operations on the droplet in the droplet operations gap, where the droplet is transported through the filler fluid in the droplet operations gap; and (e) maintaining substantially consistent contact between the droplet and an electrical ground while conducting the multiple droplet operations on the droplet in the droplet operations gap; where the substantially consistent contact between the droplet and the electrical ground permits completion of the multiple droplet operations without interruption by bubble formation in the filler fluid in the droplet operations gap.

In another embodiment, a computer readable medium storing processor executable instructions for performing a method of performing droplet operations on a droplet in a droplet actuator is also provided, the method including: (a) providing a droplet actuator including a top substrate and a bottom substrate separated to form a droplet operations gap, and where the droplet actuator further includes an arrangement of droplet operations electrodes arranged for conducting droplet operations thereon; (b) filling the droplet operations gap of the droplet actuator with a filler fluid; (c)

providing a droplet in the droplet operations gap; (d) heating the droplet to within twenty degrees Celsius of boiling to produce a heated droplet; (e) conducting multiple droplet operations on the heated droplet in the droplet operations gap, where the heated droplet is transported through the filler fluid in the droplet operations gap; and (f) reducing accumulation of electrical charges in the droplet operations gap as the heated droplet is transported through the filler fluid in the droplet operations gap; where the reduced accumulation of electrical charges in the droplet operations gap permits completion of the multiple droplet operations without interruption by bubble formation in the filler fluid in the droplet operations gap.

A droplet actuator is also provided, including: (a) a top substrate and a bottom substrate separated to form a droplet operations gap, where the droplet operations gap is filled with a filler fluid; (b) a sidewall and an opposite sidewall bounding the droplet operations gap, thereby creating a droplet operations channel; (c) an arrangement of droplet operations electrodes on the sidewall; and (d) an arrangement of one or more ground electrodes along the opposite sidewall, where the one or more ground electrodes are connected to an electrical ground; where multiple droplet operations may be conducted on one or more droplets in the droplet operations gap while maintaining substantially consistent contact between the one or more droplets and the one or more ground electrodes, thereby permitting completion of the multiple droplet operations without interruption by bubble formation in the filler fluid in the droplet operations gap, and where the multiple droplet operations are unaffected by gravity. In some embodiments, the sidewall includes a first rail and the opposite sidewall includes a second rail, where the first rail and second rail are elongated three-dimensional (3D) structures that are arranged in parallel with each other.

These and other embodiments are described more fully below.

DEFINITIONS

Figure 1A:
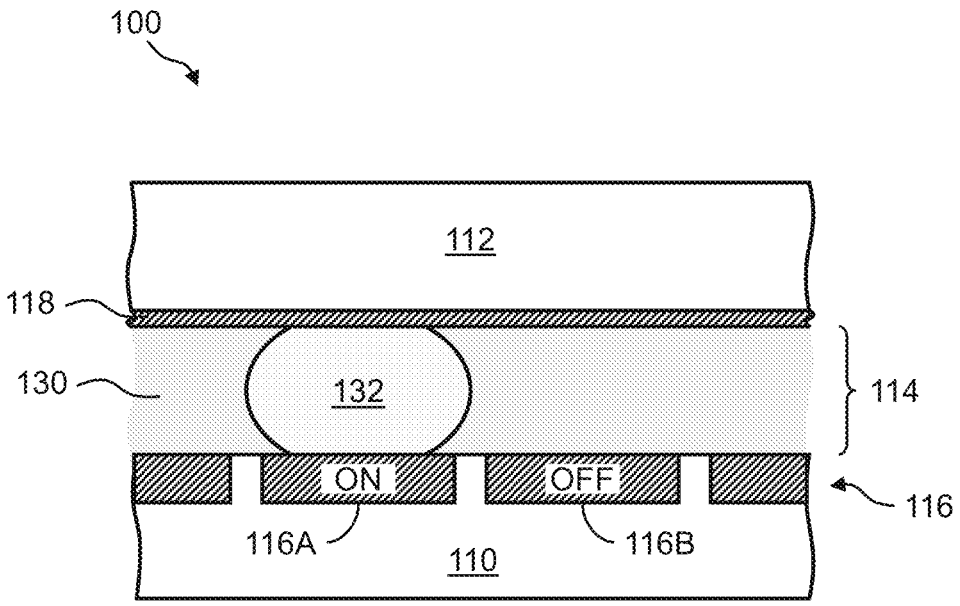
FIGS. 1A, 1B, 1C, and 1D illustrate side views of a portion of a droplet actuator and a droplet operations process in which the droplet loses contact with the ground or reference electrode of the top substrate.

As used herein, the following terms have the meanings indicated.

"Activate," with reference to one or more electrodes, means affecting a change in the electrical state of the one or more electrodes which, in the presence of a droplet, results in a droplet operation. Activation of an electrode can be accomplished using alternating or direct current. Any suitable voltage may be used. For example, an electrode may be activated using a voltage which is greater than about 150 V, or greater than about 200 V, or greater than about 250 V, or from about 275 V to about 1000 V, or about 300 V. Where alternating current is used, any suitable frequency may be employed. For example, an electrode may be activated using alternating current having a frequency from about 1 Hz to about 10 MHz, or from about 10 Hz to about 60 Hz, or from about 20 Hz to about 40 Hz, or about 30 Hz.

"Bubble" means a gaseous bubble in the filler fluid of a droplet actuator. In some cases, bubbles may be intentionally included in a droplet actuator, such as those described in U.S. Patent Pub. No. 20100190263, entitled "Bubble Techniques for a Droplet Actuator," published on Jul. 29, 2010, the entire disclosure of which is incorporated herein by references. The present invention relates to undesirable bubbles which are formed as a side effect of various processes within a droplet actuator, such as evaporation or hydrolysis of a droplet in a droplet actuator. A bubble may be at least partially bounded by filler fluid. For example, a bubble may be completely surrounded by filler fluid or may be bounded by filler fluid and one or more surfaces of the droplet actuator. As another example, a bubble may be bounded by filler fluid, one or more surfaces of the droplet actuator, and/or one or more droplets in the droplet actuator.

"Droplet" means a volume of liquid on a droplet actuator that is at least partially bounded by a filler fluid. Droplets may, for example, be aqueous or non-aqueous or may be mixtures or emulsions including aqueous and non-aqueous components. Droplets may take a wide variety of shapes; nonlimiting examples include generally disc shaped, slug shaped, truncated sphere, ellipsoid, spherical, partially compressed sphere, hemispherical, ovoid, cylindrical, combinations of such shapes, and various shapes formed during droplet operations, such as merging or splitting or formed as a result of contact of such shapes with one or more surfaces of a droplet actuator. For examples of droplet fluids that may be subjected to droplet operations using the approach of the invention, see International Patent Application No. PCT/US 06/47486, entitled, "Droplet-Based Biochemistry," filed on Dec. 11, 2006. In various embodiments, a droplet may include a biological sample, such as whole blood, lymphatic fluid, serum, plasma, sweat, tear, saliva, sputum, cerebrospinal fluid, amniotic fluid, seminal fluid, vaginal excretion, serous fluid, synovial fluid, pericardial fluid, peritoneal fluid, pleural fluid, transudates, exudates, cystic fluid, bile, urine, gastric fluid, intestinal fluid, fecal samples, liquids containing single or multiple cells, liquids containing organelles, fluidized tissues, fluidized organisms, liquids containing multi-celled organisms, biological swabs and biological washes. Moreover, a droplet may include a reagent, such as water, deionized water, saline solutions, acidic solutions, basic solutions, detergent solutions and/or buffers. Other examples of droplet contents include reagents, such as a reagent for a biochemical protocol, such as a nucleic acid amplification protocol, an affinity-based assay protocol, an enzymatic assay protocol, a sequencing protocol, and/or a protocol for analyses of biological fluids. A droplet may include one or more beads.

"Droplet Actuator" means a device for manipulating droplets. For examples of droplet actuators, see Pamula et al., U.S. Pat. No. 6,911,132, entitled "Apparatus for Manipulating Droplets by Electrowetting-Based Techniques," issued on Jun. 28, 2005; Pamula et al., U.S. patent application Ser. No. 11/343,284, entitled "Apparatuses and Methods for Manipulating Droplets on a Printed Circuit Board," filed on filed on Jan. 30, 2006; Pollack et al., International Patent Application No. PCT/US2006/047486, entitled "Droplet-Based Biochemistry," filed on Dec. 11, 2006; Shenderov, U.S. Pat. No. 6,773,566, entitled "Electrostatic Actuators for Microfluidics and Methods for Using Same," issued on Aug. 10, 2004 and U.S. Pat. No. 6,565,727, entitled "Actuators for Microfluidics Without Moving Parts," issued on Jan. 24, 2000; Kim and/or Shah et al., U.S. patent application Ser. No. 10/343,261, entitled "Electrowetting-driven Micropumping," filed on Jan. 27, 2003, Ser. No. 11/275,668, entitled "Method and Apparatus for Promoting the Complete Transfer of Liquid Drops from a Nozzle," filed on Jan. 23, 2006, Ser. No. 11/460,188, entitled "Small Object Moving on Printed Circuit Board," filed on Jan. 23, 2006, Ser. No. 12/465,935, entitled "Method for Using Magnetic Particles in Droplet Microfluidics," filed on May 14, 2009, and Ser. No. 12/513,157, entitled "Method and Apparatus for Real-time Feedback Control of Electrical Manipulation of Droplets on Chip," filed on Apr. 30, 2009; Velev, U.S. Pat. No. 7,547,380, entitled "Droplet Transportation Devices and Methods Having a Fluid Surface," issued on Jun. 16, 2009; Sterling et al., U.S. Pat. No. 7,163,612, entitled "Method, Apparatus and Article for Microfluidic Control via Electrowetting, for Chemical, Biochemical and Biological Assays and the Like," issued on Jan. 16, 2007; Becker and Gascoyne et al., U.S. Pat. No. 7,641,779, entitled "Method and Apparatus for Programmable fluidic Processing," issued on Jan. 5, 2010, and U.S. Pat. No. 6,977,033, entitled "Method and Apparatus for Programmable fluidic Processing," issued on Dec. 20, 2005; Decre et al., U.S. Pat. No. 7,328,979, entitled "System for Manipulation of a Body of Fluid," issued on Feb. 12, 2008; Yamakawa et al., U.S. Patent Pub. No. 20060039823, entitled "Chemical Analysis Apparatus," published on Feb. 23, 2006; Wu, International Patent Pub. No. WO/2009/003184, entitled "Digital Microfluidics Based Apparatus for Heat-exchanging Chemical Processes," published on Dec. 31, 2008; Fouillet et al., U.S. Patent Pub. No. 20090192044, entitled "Electrode Addressing Method," published on Jul. 30, 2009; Fouillet et al., U.S. Pat. No. 7,052,244, entitled "Device for Displacement of Small Liquid Volumes Along a Micro-catenary Line by Electrostatic Forces," issued on May 30, 2006; Marchand et al., U.S. Patent Pub. No. 20080124252, entitled "Droplet Microreactor," published on May 29, 2008; Adachi et al., U.S. Patent Pub. No. 20090321262, entitled "Liquid Transfer Device," published on Dec. 31, 2009; Roux et al., U.S. Patent Pub. No. 20050179746, entitled "Device for Controlling the Displacement of a Drop Between two or Several Solid Substrates," published on Aug. 18, 2005; Dhindsa et al., "Virtual Electrowetting Channels: Electronic Liquid Transport with Continuous Channel Functionality," Lab Chip, 10:832-836 (2010); the entire disclosures of which are incorporated herein by reference, along with their priority documents. Certain droplet actuators will include one or more substrates arranged with a droplet operations gap between them and electrodes associated with (e.g., layered on, attached to, and/or embedded in) the one or more substrates and arranged to conduct one or more droplet operations. For example, certain droplet actuators will include a base (or bottom) substrate, droplet operations electrodes associated with the substrate, one or more dielectric layers atop the substrate and/or electrodes, and optionally one or more hydrophobic layers atop the substrate, the dielectric layers and/or the electrodes forming a droplet operations surface. A top substrate may also be provided, which is separated from the droplet operations surface by a gap, commonly referred to as a droplet operations gap. Various electrode arrangements on the top and/or bottom substrates are discussed in the above-referenced patents and applications and certain novel electrode arrangements are discussed in the description of the invention. During droplet operations it is preferred that droplets remain in continuous contact or frequent contact with a ground or reference electrode. A ground or reference electrode may be associated with the top substrate facing the gap, the bottom substrate facing the gap, and/or in the gap. Where electrodes are provided on both substrates, electrical contacts for coupling the electrodes to a droplet actuator instrument for controlling or monitoring the electrodes may be associated with one or both plates. In some cases, electrodes on one substrate are electrically coupled to the other substrate so that only one substrate is in contact with the droplet actuator. In one embodiment, a conductive material (e.g., an epoxy, such as MASTER BOND™ Polymer System EP79, available from Master Bond, Inc., Hackensack, N.J.) provides the electrical connection between electrodes on one substrate and electrical paths on the other substrates, e.g., a ground electrode on a top substrate may be coupled to an electrical path on a bottom substrate by such a conductive material. Where multiple substrates are used, a spacer may be provided between the substrates to determine the height of the gap therebetween and define dispensing reservoirs. The spacer height may, for example, be from about 5 μm to about 600 μm, or about 100 μm to about 400 μm, or about 200 μm to about 350 μm, or about 250 μm to about 300 μm, or about 275 μm. The spacer may, for example, be formed of a layer of projections form the top or bottom substrates, and/or a material inserted between the top and bottom substrates. One or more openings may be provided in the one or more substrates for forming a fluid path through which liquid may be delivered into the droplet operations gap. The one or more openings may in some cases be aligned for interaction with one or more electrodes, e.g., aligned such that liquid flowed through the opening will come into sufficient proximity with one or more droplet operations electrodes to permit a droplet operation to be effected by the droplet operations electrodes using the liquid. The base (or bottom) and top substrates may in some cases be formed as one integral component. One or more reference electrodes may be provided on the base (or bottom) and/or top substrates and/or in the gap. Examples of reference electrode arrangements are provided in the above referenced patents and patent applications. In various embodiments, the manipulation of droplets by a droplet actuator may be electrode mediated, e.g., electrowetting mediated or dielectrophoresis mediated or Coulombic force mediated. Examples of other techniques for controlling droplet operations that may be used in the droplet actuators of the invention include using devices that induce hydrodynamic fluidic pressure, such as those that operate on the basis of mechanical principles (e.g. external syringe pumps, pneumatic membrane pumps, vibrating membrane pumps, vacuum devices, centrifugal forces, piezoelectric/ultrasonic pumps and acoustic forces); electrical or magnetic principles (e.g. electroosmotic flow, electrokinetic pumps, ferrofluidic plugs, electrohydrodynamic pumps, attraction or repulsion using magnetic forces and magnetohydrodynamic pumps); thermodynamic principles (e.g. bubble generation/phase-change-induced volume expansion); other kinds of surface-wetting principles (e.g. electrowetting, and optoelectrowetting, as well as chemically, thermally, structurally and radioactively induced surface-tension gradients); gravity; surface tension (e.g., capillary action); electrostatic forces (e.g., electroosmotic flow); centrifugal flow (substrate disposed on a compact disc and rotated); magnetic forces (e.g., oscillating ions causes flow); magnetohydrodynamic forces; and vacuum or pressure differential. In certain embodiments, combinations of two or more of the foregoing techniques may be employed to conduct a droplet operation in a droplet actuator of the invention. Similarly, one or more of the foregoing may be used to deliver liquid into a droplet operations gap, e.g., from a reservoir in another device or from an external reservoir of the droplet actuator (e.g., a reservoir associated with a droplet actuator substrate and a flow path from the reservoir into the droplet operations gap). Droplet operations surfaces of certain droplet actuators of the invention may be made from hydrophobic materials or may be coated or treated to make them hydrophobic. For example, in some cases some portion or all of the droplet operations surfaces may be derivatized with low surface-energy materials or chemistries, e.g., by deposition or using in situ synthesis using compounds such as poly- or perfluorinated compounds in solution or polymerizable monomers. Examples include TEFLON® AF (available from DuPont, Wilmington, Del.), members of the cytop family of materials, coatings in the FLUOROPEL® family of hydrophobic and superhydrophobic coatings (available from Cytonix Corporation, Beltsville, Md.), silane coatings, fluorosilane coatings, hydrophobic phosphonate derivatives (e.g., those sold by Aculon, Inc), and NOVEC™ electronic coatings (available from 3M Company, St. Paul, Minn.), other fluorinated monomers for plasma-enhanced chemical vapor deposition (PECVD), and organosiloxane (e.g., SiOC) for PECVD. In some cases, the droplet operations surface may include a hydrophobic coating having a thickness ranging from about 10 nm to about 1,000 nm. Moreover, in some embodiments, the top substrate of the droplet actuator includes an electrically conducting organic polymer, which is then coated with a hydrophobic coating or otherwise treated to make the droplet operations surface hydrophobic. For example, the electrically conducting organic polymer that is deposited onto a plastic substrate may be poly(3,4-ethylenedioxythiophene) poly(styrenesulfonate) (PEDOT:PSS). Other examples of electrically conducting organic polymers and alternative conductive layers are described in Pollack et al., International Patent Application No. PCT/US2010/040705, entitled "Droplet Actuator Devices and Methods," the entire disclosure of which is incorporated herein by reference. One or both substrates may be fabricated using a printed circuit board (PCB), glass, indium tin oxide (ITO)-coated glass, and/or semiconductor materials as the substrate. When the substrate is ITO-coated glass, the ITO coating is preferably a thickness in the range of about 20 to about 200 nm, preferably about 50 to about 150 nm, or about 75 to about 125 nm, or about 100 nm. In some cases, the top and/or bottom substrate includes a PCB substrate that is coated with a dielectric, such as a polyimide dielectric, which may in some cases also be coated or otherwise treated to make the droplet operations surface hydrophobic. When the substrate includes a PCB, the following materials are examples of suitable materials: MITSUI™ BN-300 (available from MITSUI Chemicals America, Inc., San Jose Calif.); ARLON™ 11N (available from Arlon, Inc, Santa Ana, Calif.); NELCO® N4000-6 and N5000-30/32 (available from Park Electrochemical Corp., Melville, N.Y.); ISOLA™ FR406 (available from Isola Group, Chandler, Ariz.), especially IS620; fluoropolymer family (suitable for fluorescence detection since it has low background fluorescence); polyimide family; polyester; polyethylene naphthalate; polycarbonate; polyetheretherketone; liquid crystal polymer; cyclo-olefin copolymer (COC); cyclo-olefin polymer (COP); aramid; THERMOUNT® non-woven aramid reinforcement (available from DuPont, Wilmington, Del.); NOMEX® brand fiber (available from DuPont, Wilmington, Del.); and paper. Various materials are also suitable for use as the dielectric component of the substrate. Examples include: vapor deposited dielectric, such as PARYLENE™ C (especially on glass), PARYLENE™ N, and PARYLENE™ HT (for high temperature, ~300° C.) (available from Parylene Coating Services, Inc., Katy, Tex.); TEFLON® AF coatings; cytop; soldermasks, such as liquid photoimageable soldermasks (e.g., on PCB) like TAIYO™ PSR4000 series, TAIYO™ PSR and AUS series (available from Taiyo America, Inc. Carson City, Nev.) (good thermal characteristics for applications involving thermal control), and PROBIMER™ 8165 (good thermal characteristics for applications involving thermal control (available from Huntsman Advanced Materials Americas Inc., Los Angeles, Calif.); dry film soldermask, such as those in the VACREL® dry film soldermask line (available from DuPont, Wilmington, Del.); film dielectrics, such as polyimide film (e.g., KAPTON® polyimide film, available from DuPont, Wilmington, Del.), polyethylene, and fluoropolymers (e.g., FEP), polytetrafluoroethylene; polyester; polyethylene naphthalate; cyclo-olefin copolymer (COC); cyclo-olefin polymer (COP); any other PCB substrate material listed above; black matrix resin; and polypropylene. Droplet transport voltage and frequency may be selected for performance with reagents used in specific assay protocols. Design parameters may be varied, e.g., number and placement of on-actuator reservoirs, number of independent electrode connections, size (volume) of different reservoirs, placement of magnets/bead washing zones, electrode size, inter-electrode pitch, and gap height (between top and bottom substrates) may be varied for use with specific reagents, protocols, droplet volumes, etc. In some cases, a substrate of the invention may derivatized with low surface-energy materials or chemistries, e.g., using deposition or in situ synthesis using poly- or per-fluorinated compounds in solution or polymerizable monomers. Examples include TEFLON® AF coatings and FLUOROPEL® coatings for dip or spray coating, other fluorinated monomers for plasma-enhanced chemical vapor deposition (PECVD), and organosiloxane (e.g., SiOC) for PECVD. Additionally, in some cases, some portion or all of the droplet operations surface may be coated with a substance for reducing background noise, such as background fluorescence from a PCB substrate. For example, the noise-reducing coating may include a black matrix resin, such as the black matrix resins available from Toray industries, Inc., Japan. Electrodes of a droplet actuator are typically controlled by a controller or a processor, which is itself provided as part of a system, which may include processing functions as well as data and software storage and input and output capabilities. Reagents may be provided on the droplet actuator in the droplet operations gap or in a reservoir fluidly coupled to the droplet operations gap. The reagents may be in liquid form, e.g., droplets, or they may be provided in a reconstitutable form in the droplet operations gap or in a reservoir fluidly coupled to the droplet operations gap. Reconstitutable reagents may typically be combined with liquids for reconstitution. An example of reconstitutable reagents suitable for use with the invention includes those described in Meathrel, et al., U.S. Pat. No. 7,727,466, entitled "Disintegratable films for diagnostic devices," granted on Jun. 1, 2010.

"Droplet operation" means any manipulation of a droplet on a droplet actuator. A droplet operation may, for example, include: loading a droplet into the droplet actuator; dispensing one or more droplets from a source droplet; splitting, separating or dividing a droplet into two or more droplets; transporting a droplet from one location to another in any direction; merging or combining two or more droplets into a single droplet; diluting a droplet; mixing a droplet; agitating a droplet; deforming a droplet; retaining a droplet in position; incubating a droplet; heating a droplet; vaporizing a droplet; cooling a droplet; disposing of a droplet; transporting a droplet out of a droplet actuator; other droplet operations described herein; and/or any combination of the foregoing. The terms "merge," "merging," "combine," "combining" and the like are used to describe the creation of one droplet from two or more droplets. It should be understood that when such a term is used in reference to two or more droplets, any combination of droplet operations that are sufficient to result in the combination of the two or more droplets into one droplet may be used. For example, "merging droplet A with droplet B," can be achieved by transporting droplet A into contact with a stationary droplet B, transporting droplet B into contact with a stationary droplet A, or transporting droplets A and B into contact with each other. The terms "splitting," "separating" and "dividing" are not intended to imply any particular outcome with respect to volume of the resulting droplets (i.e., the volume of the resulting droplets can be the same or different) or number of resulting droplets (the number of resulting droplets may be 2, 3, 4, 5 or more). The term "mixing" refers to droplet operations which result in more homogenous distribution of one or more components within a droplet. Examples of "loading" droplet operations include microdialysis loading, pressure assisted loading, robotic loading, passive loading, and pipette loading. Droplet operations may be electrode-mediated. In some cases, droplet operations are further facilitated by the use of hydrophilic and/or hydrophobic regions on surfaces and/or by physical obstacles. For examples of droplet operations, see the patents and patent applications cited above under the definition of "droplet actuator." Impedance or capacitance sensing or imaging techniques may sometimes be used to determine or confirm the outcome of a droplet operation. Examples of such techniques are described in Sturmer et al., International Patent Pub. No. WO/2008/101194, entitled "Capacitance Detection in a Droplet Actuator," published on Aug. 21, 2008, the entire disclosure of which is incorporated herein by reference. Generally speaking, the sensing or imaging techniques may be used to confirm the presence or absence of a droplet at a specific electrode. For example, the presence of a dispensed droplet at the destination electrode following a droplet dispensing operation confirms that the droplet dispensing operation was effective. Similarly, the presence of a droplet at a detection spot at an appropriate step in an assay protocol may confirm that a previous set of droplet operations has successfully produced a droplet for detection. Droplet transport time can be quite fast. For example, in various embodiments, transport of a droplet from one electrode to the next may exceed about 1 sec, or about 0.1 sec, or about 0.01 sec, or about 0.001 sec. In one embodiment, the electrode is operated in AC mode but is switched to DC mode for imaging. It is helpful for conducting droplet operations for the footprint area of droplet to be similar to electrowetting area; in other words, 1×-, 2×- 3×-droplets are usefully controlled operated using 1, 2, and 3 electrodes, respectively. If the droplet footprint is greater than the number of electrodes available for conducting a droplet operation at a given time, the difference between the droplet size and the number of electrodes should typically not be greater than 1; in other words, a $2x$ droplet is usefully controlled using 1 electrode and a $3x$ droplet is usefully controlled using 2 electrodes. When droplets include beads, it is useful for droplet size to be equal to the number of electrodes controlling the droplet, e.g., transporting the droplet.

"Filler fluid" means a fluid associated with a droplet operations substrate of a droplet actuator, which fluid is sufficiently immiscible with a droplet phase to render the droplet phase subject to electrode-mediated droplet operations. For example, the droplet operations gap of a droplet actuator is typically filled with a filler fluid. The filler fluid may, for example, be a low-viscosity oil, such as silicone oil or hexadecane filler fluid. The filler fluid may fill the entire gap of the droplet actuator or may coat one or more surfaces of the droplet actuator. Filler fluids may be conductive or non-conductive. Filler fluids may, for example, be doped with surfactants or other additives. For example, additives may be selected to improve droplet operations and/or reduce loss of reagent or target substances from droplets, formation of microdroplets, cross contamination between droplets, contamination of droplet actuator surfaces, degradation of droplet actuator materials, etc. Composition of the filler fluid, including surfactant doping, may be selected for performance with reagents used in the specific assay protocols and effective interaction or non-interaction with droplet actuator materials. Examples of filler fluids and filler fluid formulations suitable for use with the invention are provided in Srinivasan et al, International Patent Pub. Nos. WO/2010/027894, entitled "Droplet Actuators, Modified Fluids and Methods," published on Mar. 11, 2010, and WO/2009/021173, entitled "Use of Additives for Enhancing Droplet Operations," published on Feb. 12, 2009; Sista et al., International Patent Pub. No. WO/2008/098236, entitled "Droplet Actuator Devices and Methods Employing Magnetic Beads," published on Aug. 14, 2008; and Monroe et al., U.S. Patent Publication No. 20080283414, entitled "Electrowetting Devices," filed on May 17, 2007; the entire disclosures of which are incorporated herein by reference, as well as the other patents and patent applications cited herein.

"Reservoir" means an enclosure or partial enclosure configured for holding, storing, or supplying liquid. A droplet actuator system of the invention may include on-cartridge reservoirs and/or off-cartridge reservoirs. On-cartridge reservoirs may be (1) on-actuator reservoirs, which are reservoirs in the droplet operations gap or on the droplet operations surface; (2) off-actuator reservoirs, which are reservoirs on the droplet actuator cartridge, but outside the droplet operations gap, and not in contact with the droplet operations surface; or (3) hybrid reservoirs which have on-actuator regions and off-actuator regions. An example of an off-actuator reservoir is a reservoir in the top substrate. An off-actuator reservoir is typically in fluid communication with an opening or flow path arranged for flowing liquid from the off-actuator reservoir into the droplet operations gap, such as into an on-actuator reservoir. An off-cartridge reservoir may be a reservoir that is not part of the droplet actuator cartridge at all, but which flows liquid to some portion of the droplet actuator cartridge. For example, an off-cartridge reservoir may be part of a system or docking station to which the droplet actuator cartridge is coupled during operation. Similarly, an off-cartridge reservoir may be a reagent storage container or syringe which is used to force fluid into an on-cartridge reservoir or into a droplet operations gap. A system using an off-cartridge reservoir will typically include a fluid passage means whereby liquid may be transferred from the off-cartridge reservoir into an on-cartridge reservoir or into a droplet operations gap.

The terms "top," "bottom," "over," "under," and "on" are used throughout the description with reference to the relative positions of components of the droplet actuator, such as relative positions of top and bottom substrates of the droplet actuator. It will be appreciated that the droplet actuator is functional regardless of its orientation in space.

When a liquid in any form (e.g., a droplet or a continuous body, whether moving or stationary) is described as being "on", "at", or "over" an electrode, array, matrix or surface, such liquid could be either in direct contact with the electrode/array/matrix/surface, or could be in contact with one or more layers or films that are interposed between the liquid and the electrode/array/matrix/surface. In one example, filler fluid can be considered as a film between such liquid and the electrode/array/matrix/surface.

When a droplet is described as being "on" or "loaded on" a droplet actuator, it should be understood that the droplet is arranged on the droplet actuator in a manner which facilitates using the droplet actuator to conduct one or more droplet operations on the droplet, the droplet is arranged on the droplet actuator in a manner which facilitates sensing of a property of or a signal from the droplet, and/or the droplet has been subjected to a droplet operation on the droplet actuator.

DESCRIPTION

During droplet operations in a droplet actuator bubbles often form in the filler fluid in the droplet operations gap and interrupt droplet operations. Without wishing to be bound by a particular theory, the inventors have observed that during droplet operations, bubble formation can occur when the droplet loses contact with a reference or ground electrode of the droplet actuator. Further, bubble formation appears to occur as the droplet begins to regain contact with the reference or ground electrode after losing contact. Electrical charges that cause bubble formation may accumulate in the droplet across the layer of filler fluid that is created when the droplet loses contact with the reference or ground electrode. As the droplet regains contact with the top substrate after losing contact this filler fluid layer thins and the charge is discharged. This discharge may be the cause of the bubbles. FIGS. 1A, 1B, 1C, 1D, and 2 illustrate the problem of bubble formation during a droplet transport operation on an electrowetting droplet actuator.

FIGS. 1A, 1B, 1C, and 1D illustrate side views of a portion of a droplet actuator 100 and a droplet operations process in which the droplet loses contact with the ground or reference electrode of the top substrate. In this example, droplet actuator 100 includes a bottom substrate 110 and a top substrate 112 that are separated by a droplet operations gap 114. Bottom substrate 110 includes an arrangement of droplet operations electrodes 116 (e.g., electrowetting electrodes). Droplet operations electrodes 116 are on the side of bottom substrate 110 that is facing droplet operations gap 114. Top substrate 112 includes a conductive layer 118. Conductive layer 118 is on the side of top substrate 112 that is facing droplet operations gap 114. In one example, conductive layer 118 is formed of indium tin oxide (ITO), which is a material that is electrically conductive and substantially transparent to light. Conductive layer 118 provides a ground or reference plane with respect to droplet operations electrodes 116, wherein voltages (e.g., electrowetting voltages) are applied to droplet operations electrodes 116. Other layers (not shown), such as hydrophobic layers and dielectric layers, may be present on bottom substrate 110 and top substrate 112.

The droplet operations gap 114 of droplet actuator 100 is typically filled with a filler fluid 130. The filler fluid may, for example, include one or more oils, such as silicone oil, or hexadecane filler fluid. One or more droplets 132 in droplet operations gap 114 may be transported via droplet operations along droplet operations electrodes 116 and through the filler fluid 130.

FIGS. 1A, 1B, 1C, and 1D show an electrode sequence for transporting a droplet 132 from, for example, a droplet operations electrode 116A to a droplet operations electrode 116B. Initially and referring now to FIG. 1A, droplet operations electrode 116A is turned ON and droplet operations electrode 116B is turned OFF. Therefore, droplet 132 is held atop droplet operations electrode 116A.

Figure 1B:
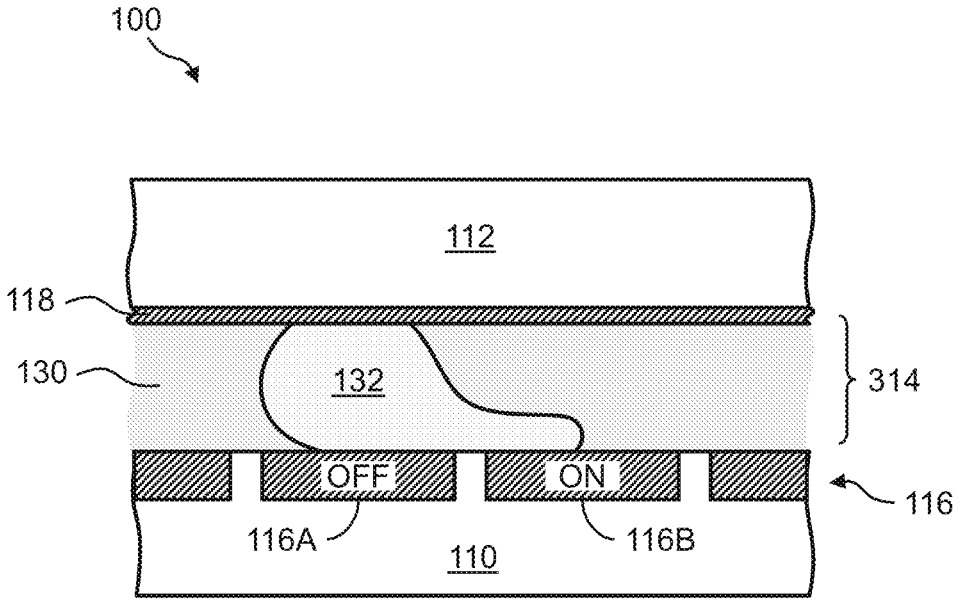

Referring now to FIG. 1B, droplet operations electrode 116A is turned OFF and droplet operations electrode 116B is turned ON and droplet 132 begins to move from droplet operations electrode 116A to droplet operations electrode 116B. FIG. 1B shows droplet 132 beginning to deform, whereas a finger of fluid begins to pull from droplet operations electrode 116A onto droplet operations electrode 116B.

Figure 1C:
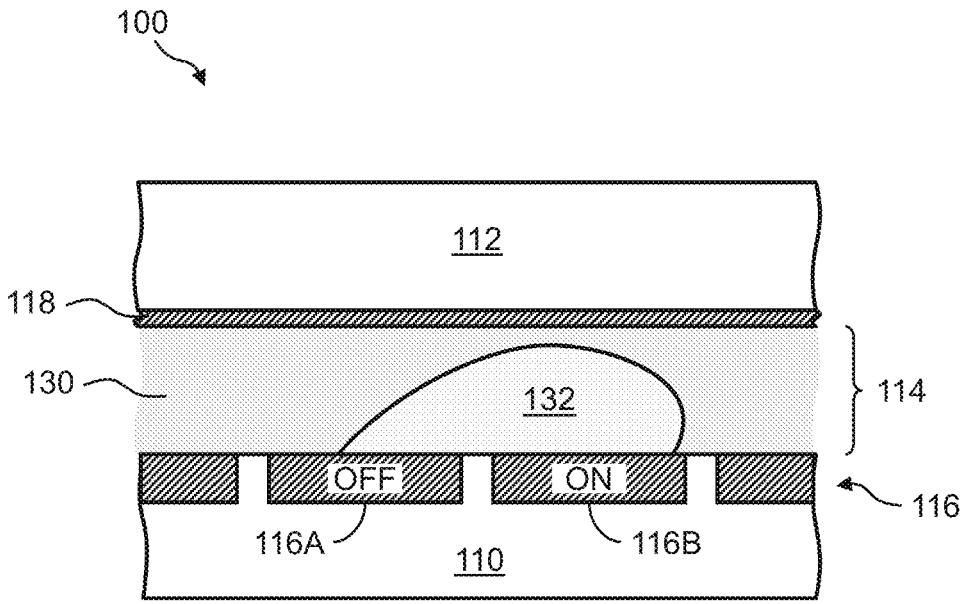

With droplet operations electrode 116A remaining OFF and droplet operations electrode 116B remaining ON, FIG. 1C shows the moment in time at which more of the volume of droplet 132 is transferred from droplet operations electrode 116A onto droplet operations electrode 116B, whereas the volume of fluid is spread across both droplet operations electrode 116A and droplet operations electrode 116B in a manner that causes the droplet 132 to lose contact with top substrate 112 and more particularly to lose contact with conductive layer 118.

Figure 1D:
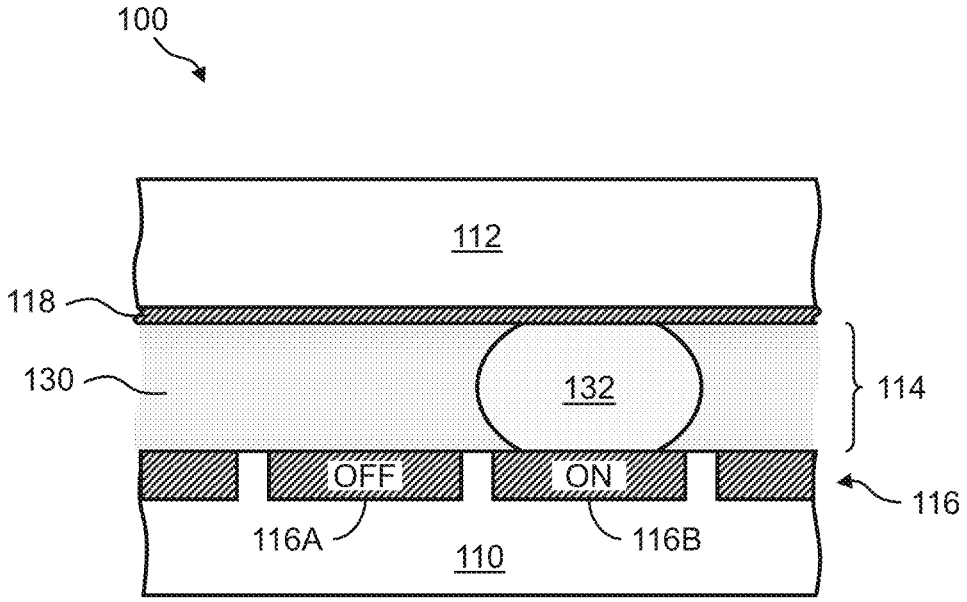

With droplet operations electrode 116A remaining OFF and droplet operations electrode 116B remaining ON, FIG. 1D shows the moment in time at which the full volume of droplet 132 is atop droplet operations electrode 116B and thus droplet 132 has regained contact with conductive layer 118 of top substrate 112.

Figure 2:
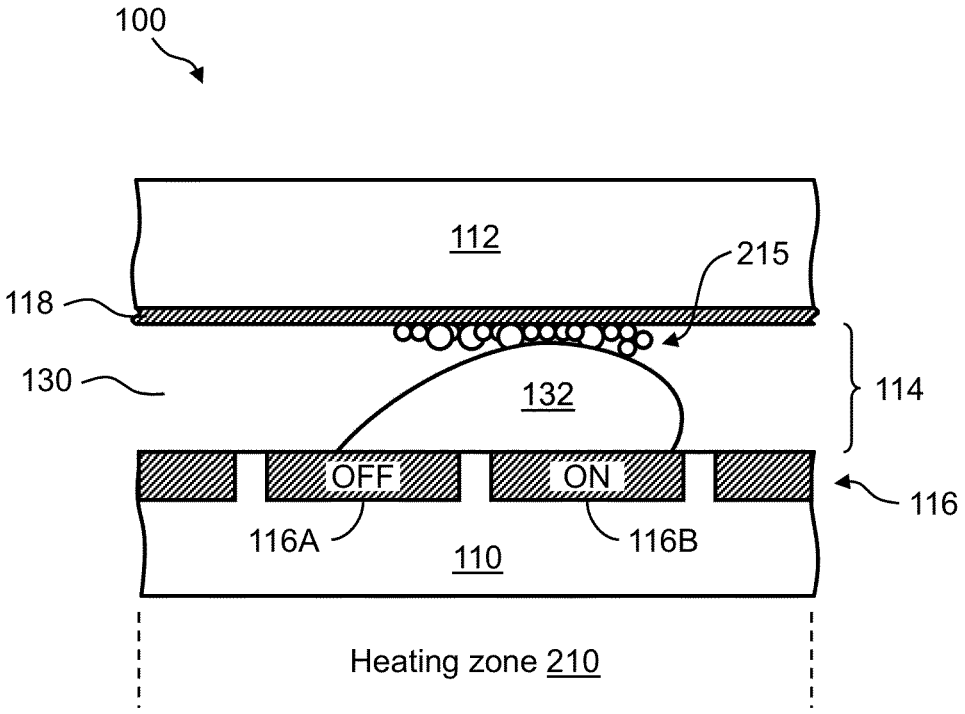
FIG. 2 illustrates a side view of the droplet actuator at the moment in time of the droplet operations process in which the droplet loses contact with the top substrate and bubbles.

FIG. 2 illustrates a side view of droplet actuator 100 at the moment in time of the droplet operations process in which droplet 132 approaches re-contact with top substrate 112 and bubbles 215 form.

The inventors have observed that bubbles can appear at low temperature, even room temperature; however, bubble formation is most prevalent and problematic at elevated temperatures, such as greater than about 80° C., or greater than 90° C., or greater than about 95° C. The inventors have observed that bubbles can appear at low temperature, even room temperature; however, bubble formation is most prevalent and problematic at elevated temperatures, such as greater than about 60% of the droplet's boiling point, or greater than about 70% of the droplet's boiling point, or greater than about 80% of the droplet's boiling point, or greater than about 90% of the droplet's boiling point, or greater than about 95% of the droplet's boiling point.

FIG. 2 shows an optional heating zone 210 that is associated with droplet actuator 100. As a droplet, such as droplet 132, is transported through heating zone 210 the droplet is heated and bubbles form during droplet operations.

In one embodiment, techniques and designs of the invention improve reliability of electrical ground connection to droplets in a droplet actuator to reduce or eliminate bubble formation in the droplet actuator, thereby permitting completion of multiple droplet operations without interruption by bubble formation. In one embodiment, conducting the multiple droplet operations comprises conducting at least ten droplet operations without the interruption by the bubble formation in the filler fluid in the droplet operations gap. In other embodiments, conducting the multiple droplet operations comprises conducting at least 100, at least 1,000, or at least 100,000 droplet operations without the interruption by the bubble formation in the filler fluid in the droplet operations gap.

7.1 Droplet Grounding Techniques

Figure 3A:
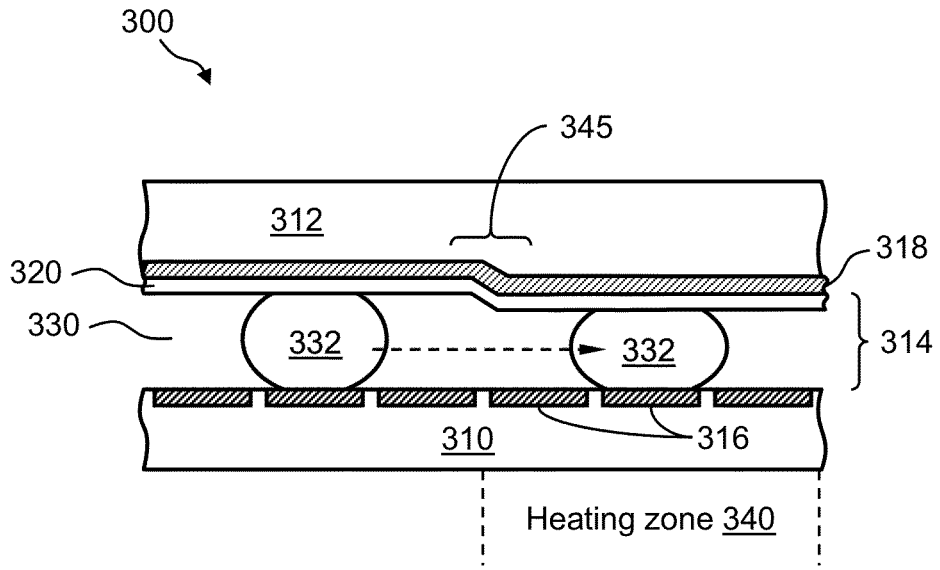
FIGS. 3A and 3B illustrate side views of examples of a droplet actuator that include a region in which the droplet operations gap height is reduced to assist the droplet to be in reliable contact with the ground or reference of the droplet actuator.
Figure 3B:
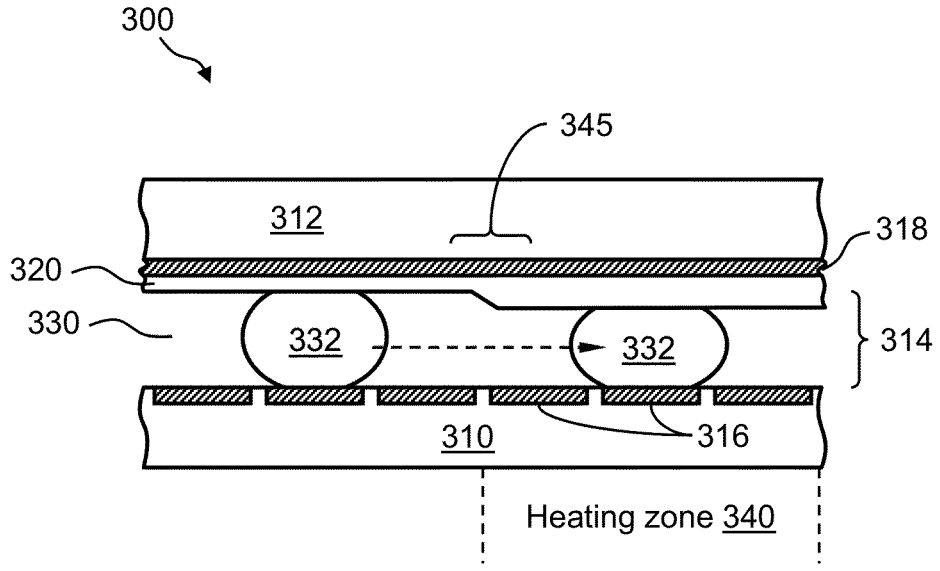

FIGS. 3A and 3B illustrate side views of examples of a droplet actuator 300 that include a region in which the droplet operations gap height is reduced to assist the droplet to be in reliable contact with the ground or reference of the droplet actuator. Referring to FIG. 3A, droplet actuator 300 includes a bottom substrate 310 and a top substrate 312 that are separated by a droplet operations gap 314. Bottom substrate 310 includes an arrangement of droplet operations electrodes 316 (e.g., electrowetting electrodes). Top substrate 312 includes a conductive layer 318, such as an ITO layer. Conductive layer 318 provides a ground or reference plane with respect to droplet operations electrodes 316, wherein voltages (e.g., electrowetting voltages) are applied to droplet operations electrodes 316. Additionally, FIG. 3A shows a dielectric layer 320 atop conductive layer 318 of top substrate 312. The droplet operations gap 314 of droplet actuator 300 is filled with a filler fluid 330. A heating zone 340 is associated with droplet actuator 300. As a droplet, such as a droplet 332, is transported through heating zone 340 the droplet is heated.

In this example, droplet actuator 300 includes a gap height transition region 345 in which the height of droplet operations gap 314 is reduced in heating zone 340 to assist droplet 332 to be in reliable contact with conductive layer 318, which is the ground or reference of droplet actuator 300. Because the gap height is reduced in heating zone 340, droplet 332 is more likely to maintain contact with conductive layer 318 throughout the entirety of droplet operations process, thus reducing or eliminating bubbles, thereby permitting completion of multiple droplet operations without interruption by bubble formation.

In FIG. 3A, which is one example implementation, the surface of top substrate 312 that is facing droplet operations gap 314 has a step feature to accomplish the reduced gap height in heating zone 340. Conductive layer 318 and dielectric layer 320 substantially follow the topography of top substrate 312. In FIG. 3B, which is another example implementation, the thickness of dielectric layer 320 is varied to accomplish the reduced gap height in heating zone 340. The thickness of dielectric layer 320 is increased in heating zone 340.

Figure 4A:
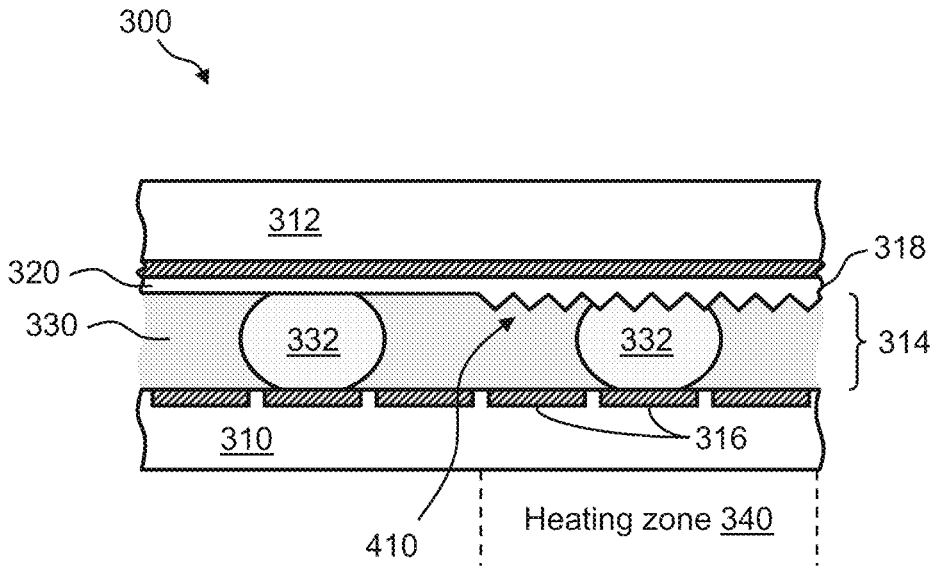
FIGS. 4A and 4B illustrate side views of examples of a droplet actuator that include a region in which the surface of the top substrate is textured to assist the droplet to be in reliable contact with the ground or reference of the droplet actuator.
Figure 4B:
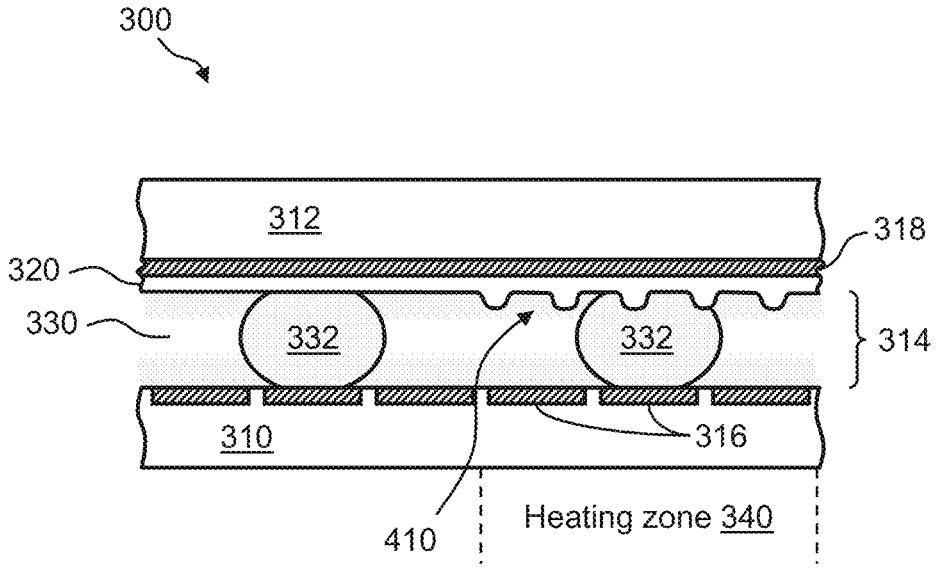

FIGS. 4A and 4B illustrate side views of examples of droplet actuator 300 that include a region in which the surface of top substrate 312 is textured to assist the droplet to be in reliable contact with conductive layer 318, which is the ground or reference. For example, in this embodiment of droplet actuator 300, dielectric layer 320 is textured to assist the droplet to be in reliable contact with conductive layer 318. In the example shown in FIG. 4A, dielectric layer 320 has a texture 410 that is a sawtooth texture. In the example shown in FIG. 4B, texture 410 of dielectric layer 320 is formed by an arrangement of ridges, projections, or protrusions. In one example, substantially the entire surface area of dielectric layer 320 includes the texture 410. In another example, only the area of dielectric layer 320 in the heating zone 340 includes the texture 410.

In another example, needles or wires (not shown) may extend from top substrate 312 into droplet operations gap 314. In yet another example, the conductive layer 318 itself may include ridges, projections, or protrusions (not shown) that extend through dielectric layer 320 and into droplet operations gap 314, wherein the ridges, projections, or protrusions maintain contact with the droplet during droplet operations, thus reducing or eliminating bubbles, thereby permitting completion of multiple droplet operations without interruption by bubble formation.

The texturing may take any form or configuration. The texture 410, for example, may be one or more dimples that outwardly extend into the gap 314. The texturing 410 may be randomly or uniformly created to reduce formation of bubbles. The texturing may have a random height or extension into the gap 314, such that adjacent texturing features (e.g., dimples, ridges, or teeth) may have different apex heights and/or shapes. Alternatively, the texturing may have uniform features, such that all the features are substantially similar. The texturing may also include depressions, craters, or valleys extending into the top surface.

Figure 5A:
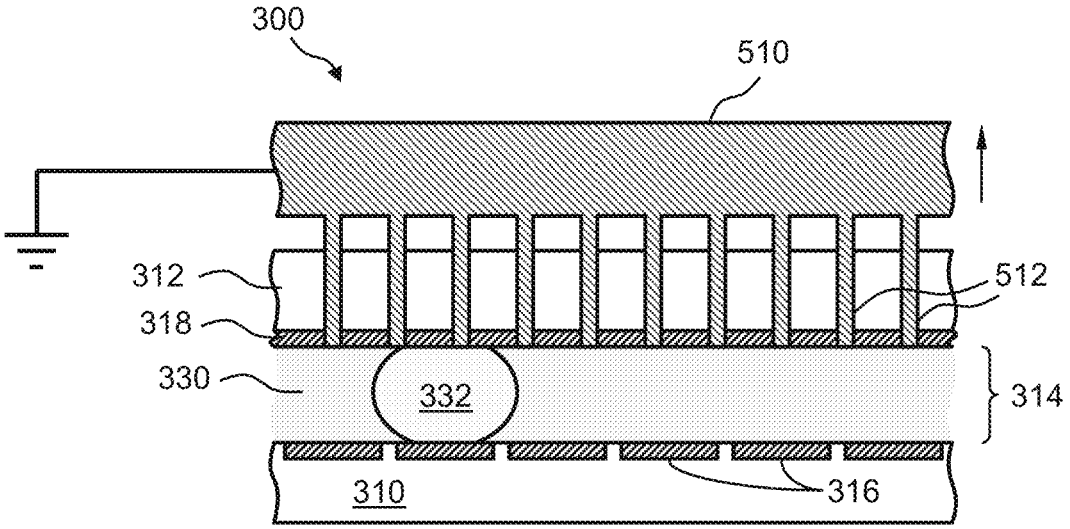
FIGS. 5A and 5B illustrate side views of a droplet actuator that includes a set of adjustable ground probes to assist the droplet to be in reliable contact with the ground or reference of the droplet actuator.
Figure 5B:
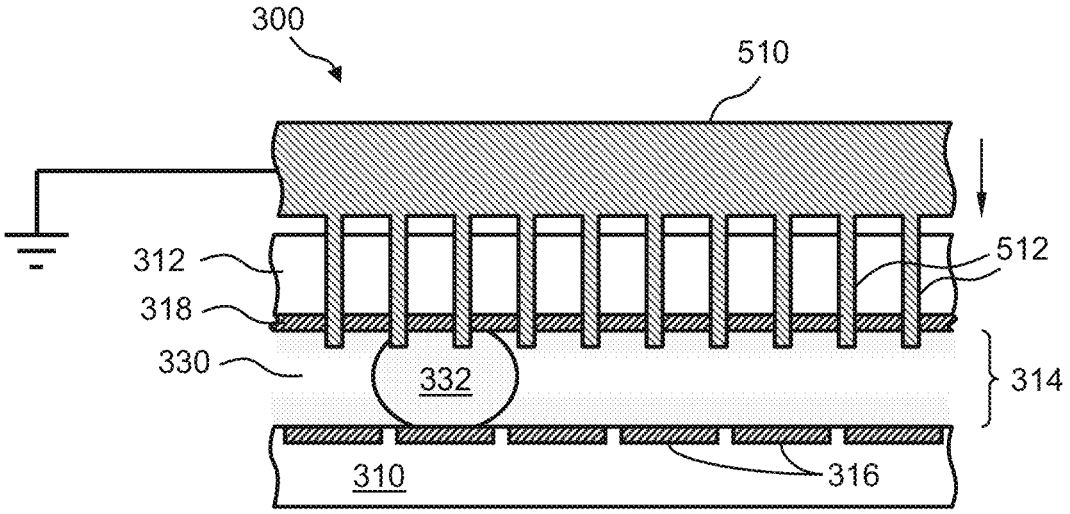

FIGS. 5A and 5B illustrate side views of droplet actuator 300 that includes a set of adjustable ground probes to assist the droplet to be in reliable contact with conductive layer 318, which is the ground or reference. Here electrical ground may be moved or slid to maintain substantial contact with the droplet. As FIG. 5A illustrates, droplet actuator 300 may include a plate 510 that further includes a set of probes 512. Plate 510 and probes 512 are formed of electrically conductive material and are electrically connected to the electrical ground of droplet actuator 300. Probes 512 are, for example, a set of cylindrical point probes or a set of parallel-arranged plates or fins that protrude from plate 510. Openings are provided in top substrate 312 for fitting probes 512 therethrough in a slideable fashion. Because probes 512 are fitted into top substrate 312 in a slideable fashion, the position of the tips of the probes 512 may be adjusted with respect to the droplet operations gap 314. For example, plate 510 may be spring-loaded.

In operation, when plate 510 is pushed toward or against top substrate 312, the tips of the probes 512 extend slightly into droplet operations gap 314 and maintain contact with the droplet during droplet operations. In so doing, a ground connection is reliably maintained with the droplet during droplet operations, thus reducing or eliminating bubbles, thereby permitting completion of multiple droplet operations without interruption by bubble formation. However, when desired, plate 510 can be lifted away from top substrate 312 such that the tips of the probes 512 retract out of droplet operations gap 314.

In one embodiment, plate 510 and probes 512 are provided in the heated regions only of the droplet actuator. In another embodiment, plate 510 and probes 512 are provided in both the heated regions and unheated regions of the droplet actuator.

The electrical ground may be moved or slid using pneumatic, hydraulic, and/or electrical actuators. Any of these actuators may extend the electrical ground into contact with the droplet. When extension is no longer needed, the electrical ground may be retracted away from the droplet. A controller of the droplet actuator may control an actuator, thus controlling a position of the electrical ground.

Figure 6A:
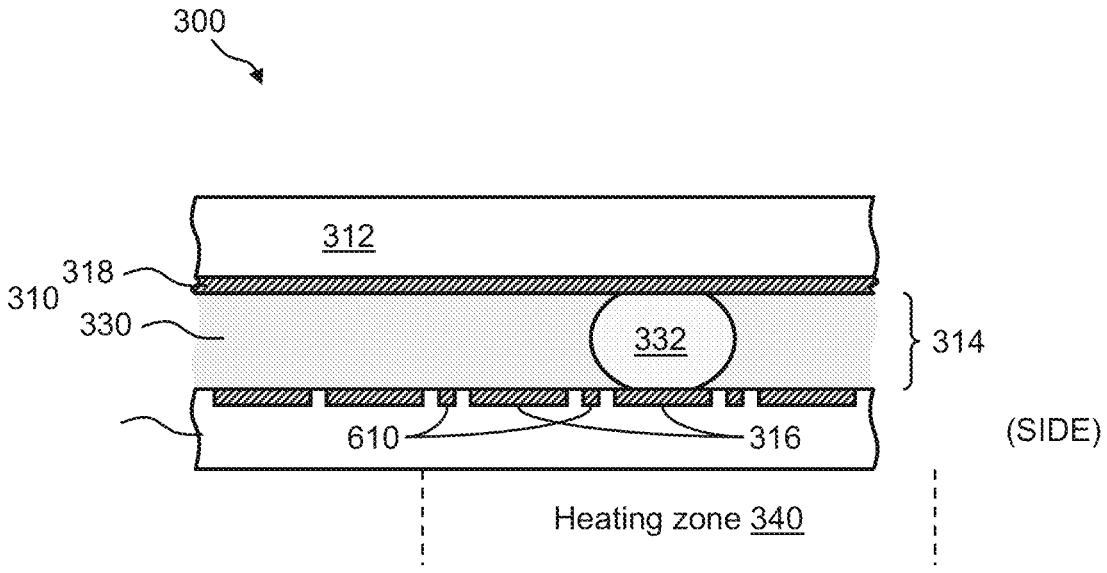
FIGS. 6A and 6B illustrate a side view and top view, respectively, of a droplet actuator that includes a ground or reference that is coplanar to the droplet operations electrodes to assist the droplet to be in reliable contact with the ground or reference of the droplet actuator.
Figure 6B:
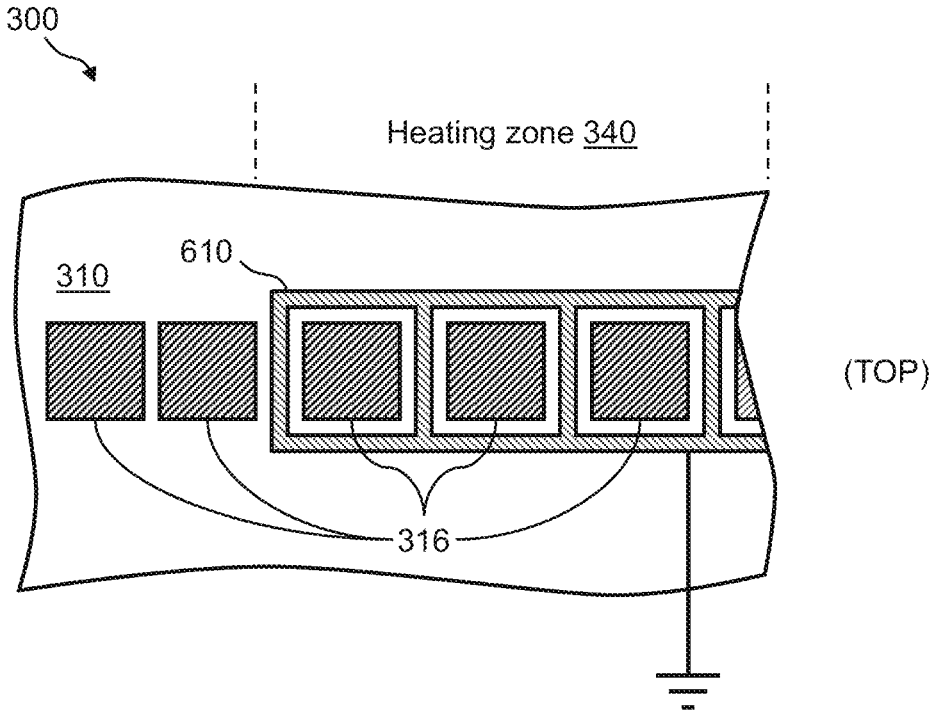

FIGS. 6A and 6B illustrate a side view and top view, respectively, of an example of droplet actuator 300 that includes a ground or reference that is coplanar to droplet operations electrodes 316 to assist the droplet to be in reliable contact with the ground or reference of droplet actuator 300. In this example, in the portion of droplet actuator 300 that is in heating zone 340, the spacing between the droplet operations electrodes 316 is increased to allow a ground or reference plane 610 to be implemented in the same plane as droplet operations electrodes 316 on bottom substrate 310. For example, ground or reference plane 610 is an arrangement of wiring traces that substantially surround each droplet operations electrodes 316. Ground or reference plane 610 is electrically connected to the electrical ground of droplet actuator 300. In this way, while a droplet, such as droplet 332, transitions from one droplet operations electrode 316 to the next, a ground connection of the droplet to ground is maintained, thus reducing or eliminating bubbles, thereby permitting completion of multiple droplet operations without interruption by bubble formation.

In one example, ground or reference plane 610 is implemented according to FIG. 1A of U.S. Patent Publication No. 20060194331, entitled "Apparatuses and methods for manipulating droplets on a printed circuit board," published on Aug. 31, 2006, the entire disclosure of which is incorporated herein by reference.

While the presence of ground or reference plane 610 consumes more surface area than the biplanar approach (i.e., conductive layer 318 only), ground or reference plane 610 can be limited to the heated regions of the droplet actuator. In the example shown in FIGS. 6A and 6B, droplet actuator 300 includes both conductive layer 318 and ground or reference plane 610 in the heated regions. However, in another example, droplet actuator 300 includes only the ground or reference plane 610 in the heated regions and conductive layer 318 in the unheated regions. In yet another example, droplet actuator 300 includes the ground or reference plane 610 throughout the entirety of bottom substrate 310 and there is no conductive layer 318 on any portion of top substrate 312.

Figure 7A:
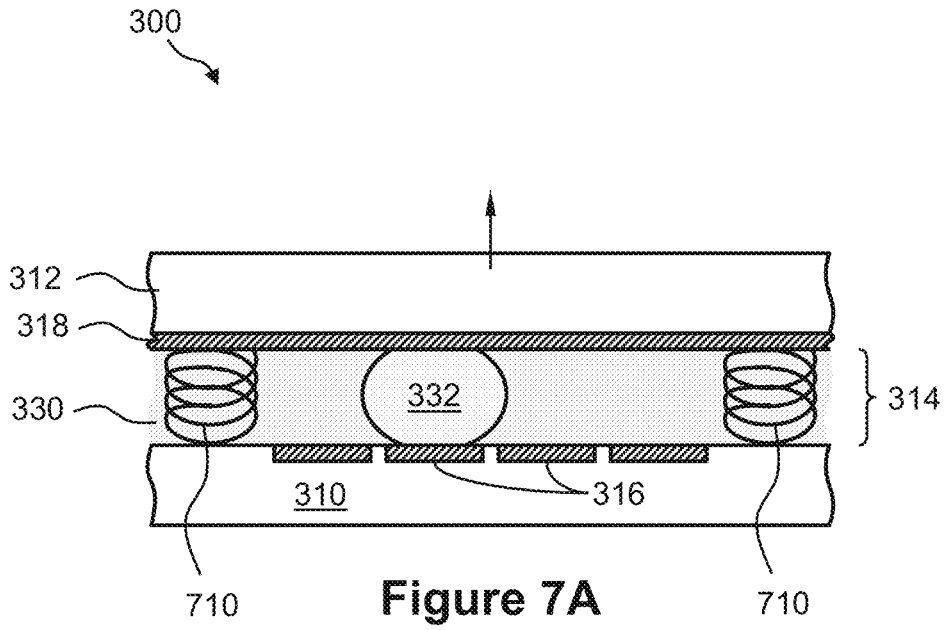
FIGS. 7A and 7B illustrate side views of a droplet actuator whose droplet operations gap height is adjustable, wherein the droplet operations gap height can be reduced as needed to assist the droplet to be in reliable contact with the ground or reference of the droplet actuator.
Figure 7B:
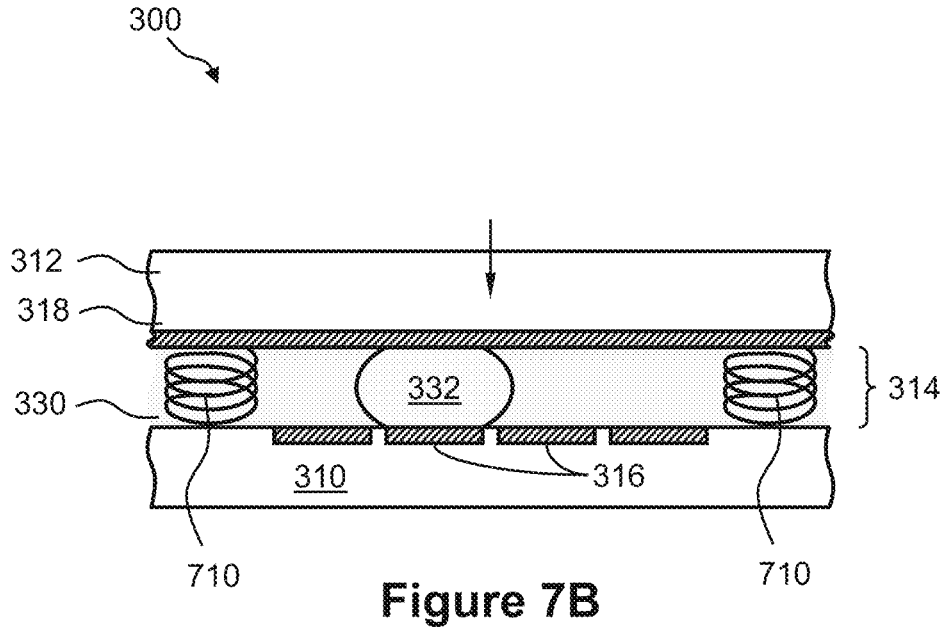

FIGS. 7A and 7B illustrate side views of an example of droplet actuator 300 whose droplet operations gap height is adjustable. Namely, the height of droplet operations gap 314 can be reduced as needed to assist the droplet to be in reliable contact with conductive layer 318, which is the ground or reference. In one example, a spring force exists between bottom substrate 310 and top substrate 312. For example, multiple springs 710 are provided in droplet operations gap 314. The gap height can be reduced by compressing bottom substrate 310 and top substrate 312 slightly together. Namely, by holding bottom substrate 310 stationary and applying force to top substrate 312, by holding top substrate 312 stationary and applying force to bottom substrate 310, or by applying force to both simultaneously. The force may be applied during the heating of a droplet, or while droplets are in a heated region, in order to reduce the gap height and ensure that the droplet maintains contact with conductive layer 318 of top substrate 312, thus reducing or eliminating bubbles, thereby permitting completion of multiple droplet operations without interruption by bubble formation.

Figure 8A:
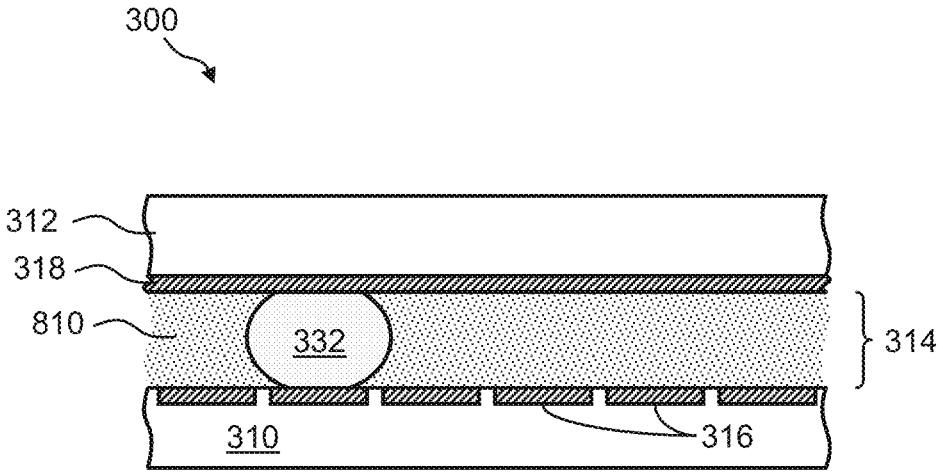
FIGS. 8A and 8B illustrate side views of droplet actuators that utilize electrical conductivity in the filler fluid to assist the droplet to discharge to the droplet.
Figure 8B:
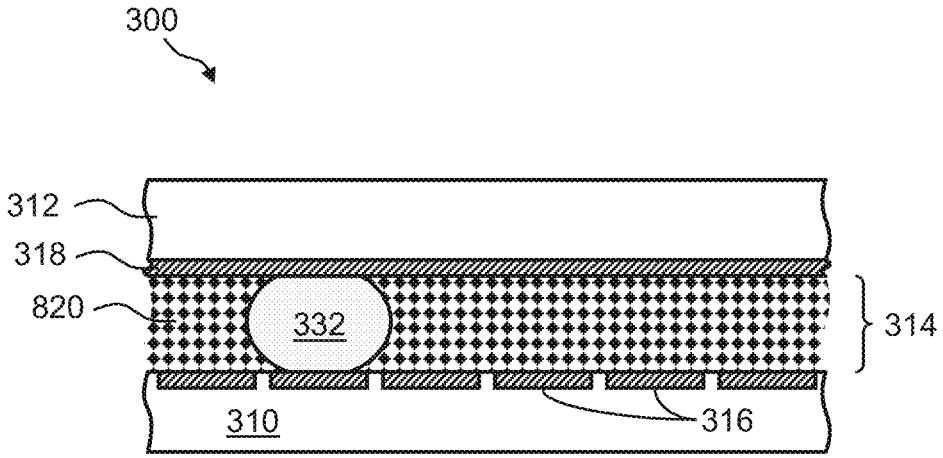

FIGS. 8A and 8B illustrate side views of examples of droplet actuator 300 that utilize electrical conductivity in the filler fluid to discharge to the droplet. In one example, FIG. 8A shows that the droplet operations gap 314 of droplet actuator 300 is filled with a filler fluid 810 that is electrically conductive. Providing an electrically conductive filler fluid permits the droplet to discharge even when it is not in contact with top substrate 312. An example of electrically conductive fluid is a ferrofluid, such as a silicone oil based ferrofluid. Other examples of ferrofluids are known in the art, such as those described in U.S. Pat. No. 4,485,024, entitled "Process for producing a ferrofluid, and a composition thereof," issued on Nov. 27, 1984; and U.S. Pat. No. 4,356,098, entitled "Stable ferrofluid compositions and method of making same," issued on Oct. 26, 1982; the entire disclosures of which are incorporated herein by reference.

In another example, FIG. 8B shows that the droplet operations gap 314 of droplet actuator 300 is filled with a filler fluid 820 that contains electrically conductive particles. The electrically conductive particles in the filler fluid permit the droplet to discharge even when it is not in contact with top substrate 312. Examples of electrically conductive particles are known in the art, such as those described in U.S. Patent Publication No. 20070145585, entitled "Conductive particles for anisotropic conductive interconnection," published on Jun. 8, 2007, the entire disclosure of which is incorporated herein by reference.

Figure 9:
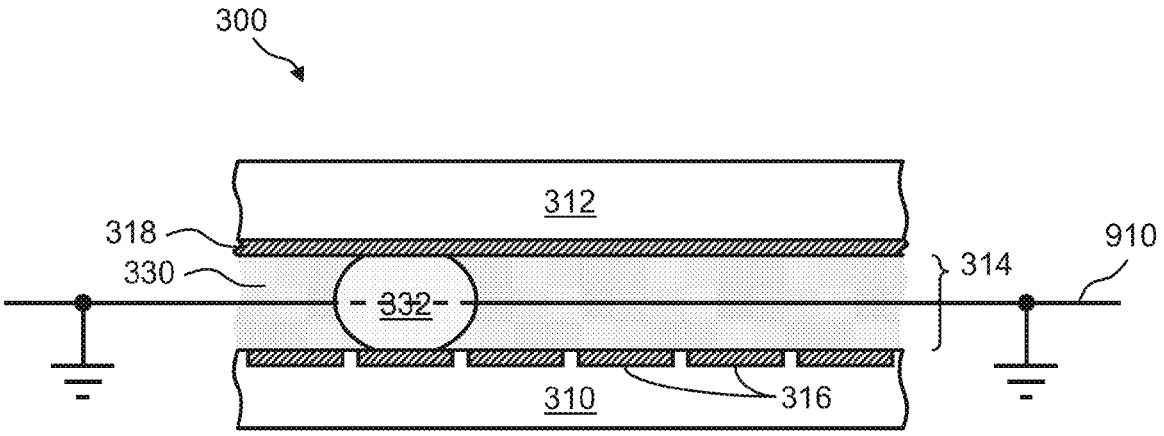
FIG. 9 illustrates a side view of a droplet actuator that includes a ground wire in the droplet operations gap to assist the droplet to be in reliable contact with the ground or reference of the droplet actuator.

FIG. 9 illustrates a side view of an example of droplet actuator 300 that includes a ground wire 910 in the droplet operations gap 314 to discharge to the droplet. Ground wire 910 is electrically connected to the electrical ground of droplet actuator 300. Ground wire 910 is, for example, formed of copper, aluminum, silver, or gold. The ground wire 910 in the filler fluid extends through the droplet and thus permits the droplet to discharge even when it is not in contact with top substrate 312. In one example, ground wire 910 exists without the presence of conductive layer 318 and therefore alone serves as the ground or reference electrode of droplet actuator 300. In another example, ground wire 910 exists in combination with conductive layer 318 and together they serve as the ground or reference electrode of droplet actuator 300. In yet another example, ground wire 910 exists in the heated regions only of the droplet actuator. In still another example, ground wire 910 exists in both the heated regions and unheated regions of the droplet actuator.

Examples of liquid moving along a wire are known in the art, such as those described in U.S. Pat. No. 7,052,244, entitled "Device for displacement of small liquid volumes along a micro-catenary line by electrostatic forces," issued on May 10, 2006; the entire disclosure of which is incorporated herein by reference.

Figure 10:
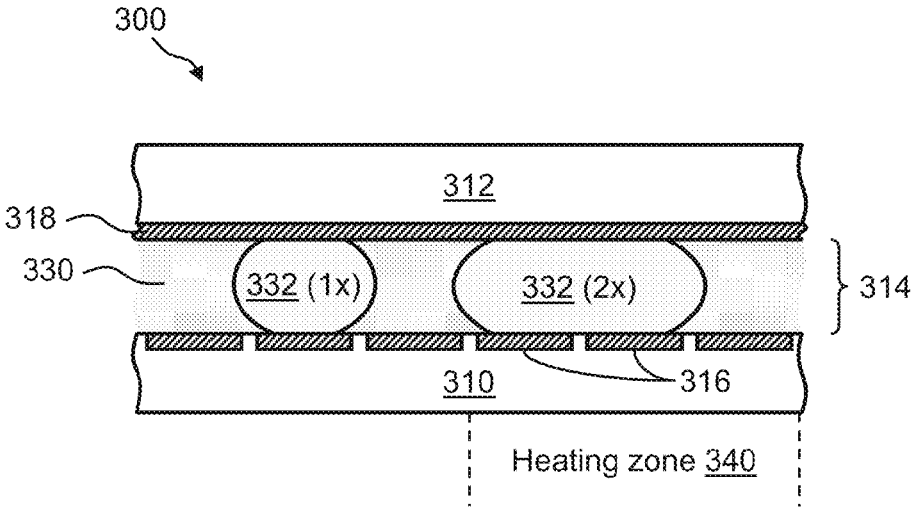
FIG. 10 illustrates a side view of a droplet actuator that utilizes 2× or larger droplets to assist the droplets to be in reliable contact with the ground or reference of the droplet actuator.

FIG. 10 illustrates a side view of droplet actuator 300 that utilizes 2× or larger droplets to assist the droplets to be in reliable contact with conductive layer 318, which is the ground or reference. For example, in advance of heating zone 340, two or more 1× droplets 332 can be merged using droplet operations to form, for example, 2× or 3× droplets 332. The 2× or 3× droplets 332 are then transported into heating zone 340. Droplet operations in heating zone 340 are then conducted using the 2× or 3× droplets 332. In this way, reliable contact between the 2× or 3× droplets 332 and conductive layer 318 is maintained, thus reducing or eliminating bubbles, thereby permitting completion of multiple droplet operations without interruption by bubble formation.

In other embodiments, the viscosity of the droplet can be increased to help maintain contact with conductive layer 318 of top substrate 312. If the droplet viscosity is greater, it is more likely to displace oil in contact with top substrate 312. Further, droplet movement will be slower, and the droplet will be distorted less during droplet operations, thereby helping to maintain contact with conductive layer 318. In yet other embodiments, the viscosity of the filler fluid can be decreased, which helps the droplet stay in contact with top substrate 312.

7.2 Droplet Operations Electrodes for Improved Droplet Transport

Figure 11:
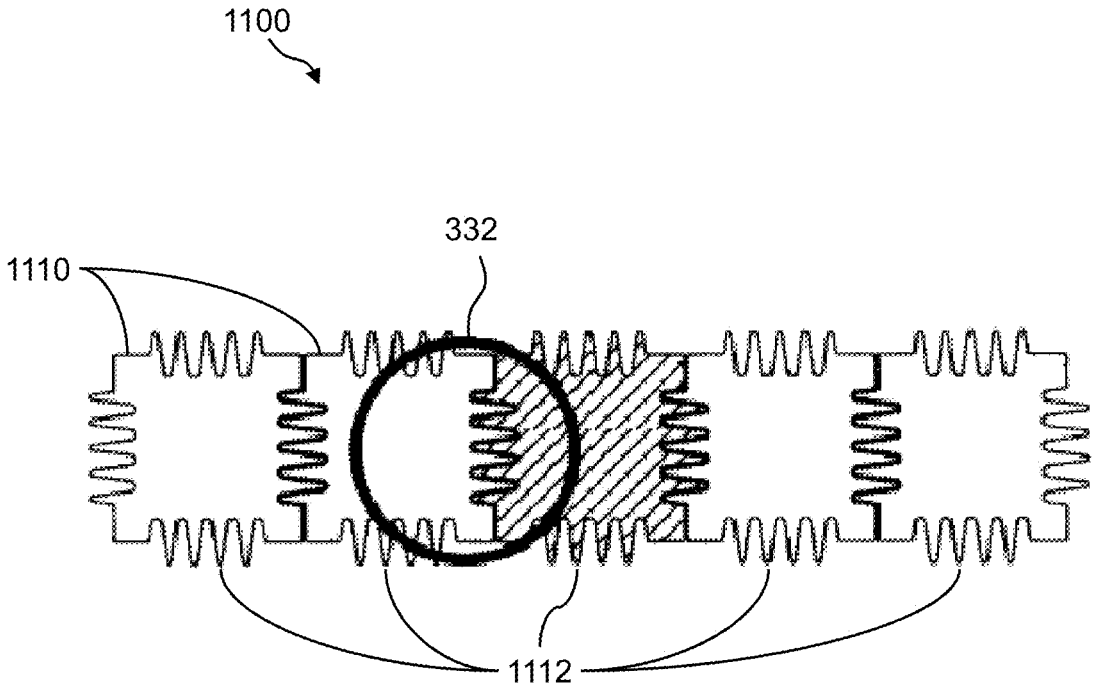
FIGS. 11, 12A, 12B, 12C, and 12D illustrate top views of examples of electrode arrangements that utilize interdigitated droplet operations electrodes to smooth out the transport of droplets from one interdigitated electrode to the next.

FIG. 11 illustrates a top view of an example of an electrode arrangement 1100 that utilizes interdigitated droplet operations electrodes to smooth out the transport of droplets from one interdigitated electrode to the next. "Smooth out" means to perform droplet operations with less droplet deformation than when interdigitated electrodes are not provided. For example, electrode arrangement 1100 includes an arrangement of droplet operations electrodes 1110. The edges of each of the droplet operations electrodes 1110 include interdigitations 1112. Droplet operations electrodes 1110 are designed such that the interdigitations 1112 of one droplet operations electrode 1110 are fitted together with the interdigitations 1112 of an adjacent droplet operations electrode 1110, as shown in FIG. 11. Examples of interdigitated droplet operations electrodes are known in the art, such as those described in FIG. 2 of U.S. Pat. No. 6,565,727, entitled "Actuators for microfluidics without moving parts," issued on May 20, 2003, the entire disclosure of which is incorporated herein by reference.

Droplet operations electrodes 1110 that include interdigitations 1112 have the effect of smoothing out the transport of the droplet from one electrode to the next electrode. This is due to the overlap between electrode surfaces. As a result, during droplet operations the droplet is more likely to remain in contact with the ground or reference electrode of the top substrate (e.g. conductive layer 318 of top substrate 312), thus reducing or eliminating bubbles, thereby permitting completion of multiple droplet operations without interruption by bubble formation. In the example shown in FIG. 11, the interdigitations are fairly shallow, meaning they do not extent deep into the base portion of the adjacent electrode.

Figure 12A:
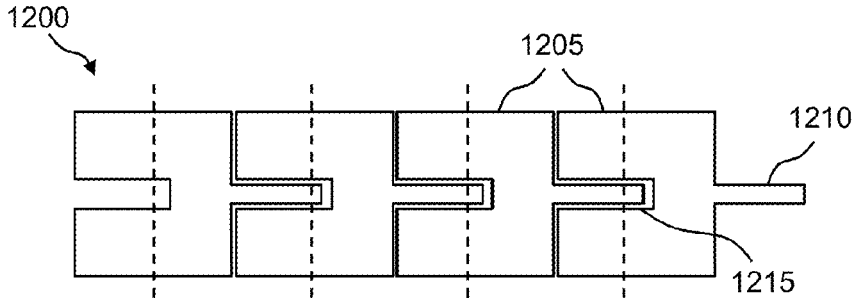

FIGS. 12A, 12B, 12C, and 12D illustrate top views of other examples of electrode arrangements that utilize interdigitated droplet operations electrodes to smooth out the transport of droplets from one interdigitated electrode to the next. In these examples, the interdigitations extend to at least the halfway point of the base portion of the adjacent electrode. In one example, an electrode arrangement 1200 of FIG. 12A includes an arrangement of droplet operations electrodes 1205. Extending from one side of each droplet operations electrode 1205 is an interdigitation 1210. The side of each droplet operations electrode 1205 that is opposite the interdigitation 1210 includes a cutout 1215. In this example, interdigitation 1210 is an elongated rectangular-shaped finger and, therefore, cutout 1215 is an elongated rectangular-shaped cutout region. When arranged in a line, interdigitation 1210 of one droplet operations electrode 1205 is fitted into cutout 1215 of the adjacent droplet operations electrode 1205, as shown in FIG. 12A.

Figure 12B:
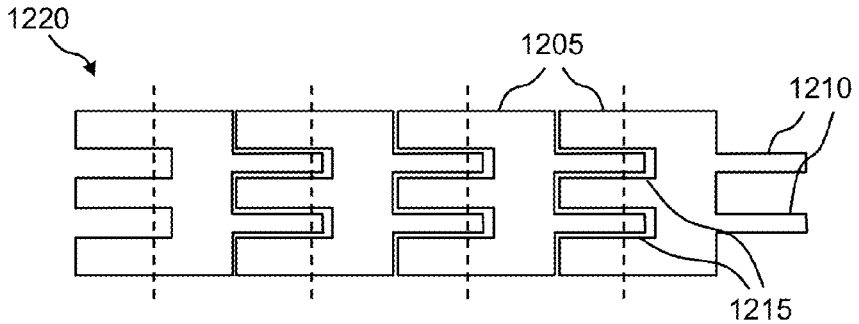

In another example, an electrode arrangement 1220 of FIG. 12B includes an arrangement of the droplet operations electrodes 1205. However, in this example, each droplet operations electrode 1205 includes two interdigitations 1210 and two corresponding cutouts 1215. Again, when arranged in a line, the two interdigitations 1210 of one droplet operations electrode 1205 are fitted into the two cutouts 1215 of the adjacent droplet operations electrode 1205, as shown in FIG. 12B.

Figure 12C:
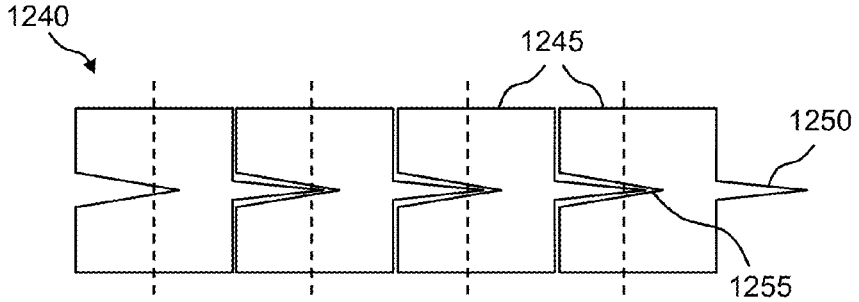

In yet another example, an electrode arrangement 1240 of FIG. 12C includes an arrangement of droplet operations electrodes 1245. Extending from one side of each droplet operations electrode 1245 is an interdigitation 1250. The side of each droplet operations electrode 1245 that is opposite the interdigitation 1250 includes a cutout 1255. In this example, interdigitation 1250 is an elongated triangular-shaped finger and, therefore, cutout 1255 is an elongated triangular-shaped cutout region. When arranged in a line, interdigitation 1250 of one droplet operations electrode 1245 is fitted into cutout 1255 of the adjacent droplet operations electrode 1245, as shown in FIG. 12C.

Figure 12D:
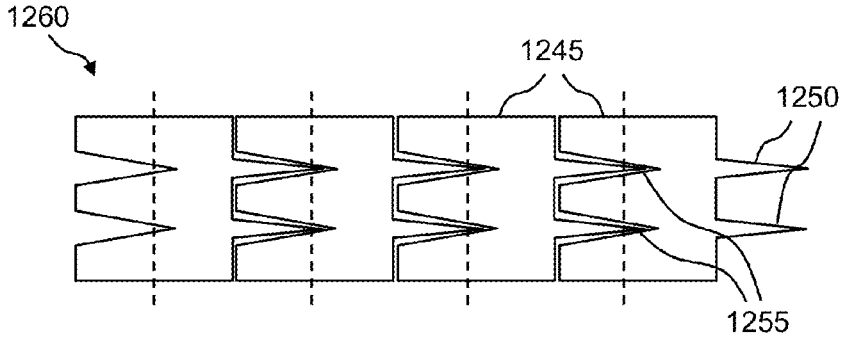

In still another example, an electrode arrangement 1260 of FIG. 12D includes an arrangement of the droplet operations electrodes 1245. However, in this example, each droplet operations electrode 1245 includes two interdigitations 1250 and two corresponding cutouts 1255. Again, when arranged in a line, the two interdigitations 1250 of one droplet operations electrode 1245 are fitted into the two cutouts 1255 of the adjacent droplet operations electrode 1245, as shown in FIG. 12D.

Droplet operations electrodes 1205 and droplet operations electrodes 1245 are not limited to only one or two interdigitations and cutouts and are not limited to the shapes shown in FIGS. 12A, 12B, 12C, and 12D. Droplet operations electrodes 1205 and droplet operations electrodes 1245 can include any number and any shapes of interdigitations and cutouts. A main aspect of the electrode arrangements shown in FIGS. 12A, 12B, 12C, and 12D is that they include interdigitations that extend to at least the halfway point of the base portion of the adjacent droplet operations electrode. For example, the interdigitations extend at least 50%, 60%, 70%, 80%, 90% or more across the base portion of the adjacent droplet operations electrode. The base portion means the portion of the electrode that is not the interdigitation itself.

Figure 13A:
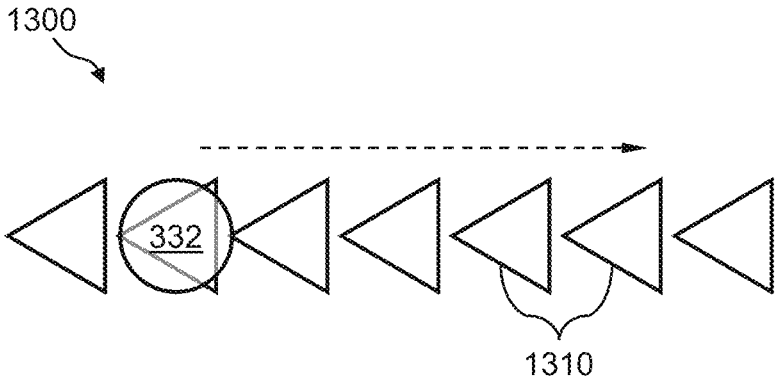
FIGS. 13A and 13B illustrate top views of examples of electrode arrangements that utilize triangular droplet operations electrodes to smooth out the transport of droplets from one triangular electrode to the next.
Figure 13B:
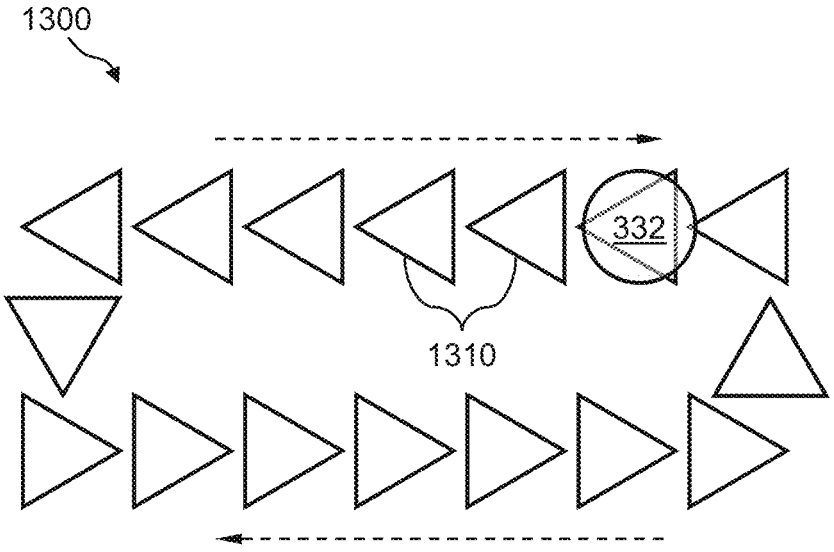

FIGS. 13A and 13B illustrate top views of examples of electrode arrangements that utilize triangular droplet operations electrodes to smooth out the transport of droplets from one triangular electrode to the next. FIG. 13A shows an electrode arrangement 1300 that includes a line of triangular droplet operations electrodes 1310. During droplet operations, greatest benefit is achieved when the droplet 332 travels in the direction that is away from the apex of the originating triangular droplet operations electrode 1310 and toward the apex of the destination triangular droplet operations electrode 1310. Therefore, in a heated region of a droplet actuator, droplet transport along triangular droplet operations electrodes 1310 may be in one direction. However, outside the heated region triangular droplet operations electrodes 1310 could be used to transport in either direction. Alternatively, triangular droplet operations electrodes 1310 may be provided only in the heated region. Further, triangular droplet operations electrodes 1310 may be provided in a loop, as shown in FIG. 13B, in order to transport in both directions.

Figure 14A:
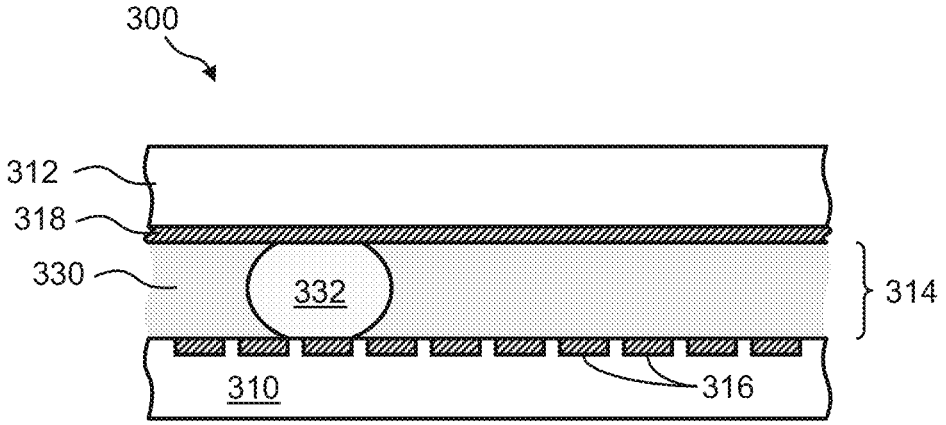
FIGS. 14A and 14B illustrate a side view and a top down view, respectively, of a droplet actuator in which the droplet operations electrodes are tailored for increasing the speed of droplet operations.
Figure 14B:
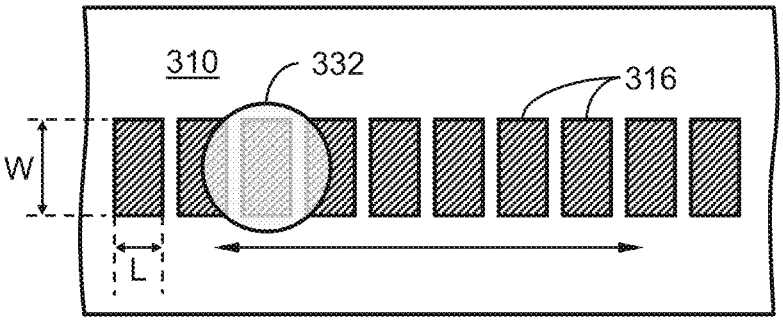

FIGS. 14A and 14B illustrate a side view and a top down view, respectively, of droplet actuator 300 in which droplet operations electrodes 316 are tailored for increasing the speed of droplet operations. Each droplet operations electrode 316 has a length L and a width W, wherein the length L is the dimension of the droplet operations electrode 316 that coincides with the direction of droplet travel. Typically, the width W and length L of droplet operations electrodes are about equal. However, in this example, the length L is less than the width W. In one example, the length L is about one half the width W. In this electrode arrangement the travel distance across each droplet operations electrode 316 is reduced and thus the speed of droplet operations is increased. By increasing the speed of droplet operations, the droplet is more likely to maintain contact with conductive layer 318 throughout the entirety of droplet operations process, thus reducing or eliminating bubbles, thereby permitting completion of multiple droplet operations without interruption by bubble formation.

7.3 Droplet Operations Channels

In one embodiment, the droplet operations gap of a droplet actuator is bounded with sidewalls (e.g., a sidewall and an opposite sidewall) to create a droplet operations channel.

Figure 15:
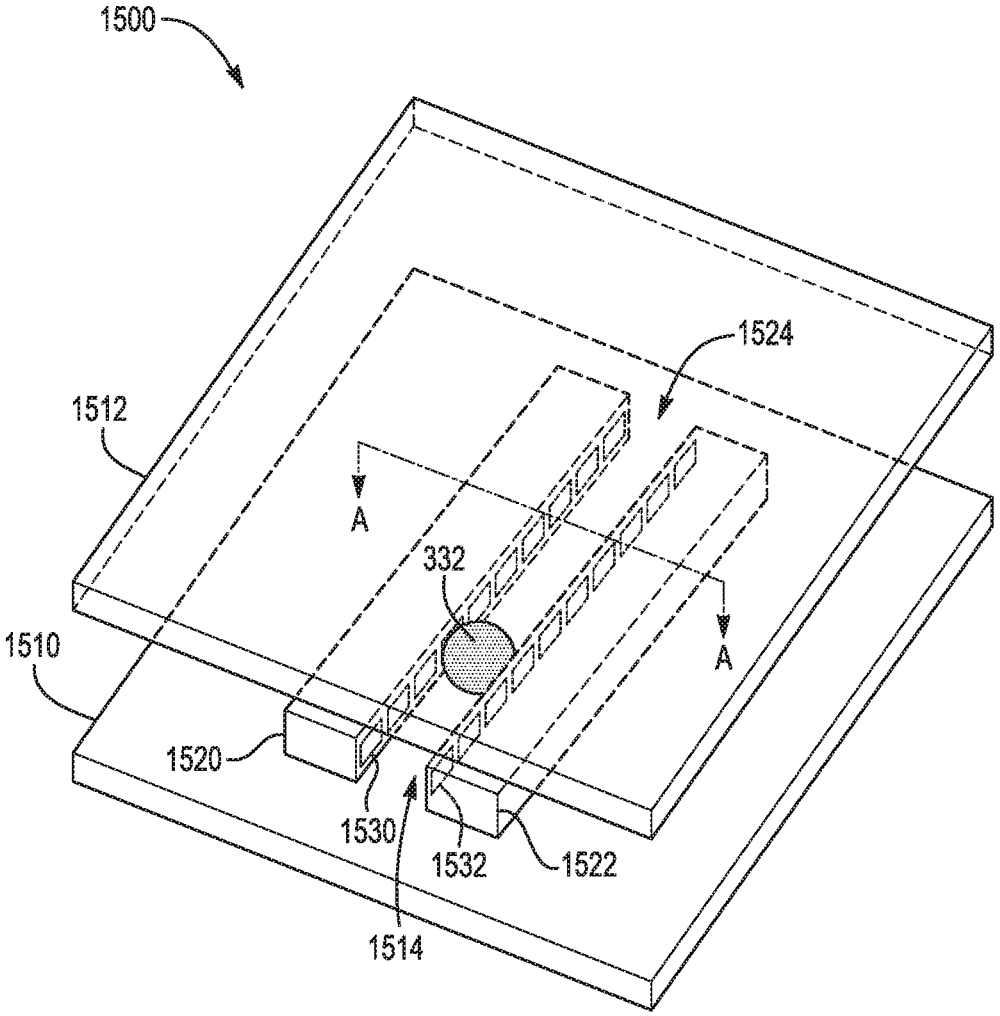
FIGS. 15 through 22B illustrate various views of a droplet actuator that includes a droplet operations channel, wherein the sidewalls of the droplet operations channel includes electrode arrangements to assist the droplet to be in reliable contact with the ground or reference of the droplet actuator.

FIG. 15 illustrates an isometric view of a droplet actuator 1500 that includes a droplet operations channel, wherein the sidewalls of the droplet operations channel include electrode arrangements to assist the droplet to be in reliable contact with the ground or reference of the droplet actuator. Droplet actuator 1500 includes a bottom substrate 1510 and a top substrate 1512 that are separated by a gap 1514.

Figure 16:
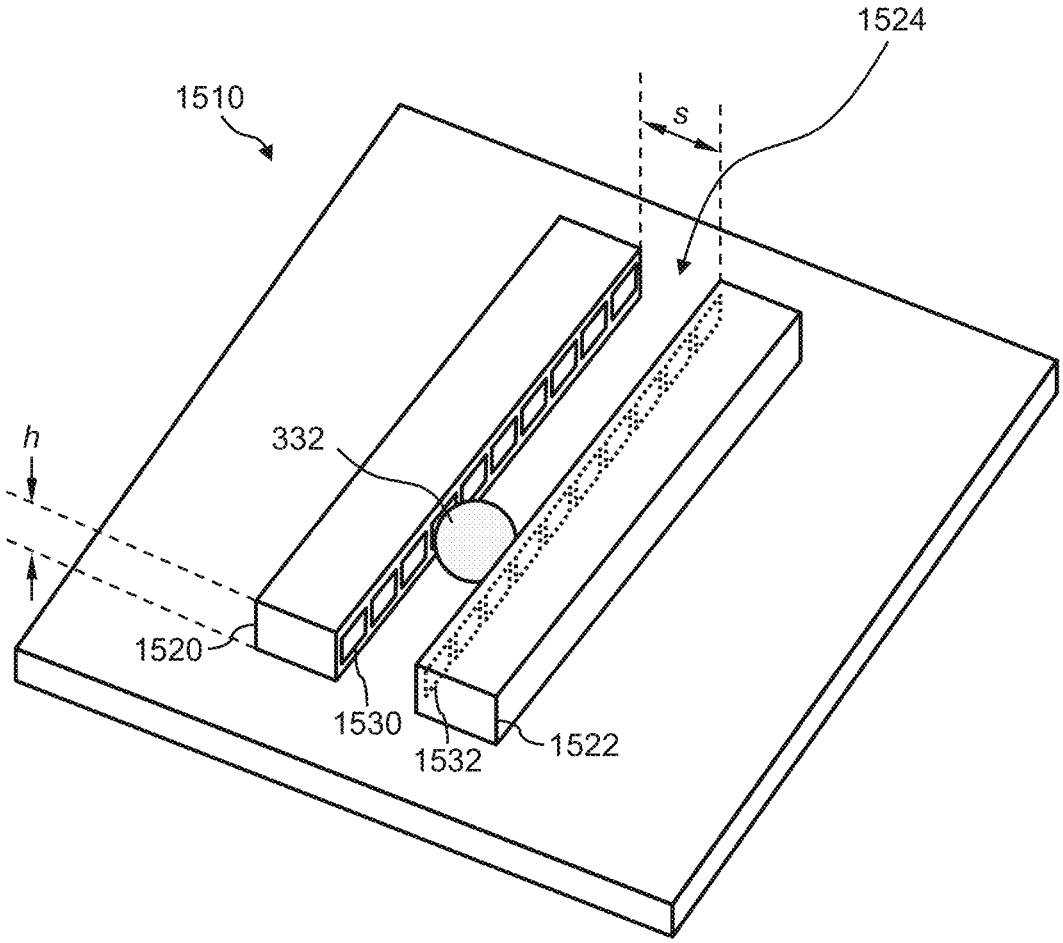

Referring now to FIG. 16, which is an isometric view of bottom substrate 1510 alone, bottom substrate 1510 further includes a first rail 1520 and a second rail 1522. First rail 1520 and second rail 1522 are elongated three-dimensional (3D) structures that are arranged in parallel with each other. There is a space s between first rail 1520 and second rail 1522. First rail 1520 and second rail 1522 have a height h. The space s between first rail 1520 and second rail 1522 forms a droplet operations channel 1524. More particularly, the side of first rail 1520 that is facing droplet operations channel 1524 and the side of second rail 1522 that is facing droplet operations channel 1524 provide droplet operations surfaces. Accordingly, an arrangement of droplet operations electrodes 1530 are provided on the surface of first rail 1520 that is facing droplet operations channel 1524. Similarly, an arrangement of ground or reference electrodes 1532 are provided on the surface of second rail 1522 that is facing droplet operations channel 1524. As a result, droplet operations can be conducted along droplet operations channel 1524 using droplet operations electrodes 1530 and ground or reference electrodes 1532. The space s and the height h of droplet operations channel 1524 are set such that a droplet (e.g., droplet 332) of a certain volume may be manipulated along droplet operations channel 1524.

Figure 17:
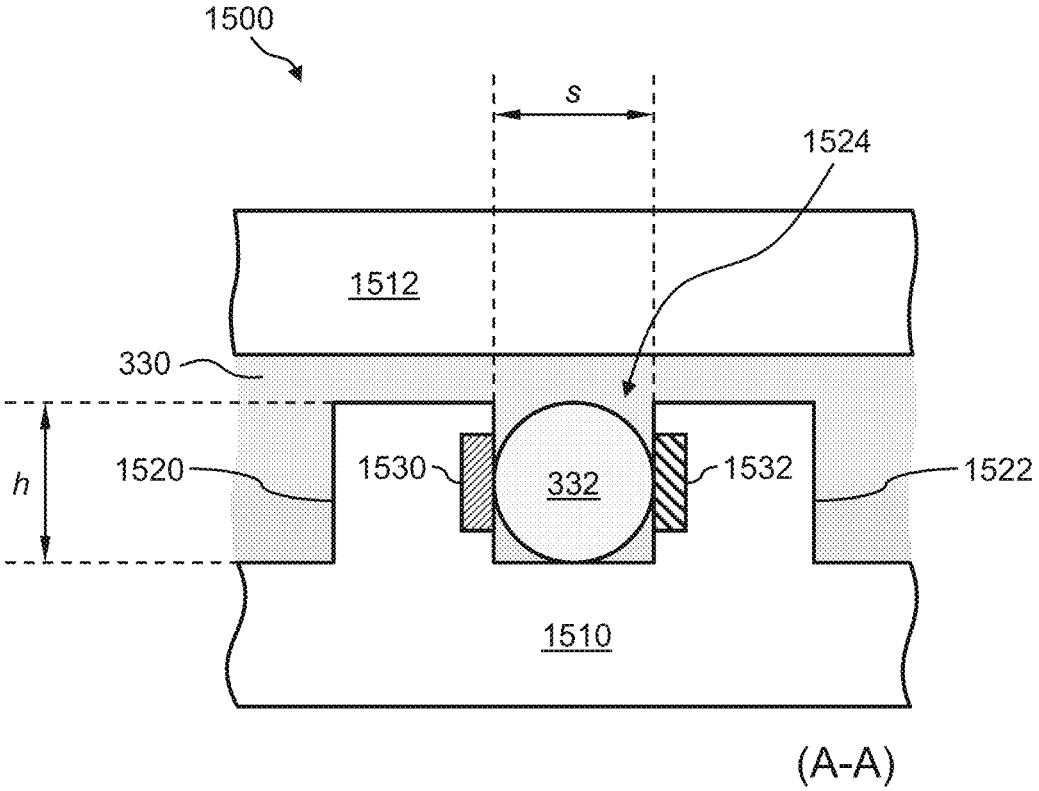

Referring now to FIG. 17, which is a cross-sectional view of a portion of droplet actuator 1500 taken along line A-A of FIG. 15, there is a gap between top substrate 1512 and the topmost surfaces of first rail 1520 and second rail 1522 that allows the full volume between bottom substrate 1510 and top substrate 1512 to be filled with filler fluid 330.

In operation and referring to FIGS. 15, 16, and 17, because droplet operations are conducted between droplet operations electrodes 1530 and ground or reference electrodes 1532, which are arranged on the sidewalls of first rail 1520 and second rail 1522, respectively, gravity does not come into play (as shown in FIG. 2) to cause droplet 332 to lose contact with ground during any phase of the droplet operations. In this way, reliable contact between droplet 332 and, for example, ground or reference electrodes 1532 is maintained, thus reducing or eliminating bubbles, thereby permitting completion of multiple droplet operations without interruption by bubble formation.

Droplet actuator 1500 and more particularly droplet operations channel 1524 is not limited to the electrode arrangements shown in FIGS. 15, 16, and 17. Other electrode arrangements may be used in droplet operations channel 1524, examples of which are described below with reference to FIGS. 18 through 22B.

Figure 18:
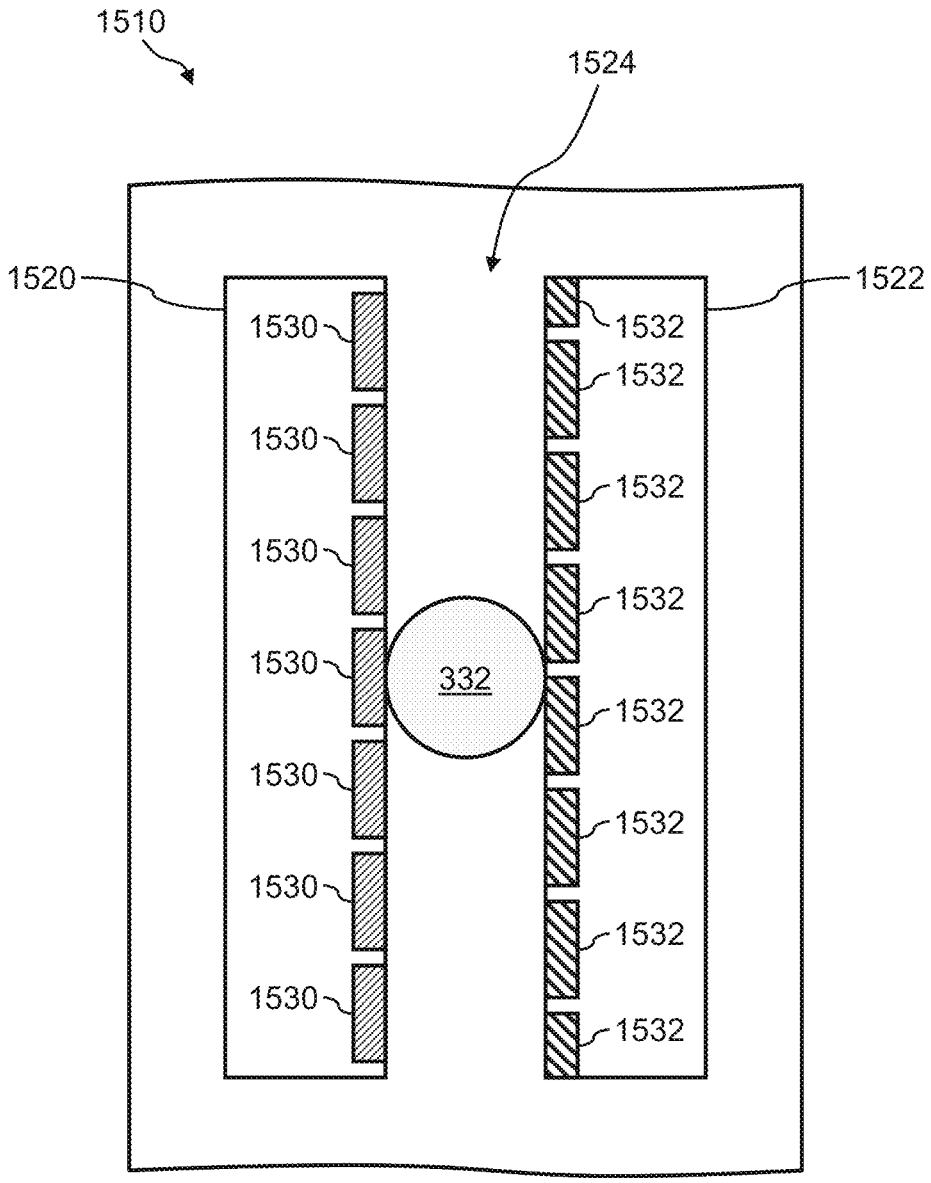

In one example, whereas FIGS. 15, 16, and 17 show droplet operations electrodes 1530 of first rail 1520 and ground or reference electrodes 1532 of second rail 1522 aligned substantially opposite one another, FIG. 18 illustrates a top down view of a portion of bottom substrate 1510 in which droplet operations electrodes 1530 and ground or reference electrodes 1532 are staggered or offset from one another.

Figure 19:
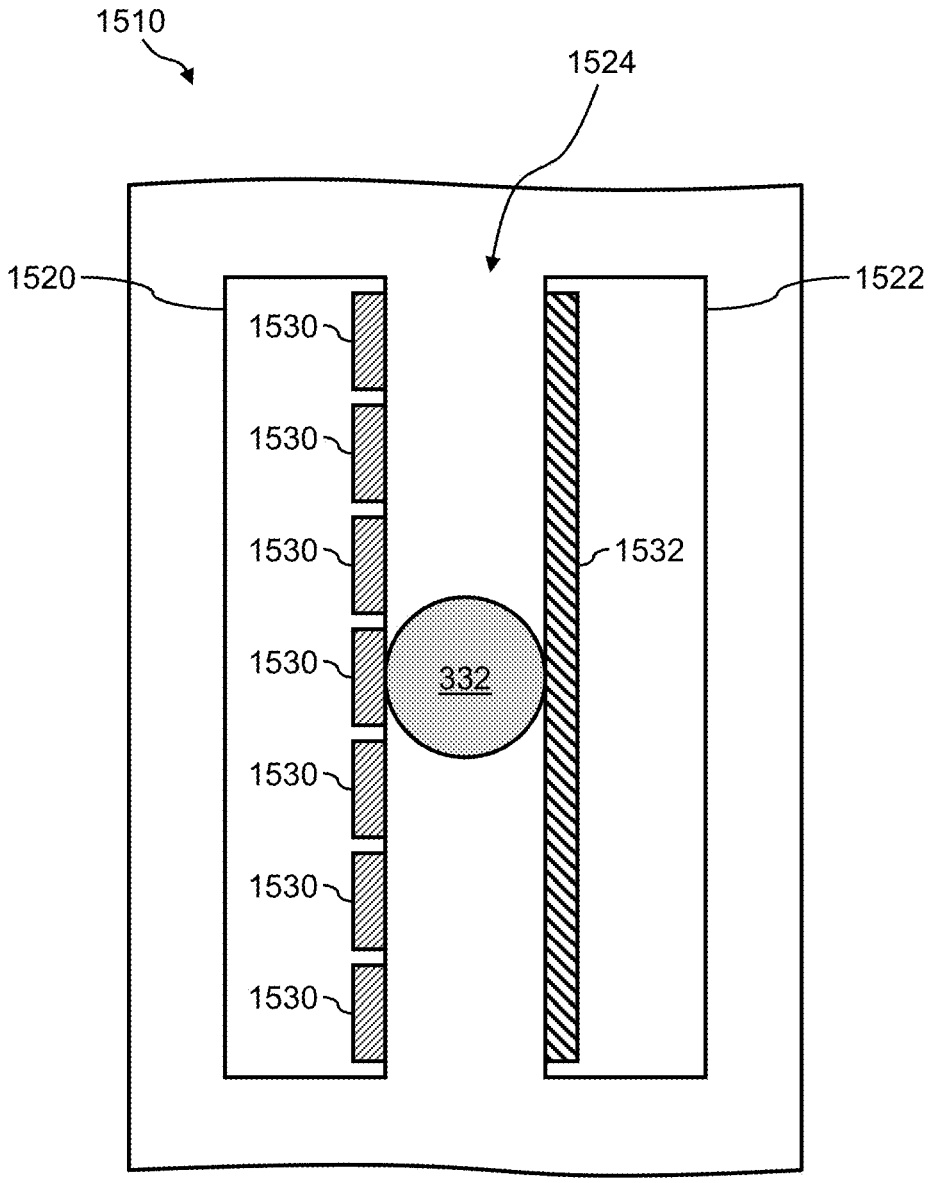

In another example, FIG. 19 illustrates a top down view of a portion of bottom substrate 1510 in which the line of multiple ground or reference electrodes 1532 is replaced with a continuous ground or reference electrode 1532.

Figure 20:
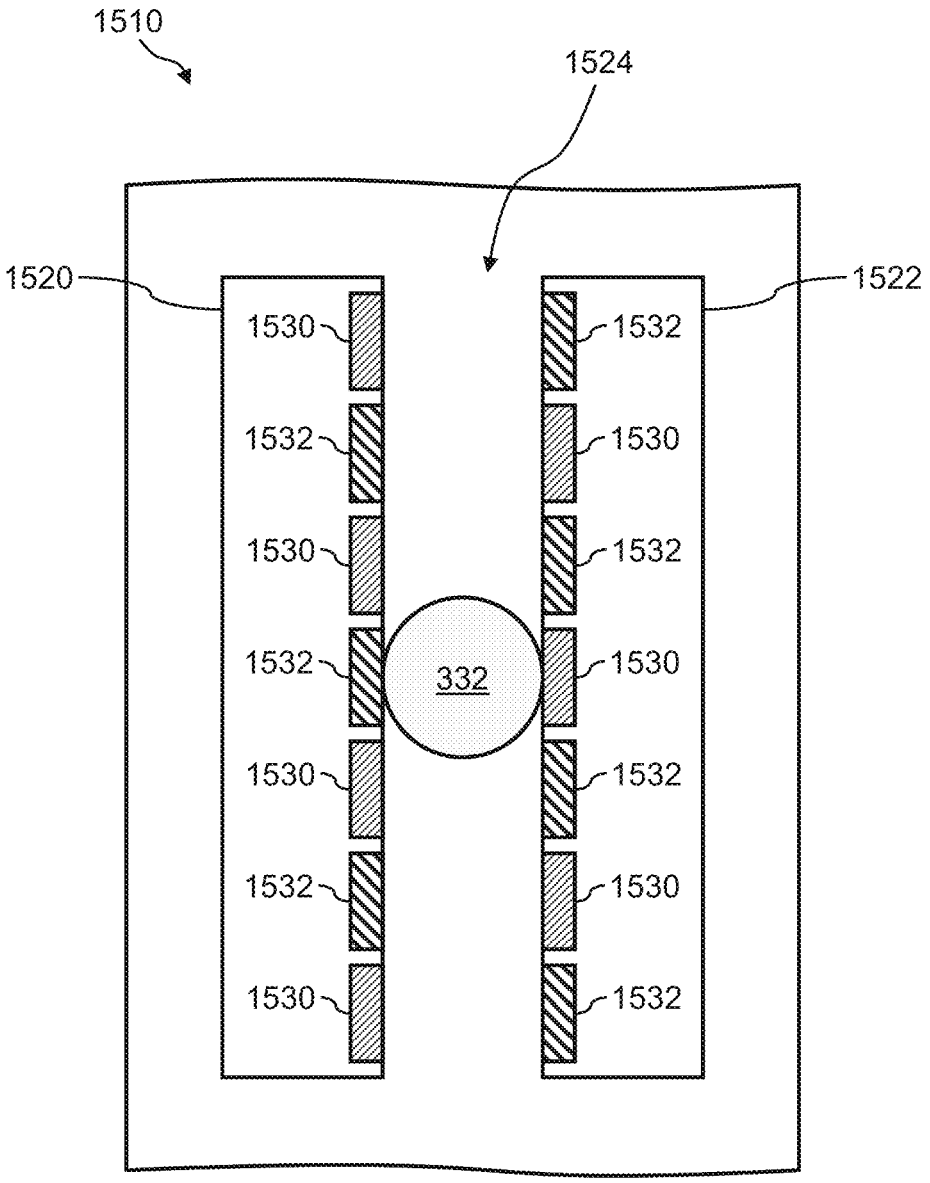

In yet another example, FIG. 20 illustrates a top down view of a portion of bottom substrate 1510 in which droplet operations electrodes 1530 and ground or reference electrodes 1532 are alternating along both first rail 1520 and second rail 1522. Additionally, in this arrangement, each droplet operations electrode 1530 on one sidewall is opposite a ground or reference electrode 1532 on the opposite sidewall.

Figure 21:
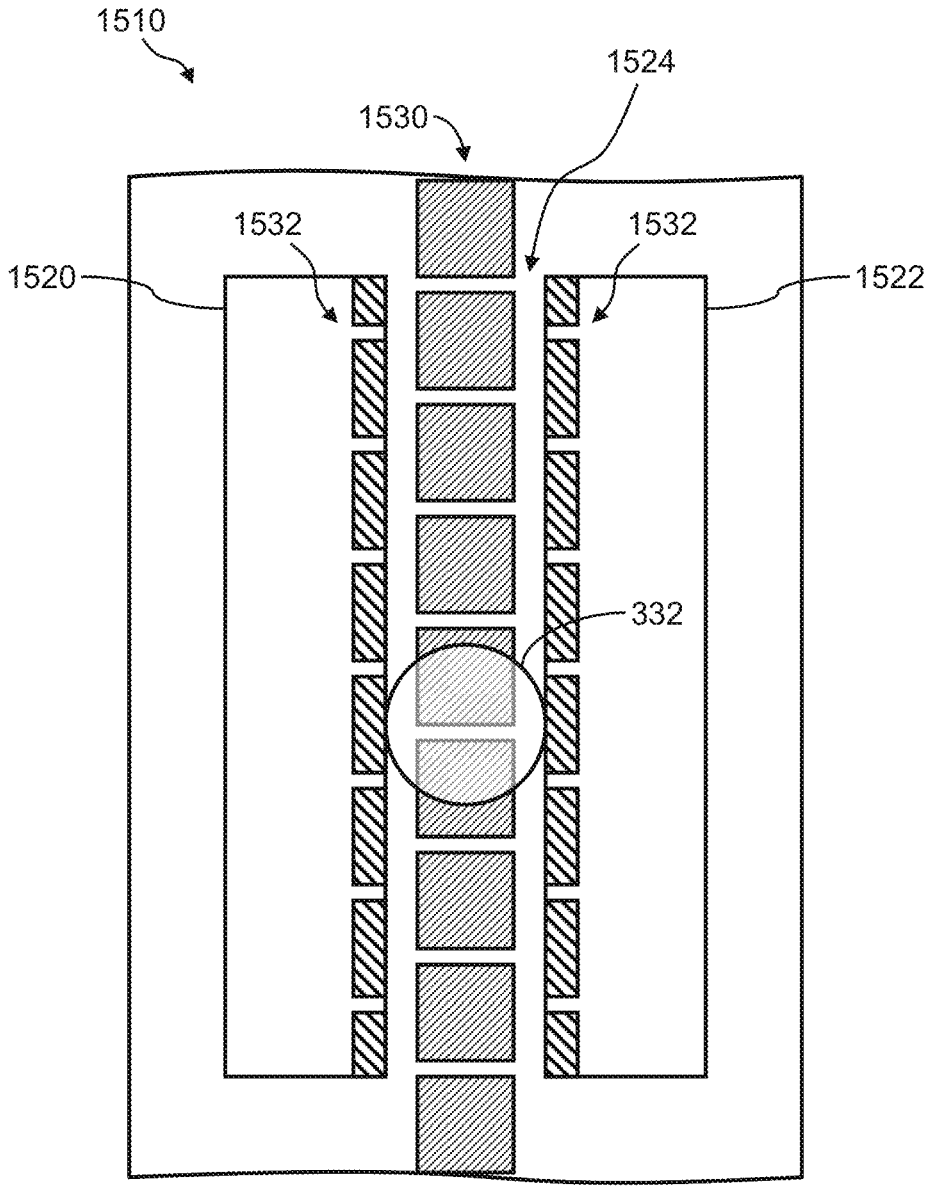
Figure 22A:
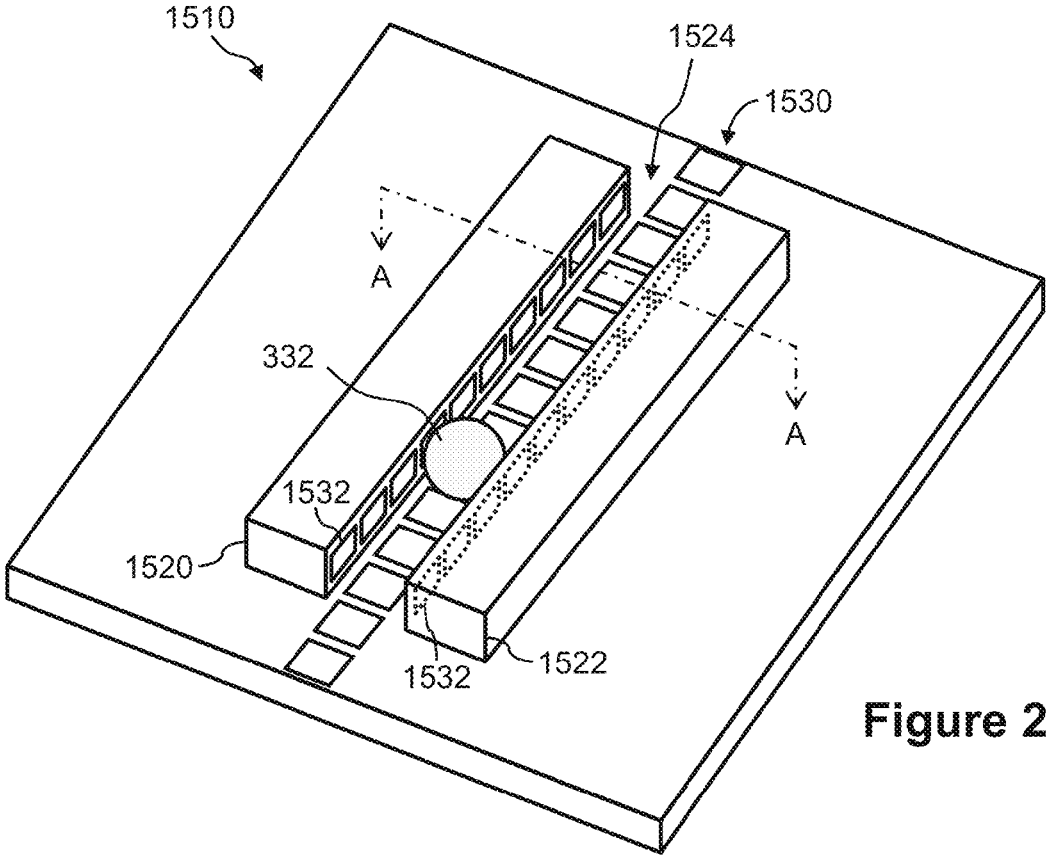
Figure 22B:
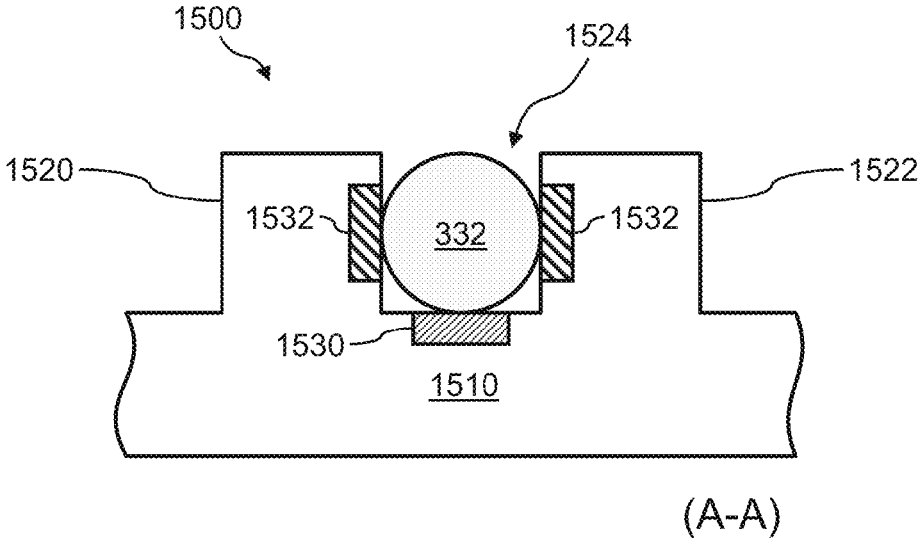

In yet another example, FIG. 21 illustrates a top down view of a portion of bottom substrate 1510 in which ground or reference electrodes 1532 (or a continuous ground or reference electrode 1532) are provided along both first rail 1520 and second rail 1522 and the droplet operations electrodes 1530 are provided on the floor of droplet operations channel 1524. More details of this configuration are shown with respect to FIGS. 22A and 22B. Namely, FIG. 22A illustrates an isometric view of the bottom substrate 1510 shown in FIG. 21 and FIG. 22B illustrates a cross-sectional view of a portion of bottom substrate 1510 taken along line A-A of FIG. 22A. Again, FIGS. 22A and 22B show droplet operations electrodes 1530 arranged on the floor of droplet operations channel 1524 instead of on the sidewalls of droplet operations channel 1524.

Referring now to FIGS. 15 through 22B, in one embodiment, one or more droplet operations channels 1524 are provided in heated regions only of a droplet actuator and used to maintain reliable contact of droplets to ground, thus reducing or eliminating bubbles, thereby permitting completion of multiple droplet operations without interruption by bubble formation. In another embodiment, one or more droplet operations channels 1524 are provided in both heated regions and unheated regions of a droplet actuator.

7.4 Taylor Cones and Bubble Formation

In a liquid, it is widely assumed that when the critical potential $\phi 0^*$ has been reached and any further increase will destroy the equilibrium, the liquid body acquires a conical shape referred to as the Taylor cone. For example, when a small volume of liquid is exposed to an electric field the shape of the liquid starts to deform from the shape caused by surface tension alone. As the voltage is increased the effect of the electric field becomes more prominent and as it approaches exerting a similar amount of force on the droplet as does the surface tension a cone shape begins to form with convex sides and a rounded tip. An example of Taylor cones forming in a droplet actuator are described below in FIG. 23.

Figure 23:
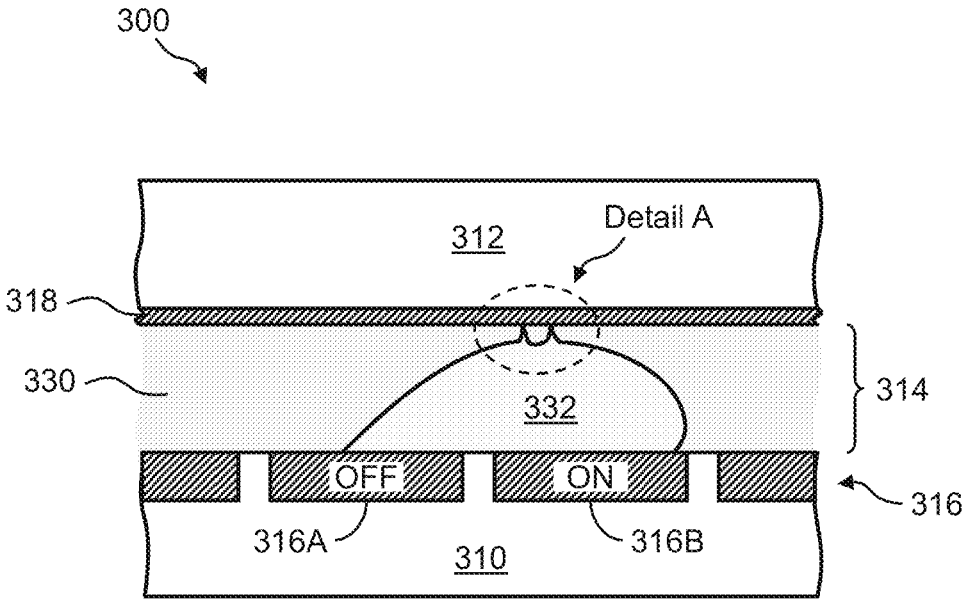
FIG. 23 illustrates a side view of a droplet actuator at the moment in time of the droplet operations process in which the droplet loses contact with the top substrate and Taylor cones are formed.
Figure 23:
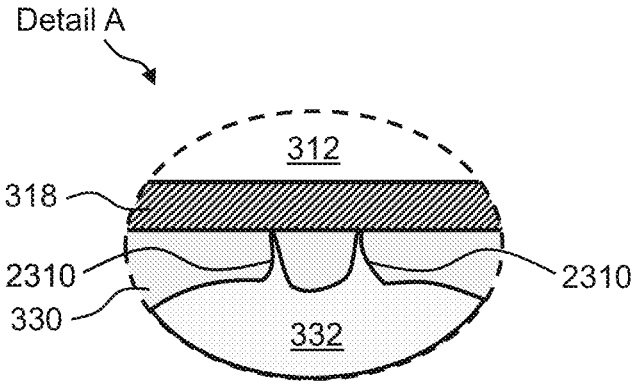

FIG. 23 illustrates a side view of droplet actuator 300 at the moment in time of the droplet operations process in which droplet 332 loses contact with top substrate 312 and Taylor cones are formed. For example, a Detail A of FIG. 23 shows one or more Taylor cones 2310 formed between droplet 332 and top substrate 312 of droplet actuator 300.

As previously described, it has been observed that bubble formation can occur when the droplet loses contact with the top substrate. More particularly, bubble formation appears to occur as the droplet begins to regain contact with the top substrate after losing contact. This contact is made through a Taylor cone or "cone jet" which is a tiny finger of liquid extracted from the droplet interface because of the high electric field that is present between the droplet and the top substrate. Since a Taylor cone is very small and localized, the charges that go through the Taylor cone are also very localized and the film of filler fluid between the droplet and the substrate can become very thin, resulting in break down of the filler fluid or joule heating and therefore bubbles form, particularly at elevated temperatures.

In order to reduce or eliminate bubbles from forming due to Taylor cones certain solutions may be implemented. In one example, if the contact of the droplet to the ground electrode is again made on a large area, i.e., greater than the area covered by a Taylor cone (e.g., about 10 um), no bubbles will form. In another example, the shape, frequency, and/or magnitude of the electrical signal can be controlled in a manner that results in no Taylor cones being formed and thus no bubbles being formed. For example, frequency must be at least the cone frequency, such as at least about 10 kHz.

7.5 Systems

Figure 24:
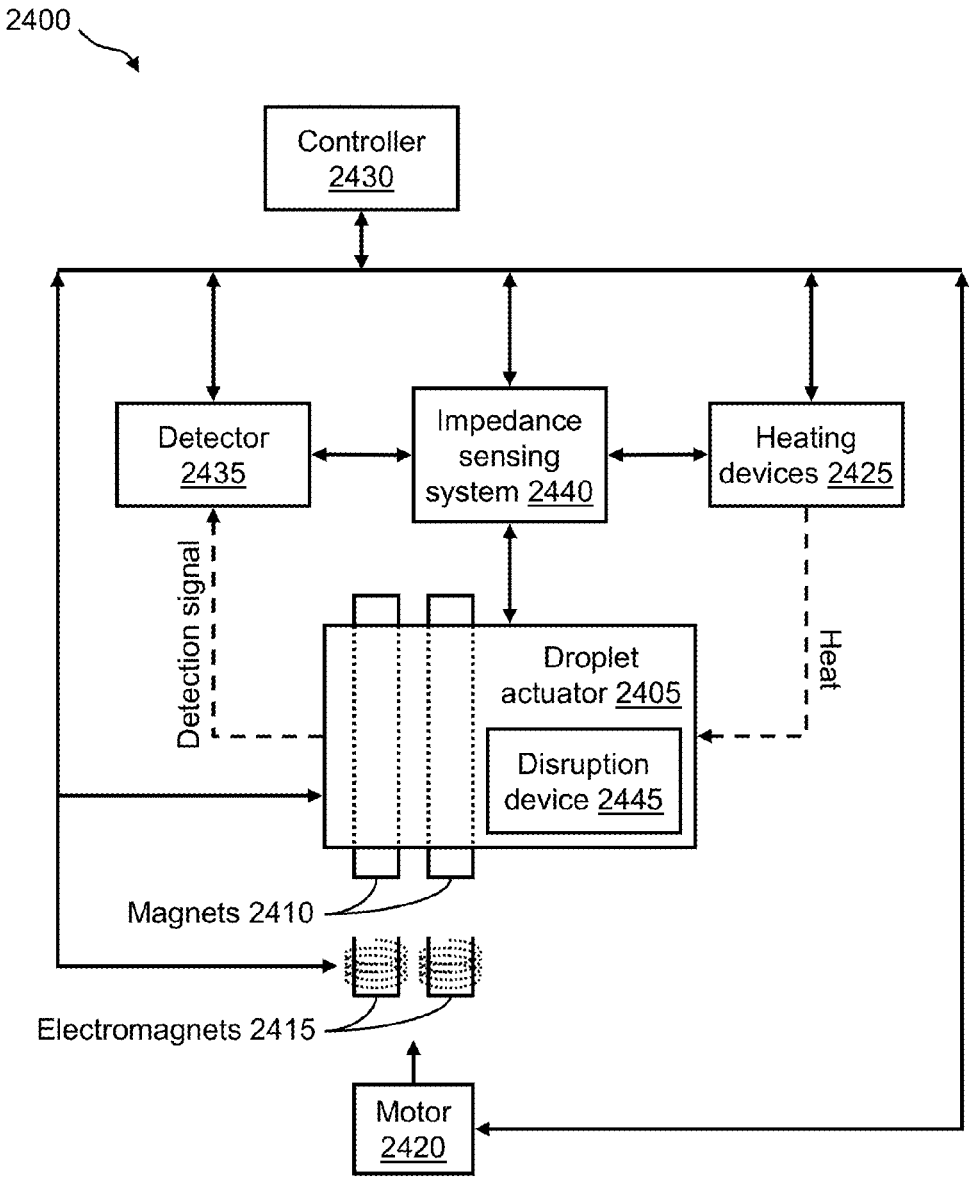
FIG. 24 illustrates a functional block diagram of an example of a microfluidics system that includes a droplet actuator.

FIG. 24 illustrates a functional block diagram of an example of a microfluidics system 2400 that includes a droplet actuator 2405. Digital microfluidic technology conducts droplet operations on discrete droplets in a droplet actuator, such as droplet actuator 2405, by electrical control of their surface tension (electrowetting). The droplets may be sandwiched between two substrates of droplet actuator 2405, a bottom substrate and a top substrate separated by a droplet operations gap. The bottom substrate may include an arrangement of electrically addressable electrodes. The top substrate may include a reference electrode plane made, for example, from conductive ink or indium tin oxide (ITO). The bottom substrate and the top substrate may be coated with a hydrophobic material. Droplet operations are conducted in the droplet operations gap. The space around the droplets (i.e., the gap between bottom and top substrates) may be filled with an immiscible inert fluid, such as silicone oil, to prevent evaporation of the droplets and to facilitate their transport within the device. Other droplet operations may be effected by varying the patterns of voltage activation; examples include merging, splitting, mixing, and dispensing of droplets.

Droplet actuator 2405 may be designed to fit onto an instrument deck (not shown) of microfluidics system 2400. The instrument deck may hold droplet actuator 2405 and house other droplet actuator features, such as, but not limited to, one or more magnets and one or more heating devices. For example, the instrument deck may house one or more magnets 2410, which may be permanent magnets. Optionally, the instrument deck may house one or more electromagnets 2415. Magnets 2410 and/or electromagnets 2415 are positioned in relation to droplet actuator 2405 for immobilization of magnetically responsive beads. Optionally, the positions of magnets 2410 and/or electromagnets 2415 may be controlled by a motor 2420. Additionally, the instrument deck may house one or more heating devices 2425 for controlling the temperature within, for example, certain reaction and/or washing zones of droplet actuator 2405. In one example, heating devices 2425 may be heater bars that are positioned in relation to droplet actuator 2405 for providing thermal control thereof.

A controller 2430 of microfluidics system 2400 is electrically coupled to various hardware components of the invention, such as droplet actuator 2405, electromagnets 2415, motor 2420, and heating devices 2425, as well as to a detector 2435, an impedance sensing system 2440, and any other input and/or output devices (not shown). Controller 2430 controls the overall operation of microfluidics system 2400. Controller 2430 may, for example, be a general purpose computer, special purpose computer, personal computer, or other programmable data processing apparatus. Controller 2430 serves to provide processing capabilities, such as storing, interpreting, and/or executing software instructions, as well as controlling the overall operation of the system. Controller 2430 may be configured and programmed to control data and/or power aspects of these devices. For example, in one aspect, with respect to droplet actuator 2405, controller 2430 controls droplet manipulation by activating/deactivating electrodes.

Detector 2435 may be an imaging system that is positioned in relation to droplet actuator 2405. In one example, the imaging system may include one or more light-emitting diodes (LEDs) (i.e., an illumination source) and a digital image capture device, such as a charge-coupled device (CCD) camera.

Impedance sensing system 2440 may be any circuitry for detecting impedance at a specific electrode of droplet actuator 2405. In one example, impedance sensing system 2440 may be an impedance spectrometer. Impedance sensing system 2440 may be used to monitor the capacitive loading of any electrode, such as any droplet operations electrode, with or without a droplet thereon. For examples of suitable capacitance detection techniques, see Sturmer et al., International Patent Publication No. WO/2008/101194, entitled "Capacitance Detection in a Droplet Actuator," published on Aug. 21, 2008; and Kale et al., International Patent Publication No. WO/2002/080822, entitled "System and Method for Dispensing Liquids," published on Oct. 17, 2002; the entire disclosures of which are incorporated herein by reference.

Droplet actuator 2405 may include disruption device 2445. Disruption device 2445 may include any device that promotes disruption (lysis) of materials, such as tissues, cells and spores in a droplet actuator. Disruption device 2445 may, for example, be a sonication mechanism, a heating mechanism, a mechanical shearing mechanism, a bead beating mechanism, physical features incorporated into the droplet actuator 2405, an electric field generating mechanism, a thermal cycling mechanism, and any combinations thereof. Disruption device 2445 may be controlled by controller 2430.

It will be appreciated that various aspects of the invention may be embodied as a method, system, computer readable medium, and/or computer program product.

Aspects of the invention may take the form of hardware embodiments, software embodiments (including firmware, resident software, micro-code, etc.), or embodiments combining software and hardware aspects that may all generally be referred to herein as a "circuit," "module" or "system." Furthermore, the methods of the invention may take the form of a computer program product on a computer-usable storage medium having computer-usable program code embodied in the medium.

Any suitable computer useable medium may be utilized for software aspects of the invention. The computer-usable or computer-readable medium may be, for example but not limited to, an electronic, magnetic, optical, electromagnetic, infrared, or semiconductor system, apparatus, device, or propagation medium. The computer readable medium may include transitory and/or non-transitory embodiments. More specific examples (a non-exhaustive list) of the computer-readable medium would include some or all of the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission medium such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Program code for carrying out operations of the invention may be written in an object oriented programming language such as Java, Smalltalk, C++ or the like. However, the program code for carrying out operations of the invention may also be written in conventional procedural programming languages, such as the "C" programming language or similar programming languages. The program code may be executed by a processor, application specific integrated circuit (ASIC), or other component that executes the program code. The program code may be simply referred to as a software application that is stored in memory (such as the computer readable medium discussed above). The program code may cause the processor (or any processor-controlled device) to produce a graphical user interface ("GUI"). The graphical user interface may be visually produced on a display device, yet the graphical user interface may also have audible features. The program code, however, may operate in any processor-controlled device, such as a computer, server, personal digital assistant, phone, television, or any processor-controlled device utilizing the processor and/or a digital signal processor.

The program code may locally and/or remotely execute. The program code, for example, may be entirely or partially stored in local memory of the processor-controlled device. The program code, however, may also be at least partially remotely stored, accessed, and downloaded to the processor-controlled device. A user's computer, for example, may entirely execute the program code or only partly execute the program code. The program code may be a stand-alone software package that is at least partly on the user's computer and/or partly executed on a remote computer or entirely on a remote computer or server. In the latter scenario, the remote computer may be connected to the user's computer through a communications network.

The invention may be applied regardless of networking environment. The communications network may be a cable network operating in the radio-frequency domain and/or the Internet Protocol (IP) domain. The communications network, however, may also include a distributed computing network, such as the Internet (sometimes alternatively known as the "World Wide Web"), an intranet, a local-area network (LAN), and/or a wide-area network (WAN). The communications network may include coaxial cables, copper wires, fiber optic lines, and/or hybrid-coaxial lines. The communications network may even include wireless portions utilizing any portion of the electromagnetic spectrum and any signaling standard (such as the IEEE 802 family of standards, GSM/CDMA/TDMA or any cellular standard, and/or the ISM band). The communications network may even include powerline portions, in which signals are communicated via electrical wiring. The invention may be applied to any wireless/wireline communications network, regardless of physical componentry, physical configuration, or communications standard(s).

Certain aspects of invention are described with reference to various methods and method steps. It will be understood that each method step can be implemented by the program code and/or by machine instructions. The program code and/or the machine instructions may create means for implementing the functions/acts specified in the methods.

The program code may also be stored in a computer-readable memory that can direct the processor, computer, or other programmable data processing apparatus to function in a particular manner, such that the program code stored in the computer-readable memory produce or transform an article of manufacture including instruction means which implement various aspects of the method steps.

The program code may also be loaded onto a computer or other programmable data processing apparatus to cause a series of operational steps to be performed to produce a processor/computer implemented process such that the program code provides steps for implementing various functions/acts specified in the methods of the invention.

CONCLUDING REMARKS

The foregoing detailed description of embodiments refers to the accompanying drawings, which illustrate specific embodiments of the invention. Other embodiments having different structures and operations do not depart from the scope of the present invention. The term "the invention" or the like is used with reference to certain specific examples of the many alternative aspects or embodiments of the applicants' invention set forth in this specification, and neither its use nor its absence is intended to limit the scope of the applicants' invention or the scope of the claims. This specification is divided into sections for the convenience of the reader only. Headings should not be construed as limiting of the scope of the invention. The definitions are intended as a part of the description of the invention. It will be understood that various details of the present invention may be changed without departing from the scope of the present invention. Furthermore, the foregoing description is for the purpose of illustration only, and not for the purpose of limitation.

What is claimed:

1. A method of performing droplet operations on a droplet in a droplet actuator, comprising:

providing the droplet actuator, comprising:

a top substrate and a bottom substrate separated to form a droplet operations gap;

a conductive layer in contact with a surface of the top substrate, wherein the conductive layer provides a ground plane;

a dielectric layer in contact with the conductive layer, wherein an area of the dielectric layer has a sawtooth texture that extends into the droplet operations gap;

an arrangement of droplet operations electrodes in contact with the bottom substrate and arranged for conducting droplet operations thereon;

filling the droplet operations gap of the droplet actuator with a filler fluid;

providing a droplet in the droplet operations gap;

conducting multiple droplet operations on the droplet in the droplet operations gap, wherein the droplet is transported through the filler fluid in the droplet operations gap; and maintaining substantially consistent contact between the droplet and the sawtooth structure, and thus an electrical ground at the ground plane, while conducting the multiple droplet operations on the droplet in the droplet operations gap;

wherein the substantially consistent contact between the droplet and the electrical ground permits completion of the multiple droplet operations without interruption by bubble formation in the filler fluid in the droplet operations gap.

2. The method according to claim 1, further comprising heating the droplet in the droplet operations gap.

3. The method according to claim 1, further comprising heating the droplet in the droplet operations gap to at least sixty percent of a boiling point of the droplet.

4. The method according to claim 1, wherein conducting the multiple droplet operations comprises conducting at least 10 droplet operations without the interruption by the bubble formation in the filler fluid in the droplet operations gap.

5. The method according to claim 1, further comprising heating the droplet in the droplet operations gap to at least sixty percent of a boiling point of the droplet, wherein conducting the multiple droplet operations comprises conducting at least 10 droplet operations without the interruption by the bubble formation in the filler fluid in the droplet operations gap.

6. The method according to claim 5, wherein conducting the multiple droplet operations comprises conducting at least 100 droplet operations without the interruption by the bubble formation in the filler fluid in the droplet operations gap.

7. The method according to claim 5, wherein conducting the multiple droplet operations comprises conducting at least 1,000 droplet operations without the interruption by the bubble formation in the filler fluid in the droplet operations gap.

8. The method according to claim 5, wherein conducting the multiple droplet operations comprises conducting at least 100,000 droplet operations without the interruption by the bubble formation in the filler fluid in the droplet operations gap.

9. The method according to claim 1, further comprising heating the droplet in the droplet operations gap to at least sixty percent of a boiling point of the droplet, wherein conducting the multiple droplet operations comprises completing an assay without the interruption by the bubble formation in the filler fluid in the droplet operations gap.

10. The method according to claim 1, further comprising heating the droplet in the droplet operations gap to at least sixty percent of a boiling point of the droplet, wherein conducting the multiple droplet operations comprises completing multiple cycles of a polymerase chain reaction without the interruption by the bubble formation in the filler fluid in the droplet operations gap.

11. The method according to claim 1, further comprising heating the droplet in the droplet operations gap to a minimum temperature of seventy five degrees Celsius, wherein conducting the multiple droplet operations comprises completing an assay without the interruption by the bubble formation in the filler fluid in the droplet operations gap.

12. The method according to claim 1, further comprising heating the droplet in the droplet operations gap to within twenty degrees Celsius of a boiling point of the droplet, wherein conducting the multiple droplet operations comprises completing an assay without the interruption by the bubble formation in the filler fluid in the droplet operations gap.

13. The method according to claim 1, wherein the droplet comprises multiple droplets in the droplet operations gap, and wherein substantially consistent contact is maintained between multiple droplets and the electrical ground while conducting multiple droplet operations on the multiple droplets in the droplet operations gap.

14. The method according to claim 1, wherein the filler fluid is an electrically conductive filler fluid.

15. The method according to claim 1, further comprising merging the droplet with another droplet to maintain the substantially consistent contact with the electrical ground while conducting the multiple droplet operations on the droplet in the droplet operations gap.

16. A method of performing droplet operations on a droplet in a droplet actuator, comprising:

providing the droplet actuator comprising a top substrate and a bottom substrate separated to form a droplet operations gap, wherein the droplet actuator further comprises an arrangement of droplet operations electrodes arranged for conducting droplet operations thereon;

filling the droplet operations gap of the droplet actuator with a filler fluid;

providing the droplet in the droplet operations gap;

conducting multiple droplet operations on the droplet in the droplet operations gap, wherein the droplet is transported through the filler fluid in the droplet operations gap; and adjusting a height of the droplet operations gap to maintain substantially consistent contact between the droplet and an electrical ground while conducting the multiple droplet operations on the droplet in the droplet operations gap;

wherein the substantially consistent contact between the droplet and the electrical ground permits completion of the multiple droplet operations without interruption by bubble formation in the filler fluid in the droplet operations gap.

17. The method according to claim 16, further comprising grounding the top substrate of the droplet actuator to the electrical ground and maintaining substantially consistent contact between the droplet and the top substrate while conducting the multiple droplet operations on the droplet in the droplet operations gap.

18. The method according to claim 16, further comprising reducing the height of the droplet operations gap to maintain the substantially consistent contact between the droplet and the electrical ground while conducting the multiple droplet operations on the droplet in the droplet operations gap.

19. The method according to claim 16, further comprising adjusting the height of the droplet operations gap with a spring to maintain the substantially consistent contact between the droplet and electrical ground while conducting the multiple droplet operations on the droplet in the droplet operations gap.

20. A method of performing droplet operations on a droplet in a droplet actuator, comprising:

providing the droplet actuator comprising a top substrate and a bottom substrate separated to form a droplet operations gap, wherein the droplet actuator further comprises an arrangement of droplet operations electrodes arranged for conducting droplet operations thereon;

filling the droplet operations gap of the droplet actuator with a filler fluid;

providing the droplet in the droplet operations gap;

conducting multiple droplet operations on the droplet in the droplet operations gap, wherein the droplet is transported through the filler fluid in the droplet operations gap; and moving an electrical ground toward the droplet to maintain substantially consistent contact between the droplet and the electrical ground while conducting the multiple droplet operations on the droplet in the droplet operations gap;

wherein the substantially consistent contact between the droplet and the electrical ground permits completion of the multiple droplet operations without interruption by bubble formation in the filler fluid in the droplet operations gap.

21. The method according to claim 20 wherein:

the droplet actuator further comprises a plate and a set of adjustable ground probes that are electrically connected to the electrical ground;

the top substrate includes openings for respectively fitting the adjustable ground probes therethrough in a slidable fashion; and the moving of the electrical ground toward the droplet is accomplished by pushing the plate toward the top substrate so that a tip of each of the adjustable ground probes extends through the openings and into the droplet operations gap.

22. The method according to claim 21 wherein the plate and the set of adjustable group probes are provided in a heated region of the droplet actuator.

23. A method of performing droplet operations on a droplet in a droplet actuator, comprising:

providing the droplet actuator comprising a top substrate and a bottom substrate separated to form a droplet operations gap, wherein the droplet actuator further comprises an arrangement of droplet operations electrodes arranged for conducting droplet operations thereon;

bounding the droplet operations gap with a sidewall and an opposite sidewall to create a droplet operations channel;

arranging the droplet operations electrodes on the sidewall;

arranging one or more ground electrodes along the opposite sidewall;

connecting the one or more ground electrodes to an electrical ground;

filling the droplet operations gap of the droplet actuator with a filler fluid;

providing the droplet in the droplet operations gap;

conducting multiple droplet operations on the droplet in the droplet operations gap, wherein the droplet is transported through the filler fluid in the droplet operations gap; and maintaining substantially consistent contact between the droplet and the electrical ground while conducting the multiple droplet operations on the droplet in the droplet operations gap;

wherein the substantially consistent contact with the electrical ground while conducting the multiple droplet operations on the droplet in the droplet operations gap is unaffected by gravity;

and wherein the substantially consistent contact between the droplet and the electrical ground permits completion of the multiple droplet operations without interruption by bubble formation in the filler fluid in the droplet operations gap.

24. The method according to claim 23, wherein the sidewall comprises a first rail and the opposite sidewall comprises a second rail, wherein the first rail and second rail are elongated three-dimensional (3D) structures that are arranged in parallel with each other.

25. The method according to claim 23, further comprising offsetting positions of the droplet operations electrodes and the position of the one or more ground electrodes.

26. The method according to claim 23, wherein the one or more ground electrodes are a continuous strip.

27. The method according to claim 23, further comprising oppositely arranging each droplet operations electrode to each of the one or more ground electrodes.

28. A method of performing droplet operations on a droplet in a droplet actuator, comprising:

providing the droplet actuator comprising a top substrate and a bottom substrate separated to form a droplet operations gap, wherein the droplet actuator further comprises an arrangement of droplet operations electrodes arranged for conducting droplet operations thereon;

bounding the droplet operations gap with a sidewall and an opposite sidewall to create a droplet operations channel;

arranging the droplet operations electrodes on the sidewall;

arranging one or more ground electrodes along the bottom substrate;

connecting the one or more ground electrodes to an electrical ground;

filling the droplet operations gap of the droplet actuator with a filler fluid;

providing the droplet in the droplet operations gap;

conducting multiple droplet operations on the droplet in the droplet operations gap, wherein the droplet is transported through the filler fluid in the droplet operations gap; and maintaining substantially consistent contact between the droplet and the electrical ground while conducting the multiple droplet operations on the droplet in the droplet operations gap;

wherein the substantially consistent contact with the electrical ground while conducting the multiple droplet operations on the droplet in the droplet operations gap is unaffected by gravity;

and wherein the substantially consistent contact between the droplet and the electrical ground permits completion of the multiple droplet operations without interruption by bubble formation in the filler fluid in the droplet operations gap.

29. The method according to claim 28, wherein the sidewall comprises a first rail and the opposite sidewall comprises a second rail, wherein the first rail and second rail are elongated three-dimensional (3D) structures that are arranged in parallel with each other.

30. A method of performing droplet operations on a droplet in a droplet actuator, comprising:

providing the droplet actuator comprising a top substrate and a bottom substrate separated to form a droplet operations gap, wherein the droplet actuator further comprises an arrangement of droplet operations electrodes arranged for conducting droplet operations thereon;

filling the droplet operations gap of the droplet actuator with a filler fluid;

providing the droplet in the droplet operations gap;

conducting multiple droplet operations on the droplet in the droplet operations gap, wherein the droplet is transported through the filler fluid in the droplet operations gap and wherein conducting the multiple droplet operations includes:

heating the droplet in the droplet operations gap;

applying a voltage to transport the droplet from an unactivated electrode to an activated electrode; and reducing electrical charges in the droplet operations gap as the droplet is transported to the activated electrode by adjusting a height of the droplet operations gap; and maintaining substantially consistent contact between the droplet and the electrical ground while conducting the multiple droplet operations on the droplet in the droplet operations gap;

wherein bubble formation in the filler fluid in the droplet operations gap is reduced or eliminated;

and wherein the substantially consistent contact between the droplet and the electrical ground permits completion of the multiple droplet operations without interruption by bubble formation in the filler fluid in the droplet operations gap.

31. The method according to claim 30, further comprising reducing the height of the droplet operations gap to reduce the electrical charges.

32. The method according to claim 30, further comprising texturing a surface of the top substrate to reduce the electrical charges.

33. A method of performing droplet operations on a droplet in a droplet actuator, comprising:

providing the droplet actuator comprising a top substrate and a bottom substrate separated to form a droplet operations gap, wherein the droplet actuator further comprises an arrangement of droplet operations electrodes arranged for conducting droplet operations thereon;

filling the droplet operations gap of the droplet actuator with a filler fluid;

providing the droplet in the droplet operations gap;

conducting multiple droplet operations on the droplet in the droplet operations gap, wherein the droplet is transported through the filler fluid in the droplet operations gap and wherein conducting the multiple droplet operations includes:

heating the droplet in the droplet operations gap;

applying a voltage to transport the droplet from an unactivated electrode to an activated electrode; and reducing discharge of electrical charges as the droplet is transported to the activated electrode by adjusting a height of the droplet operations gap; and maintaining substantially consistent contact between the droplet and the electrical ground while conducting the multiple droplet operations on the droplet in the droplet operations gap;

wherein bubble formation in the filler fluid in the droplet operations gap is reduced or eliminated;

and wherein the substantially consistent contact between the droplet and the electrical ground permits completion of the multiple droplet operations without interruption by bubble formation in the filler fluid in the droplet operations gap.

34. The method according to claim 33, further comprising reducing the height of the droplet operations gap to reduce the discharge of electrical charges.

35. The method according to claim 33, further comprising texturing a surface of the top substrate of the droplet operations gap to reduce the discharge of electrical charges.

36. A system for performing droplet operations on a droplet in a droplet actuator, comprising a processor for executing code and a memory in communication with the processor, the system comprising code stored in the memory that causes the processor at least to:

provide the droplet in a droplet operations gap of the droplet actuator, wherein the droplet actuator comprises a top substrate and a bottom substrate separated to form the droplet operations gap, and wherein the droplet actuator further comprises an arrangement of droplet operations electrodes arranged for conducting droplet operations thereon;

fill the droplet operations gap of the droplet actuator with a filler fluid;

heat the droplet in a zone of the droplet operations gap to within twenty degrees Celsius of boiling to produce a heated droplet;

conduct multiple droplet operations on the heated droplet in the droplet operations gap, wherein the heated droplet is transported through the filler fluid in the zone of the droplet operations gap; and adjust a height of the droplet operations gap to maintain substantially consistent contact between the heated droplet and an electrical ground while conducting the multiple droplet operations on the heated droplet in the zone of the droplet operations gap;

wherein the substantially consistent contact between the heated droplet and the electrical ground permits completion of the multiple droplet operations without interruption by bubble formation in the filler fluid in the zone of the droplet operations gap.

* * * * *